US006686141B2

(12) United States Patent
Uchida

(10) Patent No.: US 6,686,141 B2
(45) Date of Patent: Feb. 3, 2004

(54) SILVER HALIDE PHOTOGRAPHIC LIGHT-SENSITIVE MATERIAL AND METHOD OF FORMING IMAGE THEREIN

(75) Inventor: Minoru Uchida, Minami-Ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 45 days.

(21) Appl. No.: 09/875,902

(22) Filed: Jun. 8, 2001

(65) Prior Publication Data

US 2002/0055070 A1 May 9, 2002

(30) Foreign Application Priority Data

Jun. 8, 2000 (JP) ..... 2000-172800

(51) Int. Cl.[7] ..... G03C 1/035
(52) U.S. Cl. ..... 430/567; 430/569
(58) Field of Search ..... 430/566, 567, 430/569

(56) References Cited

U.S. PATENT DOCUMENTS

| | | | | |
|---|---|---|---|---|
| 5,565,314 A | * | 10/1996 | Nakatsu et al. | 430/567 |
| 5,677,104 A | * | 10/1997 | Hirai et al. | 430/203 |
| 5,981,162 A | * | 11/1999 | Hioki et al. | 430/580 |
| 6,048,681 A | * | 4/2000 | Suzumoto et al. | 430/567 |

FOREIGN PATENT DOCUMENTS

| | | | |
|---|---|---|---|
| JP | 8-146570 | 6/1996 | G03C/5/29 |
| JP | 10-115888 | 5/1998 | G03C/1/42 |

* cited by examiner

*Primary Examiner*—Hoa Van Le
(74) *Attorney, Agent, or Firm*—Sughrue Mion, PLLC

(57) ABSTRACT

A silver halide photographic light-sensitive material comprising, on a support, at least one light-sensitive silver halide emulsion layer and at least one non-light-sensitive layer, wherein 60% or more of the total projected area of silver halide grains contained in said at least one light-sensitive silver halide emulsion layer are tabular silver halide grains having an average aspect ratio of 5 or more, and a film pAg on the light-sensitive silver halide emulsion layer side of said material falls within 4.0 to 8.5.

20 Claims, No Drawings

SILVER HALIDE PHOTOGRAPHIC LIGHT-SENSITIVE MATERIAL AND METHOD OF FORMING IMAGE THEREIN

CROSS-REFERENCE TO RELATED APPLICATIONS

This application is based upon and claims the benefit of priority from the prior Japanese Patent Application No. 2000-172800, filed Jun. 8, 2000, the entire contents of which are incorporated herein by reference.

BACKGROUND OF THE INVENTION

The present invention relates to a novel silver halide photographic light-sensitive material for image recording (hereinafter may simply be referred to as "light-sensitive material") and a method of forming an image therein. More particularly, the present invention relates to a silver halide photographic light-sensitive material which is highly sensitive and is excellent in rapid processability and a method of forming an image therein.

Now, high-quality recorded images can easily be obtained by the use of a photographic light-sensitive material based on a silver halide. For example, generally, in the system known as "color photography", photography is first performed with the use of a color negative film. Then, the color negative film is developed, and the image information recorded in the developed color negative film is optically printed on color photographic paper. Thus, a color print is obtained. In recent years, this process has been highly progressed, and now everyone can readily enjoy color photographs by virtue of the spread of color laboratories which are large-scale centers where a large number of color prints can be produced with high efficiency, or so-called "minilabos" which are small simple printer processors installed at shops.

Although the above system is now widely spread, the demand for greater simplicity thereof is increasing. For example, first, with respect to the processing baths for carrying out development, bleaching and fixing, it is needed to accurately control the composition and the temperature thereof, so that expert knowledge and skilled operation are required. Secondly, the processing solutions contain developing agents, chelate compounds as bleaching agents and other substances whose effluence must be regulated from the viewpoint of the environment, so that special equipment may be needed at the installation of the developing apparatus. Thirdly, development requires much time, although it has been shortened as a result of technical development in recent years, so that meeting the demands for rapid reproduction of recorded images is still unsatisfactory. As is apparent from the above, there still remains room for improvement in the system.

Also, requirements on the light-sensitive material are becoming stricter. Higher demands are being imposed on photographic performance such as sensitivity increase, image quality such as graininess or sharpness, and toughness such as storage stability or pressure resistance.

Rapidly processable light-sensitive materials containing tabular silver halide grains are disclosed in, for example, Jpn. Pat. Appln. KOKAI Publication Nos. (hereinafter referred to as JP-A's) 10-115888, 10-62936, 9-61960 and 62-78555. The technologies disclosed in these publications, although enabling production of highly sensitive and rapidly processable light-sensitive materials, are still unsatisfactory in respect of toughness, such as storage stability or pressure resistance, of light-sensitive material. Further, the technologies for finely controlling the film pAg of light-sensitive material are disclosed in, for example, JP-A's 8-146570 and 4-324856. The light-sensitive materials disclosed in these publications, although being excellent in rapid processability, are light-sensitive materials wherein an emulsion constituted of regular grains is used as silver halide grains, so that these are conspicuously inferior, in respect of sensitivity and image quality from the viewpoint of practical application, to the light-sensitive material for photography wherein use is made of an emulsion constituted of tabular silver halide grains according to the present invention.

BRIEF SUMMARY OF THE INVENTION

It is an object of the present invention to provide a silver halide color photographic light-sensitive material, which is highly sensitive, ensures high image quality and is excellent in storage stability despite easy rapid processing. It is another object of the present invention to provide a method of forming an image, which can stand practical use.

These objects of the present invention have been attained by the following means. That is, the means include:

(I) A silver halide photographic light-sensitive material comprising, on a support, at least one light-sensitive silver halide emulsion layer and at least one non-light-sensitive layer, wherein 60% or more of the total projected area of silver halide grains contained in the at least one light-sensitive silver halide emulsion layer are tabular silver halide grains having an average aspect ratio of 5 or more, and a film pAg on the light-sensitive silver halide emulsion layer side of the material falls within 4.0 to 8.5.

(II) The material according to item (I), wherein the tabular silver halide grains have an average thickness of 0.01 to 0.12 $\mu$m.

(III) The material according to item (I), wherein at least some of the tabular silver halide grains have a sensitizing dye adsorbed thereon so as to exhibit a spectral absorption maximum wavelength of less than 500 nm and a light absorption intensity of 60 or more, or so as to exhibit a spectral absorption maximum wavelength of 500 nm or more and a light absorption intensity of 100 or more.

(IV) The material according to item (I), wherein a developing agent and/or a precursor thereof is contained in the at least one light-sensitive silver halide emulsion layer and/or the at least one non-light-sensitive layer.

(V) The material according to item (IV), wherein the developing agent is at least one compound selected from among the compounds represented by the following general formulae (1) to (5):

(1)

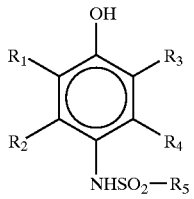

(2)

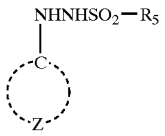

-continued (3)

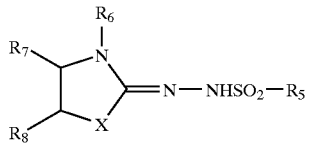

(4)

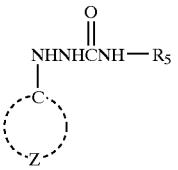

(5)

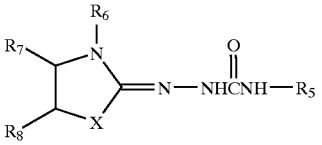

where each of $R_1$ to $R_4$ independently represents a hydrogen atom, a halogen atom, an alkyl group, an aryl group, an alkylcarbonamido group, an arylcarbonamido group, an alkylsulfonamido group, an arylsulfonamido group, an alkoxy group, an aryloxy group, an alkylthio group, an arylthio group, an alkylcarbamoyl group, an arylcarbamoyl group, a carbamoyl group, an alkylsulfamoyl group, an arylsulfamoyl group, a sulfamoyl group, a cyano group, an alkylsulfonyl group, an arylsulfonyl group, an alkoxycarbonyl group, an aryloxycarbonyl group, an alkylcarbonyl group, an arylcarbonyl group or an acyloxy group; $R_5$ represents a substituted or unsubstituted alkyl group, aryl group or heterocyclic group; Z represents an atom group (including a carbon atom of the formula) capable of forming an aromatic ring (including a heteroaromatic ring), which may have substituents other than —NHNHSO$_2$-R$_5$ or —NHNHCONH-R$_5$, provided that when Z is a benzene ring, the total of Hammett's constants ($\sigma$) of the substituents is 1 or more; $R_6$ represents a substituted or unsubstituted alkyl group; X represents an oxygen atom, a sulfur atom, a selenium atom or a tertiary nitrogen atom substituted with an alkyl or aryl; and each of $R_7$ and $R_8$ independently represents a hydrogen atom or a substituent, wherein $R_7$ and $R_8$ may be bonded to each other to thereby form a double bond or a ring.

(VI) The material according to item (IV), wherein the developing agent is a p-phenylenediamine compound and/or a p-aminophenol compound.

(VII) The material according to item (IV), wherein the developing agent precursor is a compound represented by the following general formula (6):

(6)

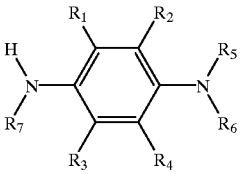

where each of $R_1$, $R_2$, $R_3$ and $R_4$ independently represents a hydrogen atom or a substituent; each of $R_5$ and $R_6$ independently represents an alkyl group, an aryl group, a heterocyclic group, an acyl group or a sulfonyl group; $R_1$ and $R_2$, $R_3$ and $R_4$, $R_5$ and $R_6$, $R_2$ and $R_5$, and/or $R_4$ and $R_6$ may be bonded to each other to thereby form a 5-membered, 6-membered or 7-membered ring; and $R_7$ represents $R_{11}$-O—CO—, $R_{12}$-CO—CO—, $R_{13}$-NH—CO—, $R_{14}$-SO$_2$—, $R_{15}$-W—C ($R_{16}$)($R_{17}$)- or $(M)_{1/n}$ OSO$_2$—, wherein each of $R_{11}$, $R_{12}$, $R_{13}$ and $R_{14}$ independently represents an alkyl group, an aryl group or a heterocyclic group, $R_{15}$ represents a hydrogen atom or a block group, W represents an oxygen atom, a sulfur atom or >N-$R_{18}$, each of $R_{16}$, $R_{17}$ and $R_{18}$ independently represents a hydrogen atom or an alkyl group, and M represents a n-valence cation.

(VIII) The material according to item (I), wherein an organometallic salt is contained in the at least one light-sensitive silver halide emulsion layer and/or the at least one nonlight-sensitive layer.

(IX) A method of forming an image in the silver halide photographic light-sensitive material of item (I), which comprises a development performed at 60 to 180° C.

(X) A method of forming an image in the silver halide photographic light-sensitive material of item (I), which comprises a development performed for a period of 5 to 60 sec.

(XI) The material according to item (I), wherein the film pAg falls within 5.0 to 7.5.

(XII) The material according to item (I), wherein the average aspect ratio of the tabular silver halide grains is 8 to 60.

(XIII) The material according to item (III), wherein the sensitizing dye is a dye having at least one aromatic group.

(XIV) The material according to item (XIII), wherein the sensitizing dye consists of a positively charged dye, or a dye having intra-molecularly offset charge, or a dye having no charge.

(XV) The material according to item (III), wherein the sensitizing dye comprises a combination of a positively charged dye and a negatively charged dye, and at least one of them has at least one aromatic group as a substituent.

(XVI) The material according to item (III), wherein the sensitizing dye is a dye compound having two or more chromophore portions linked to each other by a covalent bond through a linking group.

(XVII) The material according to item (I), wherein the tabular silver halide grains have an average thickness of 0.01 to 0.07 $\mu$m.

(XVIII) The material according to item (I), wherein at least some of the tabular silver halide grains have a sensitizing dye adsorbed thereon so as to exhibit a spectral absorption maximum wavelength of less than 500 nm and a light absorption intensity of 90 or more, or so as to exhibit a spectral absorption maximum wavelength of 500 nm or more and a light absorption intensity of 150 or more.

A highly sensitive light-sensitive material which ensures prolonged storage life and enables rapidly forming high-quality images can be provided by the present invention.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

DETAILED DESCRIPTION OF THE INVENTION

The present invention will be described in detail below.

In the present invention, an original image is first obtained on a light-sensitive material, and, on the basis of information thereof, a desired image is obtained on a recording material separate from the light-sensitive material.

In the present invention, in the constitution of a light-sensitive material used to record an original scene and to reproduce the same as a color image, use can fundamentally be made of color reproduction according to the subtractive color process. For example, color information of an original scene can be recorded by disposing at least three light-sensitive layers having lightsensitivity in blue, green and red regions and by incorporating, in the light-sensitive layers, color couplers capable of forming yellow, magenta and cyan dyes which are in complementary relationship to their own light-sensitive wavelength regions. The image for appreciation can be reproduced by subjecting a color light-sensitive material having a similar relationship between light-sensitive wavelength and colored hue to exposure through the thus obtained dye image. Also, it is practicable to photoelectrically read information on image obtained by photography of an original scene by means of, for example, a scanner and to output an image for appreciation on the basis of the read information. Immediately reading image information after the color development but prior to a desilvering step is preferred from the viewpoint of rapid processing. Furthermore, using the image information, without removing unreacted silver halides at the time of development to thereby cause silver halides to substantially remain, as an original manuscript is preferred from the viewpoint of processing speed increase and process simplification. The material on which the output is effected may be a sublimation-type heat-sensitive recording material, a full color direct heat-sensitive recording material, an ink jet material or an electrophotographic material, as well as the light-sensitive material based on silver halides.

It is also practicable to provide a relationship other than the above complementary one between the light-sensitive wavelength region and colored hue. In that instance, the original color information can be reproduced by implementing image processing such as hue conversion after the above capturing of image information.

Light-sensitive layers having lightsensitivity in three or more wavelength regions can be provided in the light-sensitive material of the present invention. For example, light-sensitive layers having lightsensitivity in not only blue, green and red visible regions but also the infrared wavelength region can be provided in the light-sensitive material.

The light-sensitive material of the present invention can be used as not only B/W light-sensitive materials but also various color light-sensitive materials such as general-purpose or movie color negative films and slide or television color reversal films, color papers, color positive films, color reversal papers and color diffusion transfer films.

The expression "method of forming an image, which can stand practical use" used herein means exposing, with an exposure quantity corresponding to effective photographing region, the above light-sensitive material constituted so as to enable formation of an image with photographic performance (sensitivity, gradation, color reproduction, graininess, sharpness and toughness) that can stand practical use as merchandise and developing the exposed light-sensitive material so as to enable obtaining a recorded image that can stand practical use. In the use as a light-sensitive material for photographing, the exposure is generally performed for 1/10,000 to 10 sec. Although the temperature at which the development is performed can be arbitrarily selected, it is preferred from the viewpoint of rapid processing that the temperature range from 60 to 180° C., especially from 80 to 160° C. The development time is preferably selected from among 5 to 60 sec, more preferably 5 to 45 sec.

The light-sensitive material of the present invention comprises a support and, superimposed thereon, at least one light-sensitive silver halide emulsion layer and at least one nonlight-sensitive layer. A characteristic of the light-sensitive material of the present invention is that the film pAg on the light-sensitive silver halide emulsion layer side falls within a specified range.

The expression "film pAg on the light-sensitive silver halide emulsion layer side" used herein means the pAg in terms of the all-layer total on the light-sensitive silver halide emulsion layer side of the support. The film pAg of the present invention is in the range of 4.0 to 8.5, preferably 5.0 to 7.5. The film pAg value is determined by first completely removing hydrophilic colloid layers from the back side of the light-sensitive material, subsequently immersing an 8 cm×12 cm size light-sensitive material in 100 milliliters of distilled water for 5 min and thereafter measuring the pAg of the distilled water with the use of a silver electrode and a comparative electrode (calomel electrode). The regulation of film pAg can be accomplished by loading, for example, a light-sensitive silver halide emulsion layer and/or a nonlight-sensitive layer with a solution of Ag ion such as $AgNO_3$ or an aqueous solution of halide such as KBr or NaCl. However, the regulation means is not limited thereto, and any other means available for changing pAg can be employed. Regulating the film pAg so as to fall within the above range strikingly enhances the rapid processability and storage stability.

In the present invention, the terminology "tabular silver halide grains (hereinafter referred to as "tabular grains")" means silver halide grains having two mutually opposite parallel principal planes and having an aspect ratio of 2 or more. Among these, tabular grains having an average aspect ratio of 5 or more are referred to as the tabular grains of the present invention. The tabular grains will be described in detail below.

In the present invention, the aspect ratio of tabular grains is defined as the quotient of the equivalent circle diameter (diameter of a circle with the same projected area as that of the principal planes) of the two mutually opposite parallel principal planes divided by the spacing of the principal planes (i.e., thickness of the tabular grains). The average aspect ratio is a number average calculated from the respective aspect ratios of individual tabular grains.

In the light-sensitive material of the present invention, 60% or more of the total projected area of silver halide grains contained in at least one light-sensitive silver halide emulsion layer are tabular silver halide grains having an average aspect ratio of 5 to 100. For realizing the exertion of the effects of the present invention, it is more preferred that tabular grains having an average aspect ratio of 8 to 60 be contained. It is most preferred that tabular grains having an average aspect ratio of 10 to 30 be contained. When the average aspect ratio is less than 5, making the best use of the advantages (enhancement of sensitivity and image quality) of tabular grains cannot be attained. On the other hand, when the average aspect ratio exceeds 100, the pressure resistance is unfavorably deteriorated. Further, in the present invention, in the emulsion of the at least one light-sensitive silver halide emulsion layer, the tabular grains of the present invention occupy 60% or more, more preferably 80% or more, and most preferably 90% or more, of the total projected area of all the light-sensitive silver halide grains. When the ratio is less than 60%, unfavorably, making the best use of the advantages of tabular grains cannot be attained.

In the present invention, the average grain thickness is an arithmetic mean of the respective thicknesses of all the tabular grains. The average grain thickness of the tabular grains of the present invention is preferably in the range of 0.01 to 0.3 μm, more preferably 0.01 to 0.12 μm, and most preferably 0.01 to 0.07 μm. When the average grain thickness is less than 0.01 μm, the pressure resistance is unfavorably deteriorated. On the other hand, when the average grain thickness exceeds 0.3 μm, it is unfavorably difficult to attain the effects of the present invention.

In the present invention, although the grain thickness and aspect ratio falling within the above ranges can be selected according to the intended use, it is preferred to employ tabular grains of small grain thickness and high aspect ratio.

Although the diameter (equivalent circle diameter) of the tabular grains of the present invention can be selected arbitrarily, preferably, selection is so made that the average equivalent circle diameter being an arithmetic mean of the respective equivalent circle diameters of all the tabular grains ranges from 0.3 to 20 μm, more preferably 0.5 to 10 μm. When the average equivalent circle diameter is less than 0.3 μm, it is unfavorably difficult to obtain the effects of the present invention. On the other hand, when the average equivalent circle diameter exceeds 20 μm, the pressure resistance is unfavorably deteriorated.

The grain diameter and grain thickness can be determined from an electron micrograph of grains by, for example, the method described in U.S. Pat. No. 4,434,226. One method of determining the aspect ratio comprises taking a transmission electron micrograph according to the replica method and, from the transmission electron micrograph, measuring the diameter of a circle having the same area as the projected area of each individual grain (equivalent circle diameter) and the thickness thereof. In this method, the thickness can be calculated from the length of the shadow of the replica.

In the present invention, it is preferred that the tabular grains be monodispersive. The variation coefficient of grain diameter distribution of tabular grains having an average aspect ratio of 2 or more is preferably 35% or less, more preferably 25% or less, and most preferably 20% or less. Variation coefficients exceeding 35% are unfavorable from the viewpoint of inter-granular homogeneity. The terminology "variation coefficient of grain diameter distribution" used herein means the value obtained by dividing the dispersion (standard deviation) of equivalent sphere diameters of individual silver halide grains by the average equivalent sphere diameter to thereby obtain a quotient and multiplying the resultant quotient by 100. (The terminology "equivalent sphere diameter" used herein means the diameter of a sphere having the same volume as that of tabular grains.) The grain size distribution of a silver halide emulsion consisting of a group of silver halide grains whose configuration is undiversified and whose grain size mathematical dispersion is small exhibits a substantially normal distribution, so that the standard deviation thereof can be easily determined.

The preparation of monodispersed tabular grains is described in JP-A-63-11928. Monodispersed hexagonal tabular grains are described in JP-A-63-151618. Circular monodispersed tabular grain emulsions are described in JP-A-1-131541. Further, JP-A-2-838 discloses an emulsion which is occupied in an amount of 95% or more of the total projected area thereof by tabular grains having two twin faces parallel to the principal planes, the size distribution of these tabular grains being monodispersed. EP No. 514,742A1 discloses an emulsion of tabular grains exhibiting a grain size variation coefficient of 10% or less, prepared from polyalkylene oxide block copolymers.

Tabular grains whose principal surfaces consist of (100) faces on the one hand and (111) faces on the other hand are known. The technology of the present invention can be applied to both types of tabular grains. The former type, regarding silver bromide, is described in U.S. Pat. No. 4,063,951 and JP-A-5-281640, and, regarding silver chloride, is described in EP No. 534,395A1 and U.S. Pat. No. 5,264,337. The tabular grains of the latter type are grains of variable configurations having one or more twin faces mentioned above. These tabular grains, regarding silver chloride, are described in U.S. Pat. Nos. 4,399,215, 4,983,508 and 5,183,732 and JP-A's 3-137632 and 3-116113.

In the formation of tabular grains, there can be employed various methods, for example, the grain forming method described in U.S. Pat. No. 5,494.789, the disclosure of which is incorporated herein by reference.

In the formation of tabular grains with a high aspect ratio, it is important to form twinned crystal nuclei of small size. Therefore, it is preferred to perform nucleation at low temperature, high pBr, low pH and low gelatin content within a short period of time. With respect to the type of gelatin, low-molecular-weight gelatins, gelatins of low methionine content and gelatin phthalate are preferred.

After nucleation, only tabular grain nuclei (parallel multiple twinned crystal nuclei) are grown by physical ripening, while other nuclei of regular crystal, single twinned crystal and nonparallel multiple twinned crystal are vanished. Thus, parallel multiple twinned crystal nuclei are selectively caused to remain. Thereafter, a soluble silver salt and a soluble halide are added to thereby effect grain growth. As a result, an emulsion of tabular grains is obtained.

It is also preferable to grow grains by adding silver halide fine grains separately prepared in advance or simultaneously prepared with the use of another reaction vessel to thereby effect a supply of silver and halide.

The tabular grains of the present invention preferably have dislocation lines. The dislocation lines are linear lattice defects which are present at boundaries between already slidden regions and unslidden regions on crystal slide faces.

When the tabular grains of the present invention have dislocation lines, the position thereof may be, for example, apex portions or fringe portions of grains. Also, dislocation lines may be formed on the principal planes of grains. The fringe portion mentioned herein refers to the periphery of tabular grains. Specifically, the fringe portion refers to an outer region from a point where, in a distribution of silver iodide from the sides to the center of tabular grains, the silver iodide content first exceeds or becomes less than the average silver iodide content over the entire grain, as viewed from the grain sides.

When the tabular grains of the present invention have dislocation lines, the density of dislocation lines is arbitrary. For example, 10 or more dislocation lines, or 30 or more dislocation lines, or 50 or more dislocation lines, per grain can be selected. The tabular grains of the present invention may have internal dislocation lines.

A technique of introducing, under control, dislocation into silver halide grains is described in JP-A-63-220238. It is mentioned that, as compared with the tabular grains having no dislocation lines, the tabular grains into which dislocation lines have been introduced exhibit such effects as enhancement of photographic characteristics such as sensitivity and reciprocity law, prolongation of storage life, improvement of latent image stability and reduction of pressure marks. In the invention described in the literature, the dislocation is mainly introduced in the edge portions of tabular grains. With respect to the tabular grains having the dislocation introduced in the central portion thereof, reference can be made to U.S. Pat. No. 5,238,796.

The dislocation lines within silver halide grains can be observed by a direct method using a transmission electron microscope at low temperatures as described in, for example, J. F. Hamilton, Photo. Sci. Eng., 11, 57 (1967) and T. Shiozawa, J. Soc. Photo. Sci. Japan, 35, 213 (1972). Illustratively, silver halide grains are harvested from the emulsion with due care that such a pressure causing dislocation is not applied, are put on a mesh for electron microscope observation and, while cooling the specimen so as to prevent damage (printout) by electron beams, are observed by the transmission method. The greater the thickness of the above grains, the more difficult the passing of the electron beams is. Therefore, the use of an electron microscope of high voltage type (at least 200 kV on the grains of 0.25 $\mu$m thickness) is preferred for ensuring clearer observation. The thus obtained photograph of grains enables determining the position and number of dislocation lines in each grain viewed from a face perpendicular to the principal planes.

The tabular grains of the present invention can be constituted of, for example, any of silver bromide, silver chlorobromide, silver iodobromide, silver iodochloride, silver chloride and silver chloroiodobromide. Among these, silver bromide, silver iodobromide and silver chloroiodobromide are preferred.

When there is a phase containing an iodide or a chloride, the phase may be uniformly distributed in each grain, or may be localized therein. Other silver salts, such as silver rhodanate, silver sulfide, silver selenide, silver carbonate, silver phosphate and an organic acid salt of silver, may be contained in the form of other separate grains or as parts of silver halide grains.

The silver iodide content of the tabular grains for use in the present invention is preferably in the range of 0.1 to 20 mol %, more preferably 0.1 to 15 mol %, and most preferably 0.2 to 10 mol %. Silver iodide contents of less than 1 mol % are not suitable because it becomes difficult to realize the effects of increased dye adsorption, enhancement of intrinsic photographic speed, etc. On the other hand, silver iodide contents of more than 20 mol % are not suitable because the development velocity is generally delayed.

The variation coefficient of intergranular silver iodide content distribution in the tabular grains for use in the present invention is preferably 30% or less, more preferably 25% or less, and most preferably 20% or less. That the variation coefficient exceeds 30% is not favorable from the viewpoint of intergranular homogeneity. The silver iodide contents of individual tabular grains can be measured by analyzing the composition of each individual grain by means of an X-ray microanalyzer. The terminology "variation coefficient of silver iodide content distribution" used herein means the quotient obtained by dividing the standard deviation of silver iodide contents of individual grains by the average silver iodide content.

The tabular grains of the present invention may be epitaxial silver halide grains comprising host tabular grains and, superimposed on surfaces thereof, at least one sort of silver salt epitaxy.

In the present invention, the silver salt epitaxy may be formed on selected sites of host tabular grain surfaces, or may be localized on corners or edges (when tabular grains are viewed from a direction perpendicular to the main plane, grain side faces and site on each side) of host tabular grains.

When it is intended to form the silver salt epitaxy, it is preferred that the formation be effected on selected sites of host tabular grain surfaces with intra-granular and intergranular homogeneity.

As the practical silver salt epitaxy site-directing method, there can be mentioned, for example, the method of loading host grains with silver iodide, and the method of causing host grains to adsorb a spectral sensitizing dye (for example, a cyanine dye) or an aminoazaindene (for example, an adenine) before the formation of silver salt epitaxy as described in U.S. Pat. No. 4,435,501. These methods may be employed.

Further, before the formation of silver salt epitaxy, iodide ions may be added and deposited on host grains.

Of these site-directing methods, an appropriate one may be selected according to given occasion, or a plurality thereof may be used in combination.

When the silver salt epitaxy is formed, the ratio of silver salt epitaxy occupancy to the surface area of host tabular grains is preferably in the range of 1 to 50%, more preferably 2 to 40%, and most preferably 3 to 30%.

When the silver salt epitaxy is formed, the ratio of the silver quantity of silver salt epitaxy to the total silver quantity of silver halide tabular grains is preferably in the range of 0.3 to 50 mol %, more preferably 0.3 to 25 mol %, and most preferably 0.5 to 15 mol %.

The composition of silver salt epitaxy can be selected so as to conform to given occasion. Although use can be made of a silver halide containing any of chloride ion, bromide ion and iodide ion, it is preferred that the silver salt epitaxy be constituted of a silver halide containing at least chloride ion.

An epitaxy formation from silver chloride is easy because silver chloride forms the same face-centered cubic lattice structure as constituted by silver bromide or silver iodobromide as a constituent of host tabular grains. However, there is a difference between lattice spacings formed by two types of silver halides, which difference leads to such an epitaxy joining as will contribute to an enhancement of photographic sensitivity.

The silver chloride content of silver halide epitaxy is preferably at least 10 mol %, more preferably at least 15 mol %, and most preferably at least 20 mol %, higher than that of host tabular grains.

When the difference between these silver chloride contents is less than 10 mol %, it is unfavorably difficult to attain the effect of the present invention.

In the introduction of halide ions in the silver halide epitaxy, it is preferred that, for increasing the introduction amount thereof, halide ions be introduced in sequence conforming to the composition of epitaxy.

For example, when it is intended to form an epitaxy wherein silver chloride is much contained in an inner part, silver bromide in an intermediate part and silver iodide in an outer part, chloride ions, bromide ions and iodide ions are sequentially added in the form of halides, so that the solubility of silver halide containing added halide ions is rendered lower than that of other silver halides to thereby deposit that silver halide with the result that a layer enriched in that silver halide is formed.

Silver salts other than silver halides, such as silver rhodanate, silver sulfide, silver selenide, silver carbonate, silver phosphate and organic acid silver salts, may be contained in the silver salt epitaxy.

The formation of silver salt epitaxy can be accomplished by various methods, for example, the method of adding halide ions, the method of adding an aqueous solution of silver nitrate and an aqueous solution of halide according to the double jet technique and the method of adding silver halide fine grains. Of these methods, an appropriate one may be selected according to given occasion, or a plurality thereof may be used in combination.

In the formation of silver salt epitaxy, the temperature, pH and pAg of system, the type and concentration of protective colloid agent such as gelatin, the presence or absence, type and concentration of silver halide solvent, etc. can widely be varied.

With respect to epitaxial silver halide grains, for the retention of the configuration of host tabular grains or for the site directing of silver salt epitaxy onto grain edge/corner portions, it is preferred that the silver iodide content of outer regions (portions where final deposition occurs, forming grain edge/corner portions) of host tabular grains be at least 1 mol % higher than that of central regions thereof.

In that instance, the silver iodide content of outer regions is preferably in the range of 1 to 20 mol %, more preferably 5 to 15 mol %. When the silver iodide content is less than 1 mol %, it is difficult to attain the above effect. On the other hand, when the silver iodide content exceeds 20 mol %, the development velocity is unfavorably retarded.

Further, in that instance, the ratio of the total silver quantity contained in outer regions containing silver iodide to the total silver quantity contained in host tabular grains is preferably in the range of 10 to 30%, more preferably 10 to 25%. When the ratio is less than 10% or exceeds 30%, it is unfavorably difficult to attain the above effect.

Still further, in that instance, the silver iodide content of central regions is preferably in the range of 0 to 10 mol %, more preferably 1 to 8 mol %, and most preferably 1 to 6 mol %. When the silver iodide content exceeds 10 mol %, the development velocity is unfavorably retarded.

Any common dopants known as being useful in silver halide face-centered cubic crystal lattice structures can be used in the tabular grains for use in the present invention. Examples of common dopants include Fe, Co, Ni, Ru, Rh, Pd, Re, Os, Ir, Pt, Au, Hg, Pb and Tl. These dopants can be present in host emulsion and/or silver salts epitaxially arranged on the grain surface.

The above emulsion of the present invention and other photographic emulsions for use in combination therewith will be described below.

Silver halide grains contained in other emulsions for use in the present invention may be those having regular crystal forms such as cubic, octahedral or tetradecahedral crystal forms, or having irregular crystal forms such as spherical or platelike crystal forms, or having crystal defects such as twin faces, or having composite forms thereof. The silver halides of the present invention, with respect to the grain diameter thereof, may consist of fine grains having an equivalent sphere diameter of about 0.2 $\mu$m or less or large grains having an equivalent sphere diameter reaching about 3 $\mu$m, and further may be either a polydisperse or a monodisperse emulsion.

These can be selected from among silver halide emulsions prepared by the methods described in, e.g., U.S. Pat. No. 4,500,626, column 50; U.S. Pat. No. 4,628,021; Research Disclosure (to be abbreviated as RD hereafter) No. 17,029 (1978); RD No, 17,643 (December, 1978), pp. 22 and 23; RD No. 18,716 (November, 1979), page 648; RD No. 307,105 (November, 1989), pp. 863 to 865; JP-A's 62-253159, 64-13546, 2-236546 and 3-110555; P. Glafkides, "Chemie et Phisque Photographique", Paul Montel, 1967; G. F. Duffin, "Photographic Emulsion Chemistry", Focal Press, 1966; and V. L. Zelikman et al., "Making and Coating Photographic Emulsion", Focal Press, 1964.

Two or more emulsions having at least one different characteristic, such as grain size, grain size distribution, halogen composition, the shape of a grain and sensitivity, can be mixed in the same layer of the light-sensitive material of the present invention. It is also possible to mix the emulsion consisting of the tabular grains of the present invention and other emulsions.

In the process of preparing the light-sensitive silver halide emulsion according to the present invention, it is preferred to effect removing of excess salts, known as desalting. As means therefor, use can be made of the noodle washing method to be performed after gelation of gelatin, or the precipitation method using an inorganic salt comprising a polyvalent anion (e.g., sodium sulfate), an anionic surfactant, an anionic polymer (e.g., sodium polystyrenesulfonate) or a gelatin derivative (e.g., aliphatic acylated gelatin, aromatic acylated gelatin or aromatic carbamoylated gelatin). The precipitation method is preferred.

The light-sensitive silver halide emulsion for use in the present invention may be loaded with any of heavy metals such as iridium, rhodium, platinum, cadmium, zinc, thallium, lead, iron and osmium for various purposes. These may be used individually or in combination. The loading amount, although depending on the intended use, is generally in the range of about 10-9 to 10-3 mol per mol of silver halide. In the loading, the grains may be uniformly loaded with such metals, or the metals may be localized at internal regions or surfaces of the grains. For example, the emulsions described in JP-A's 2-236542 and 1-116637 can preferably be employed.

In the stage of grain formation with respect to the light-sensitive silver halide emulsion of the present invention, for example, a rhodanate, ammonia, a tetra-substituted thiourea compound, an organic thioether derivative described in Jpn. Pat. Appln. KOKOKU Publication No. (hereinafter referred to as JP-B-) 47-11386 or a sulfur-containing compound described in JP-A-53-144319 can be used as a silver halide solvent.

With respect to other conditions, reference can be made to descriptions of, for example, the aforementioned P. Glafkides, "Chemie et Phisque Photographique", Paul Montel, 1967; G. F. Duffin, "Photographic Emulsion Chemistry", Focal Press, 1966; and V. L. Zelikman et al., "Making and Coating Photographic Emulsion", Focal Press, 1964. Specifically, use can be made of any of the acid method, the neutral method and the ammonia method. The reaction of a soluble silver salt with a soluble halide can be accomplished by any of the one-side mixing method, the simultaneous mixing method and a combination thereof. The simultaneous mixing method is preferably employed for obtaining a monodisperse emulsion.

The reverse mixing method wherein grains are formed in excess silver ions can also be employed. The method wherein the pAg of liquid phase in which a silver halide is formed is held constant, known as the controlled double jet method, can be employed as one mode of simultaneous mixing method.

In order to accelerate the grain growth, the addition concentration, addition amount and addition rate of a silver salt and a halide to be added may be increased (see, for example, JP-A's 55-142329 and 55-158124 and U.S. Pat. No. 3,650,757).

Any of known agitation methods can be employed in the agitation of the reaction mixture. Although the temperature and pH of reaction mixture during the formation of silver halide grains may be freely selected in conformity with the purpose, the pH is preferably in the range of 2.2 to 7.0, more preferably 2.5 to 6.0.

The light-sensitive silver halide emulsion generally consists of a chemically sensitized silver halide emulsion. In the chemical sensitization of light-sensitive silver halide emulsion according to the present invention, use can be made of the chalcogen sensitization methods such as sulfur sensitization, selenium sensitization and tellurium sensitization methods, which are common for conventional light-sensitive material emulsions, the noble metal sensitization method using gold, platinum, palladium or the like and the reduction sensitization method individually or in combination (see, for example, JP-A-3-110555). These chemical sensitizations can be performed in the presence of a nitrogen-containg heterocyclic compound (see JP-A-62-253159). Further, antifoggants listed later can be added after the completion of chemical sensitization. For example, use can be made of the methods of JP-A's 5-45833 and 62-40446.

During the chemical sensitization, the pH is preferably in the range of 5.3 to 10.5, more preferably 5.5 to 8.5. The pAg is preferably in the range of 6.0 to 10.5, more preferably 6.8 to 9.0.

The coating amount of light-sensitive silver halide for use in the present invention is preferably in the range of 0.01 $mg/m^2$ to 10 $g/m^2$, more preferably 6 $g/m^2$ or less, in terms of silver.

In order to provide the light-sensitive silver halide for use in the present invention with color sensitivity, such as green sensitivity or red sensitivity, spectral sensitization of the light-sensitive silver halide emulsion is effected by a methine dye or the like. According to necessity, spectral sensitization in the blue region may be effected for a blue-sensitive emulsion.

Useful dyes include a cyanine dye, a merocyanine dye, a complex cyanine dye, a complex merocyanine dye, a holopolar cyanine dye, a hemicyanine dye, a styryl dye and a hemioxonol dye.

For example, use can be made of sensitizing dyes described in U.S. Pat. No. 4,617,257 and JP-A's 59-180550, 64-13546, 5-45828 and 5-45834.

These sensitizing dyes may be used individually or in combination. The use of sensitizing dyes in combination is often employed for the purpose of attaining supersensitization or wavelength regulation of spectral sensitization.

The emulsion of the present invention may be loaded with a dye which itself exerts no spectral sensitizing effect or a compound which absorbs substantially none of visible radiation and exhibits supersensitization, together with the above sensitizing dye (for example, those described in U.S. Pat. No. 3,615,641 and JP-A-63-23145).

With respect to the timing of loading the emulsion with the above sensitizing dye, the loading may be effected during chemical ripening, or before or after the same. Also, the loading may be performed before or after nucleation of silver halide grains as described in U.S. Pat. Nos. 4,183,756 and 4,225,666. The sensitizing dye and supersensitizing agent can be added in the form of a solution in an organic solvent such as methanol, a dispersion in gelatin or the like, or a solution containing a surfactant. The loading amount thereof is generally in the range of about $10^{-8}$ to $10^{-2}$ mol per mol of silver halide.

The additives useful for use in the present invention are described in the aforementioned RD Nos. 17643, 18716 and 307105. The locations where they are described will be listed below.

| Types of Additives | | RD17643 Dec. 1978 | RD18716 Nov. 1978 | RD307105 Nov. 1989 |
|---|---|---|---|---|
| 1. | Chemical sensitizers | page 23 | page 648 right column | page 866 |
| 2. | Sensitivity increasing agents | page 648 right column | | |
| 3. | Spectral sensitizers, super-sensitizers | pages 23–24 | page 647, right column to page 649, right column | pages 866–868 |
| 4. | Brighteners | page 24 | page 648, right column | page 868 |
| 5. | Light absorbents, filter dyes, ultraviolet absorbents | pages 25–26 | page 649, right column to page 650, left column | page 873 |
| 6. | Binders | page 26 | page 651, left column | pages 873–874 |
| 7. | Plasticizers, lubricants | page 27 | page 650, right column | page 876 |
| 8. | Coating aids, surfactants | pages 26–27 | page 650, right column | pages 875–876 |
| 9. | Antistatic agents | page 27 | page 650, right column | pages 876–877 |
| 10. | Matting agents | | | pages 878–879. |

The tabular grains of the present invention which have a sensitizing dye adsorbed thereon so that the spectral absorption maximum wavelength is less than 500 nm while the light absorption intensity is 60 or more or so that the spectral absorption maximum wavelength is 500 nm or more while the light absorption intensity is 100 or more, preferably employed in the present invention, will now be described.

In the present invention, the light absorption intensity refers to a light absorption area intensity per grain surface area realized by a sensitizing dye. It is defined as an integral value, over wave number ($cm^{-1}$), of optical density Log (Io/(Io-I)), wherein Io represents the quantity of light incident on each unit surface area of grains and I represents the quantity of light absorbed by the sensitizing dye on the surface. The range of integration is from 5000 $cm^{-1}$ to 35,000 $cm^{-1}$.

It is preferred that the tabular grains of the present invention contained in at least one light-sensitive silver halide emulsion layer at a ratio of 60% or more of the total projected area of all the silver halide grains, at least some thereof, have a sensitizing dye adsorbed thereon so as to realize a light absorption intensity of 60 or more in the use of grains of less than 500 nm spectral absorption maximum wavelength, or a light absorption intensity of 100 or more in the use of grains of 500 nm or more spectral absorption maximum wavelength. The ratio of the tabular grains of the present invention having undergone the above sensitizing dye adsorption is preferably 50% or more of the total projected area of all the silver halide grains contained in the layer.

With respect to the grains of 500 nm or more spectral absorption maximum wavelength, the light absorption intensity is more preferably 150 or more, still more preferably 170 or more, and most preferably 200 or more. With respect to the grains of less than 500 nm spectral absorption maximum wavelength, the light absorption intensity is more preferably 90 or more, still more preferably 100 or more, and most preferably 120 or more. In both instances, although there is no particular upper limit, the light absorption intensity is preferably up to 2000, more preferably up to 1000, and most preferably up to 500. With respect to the grains of less than 500 nm spectral absorption maximum wavelength, the spectral absorption maximum wavelength is preferably 350 nm or more.

As one method of measuring the light absorption intensity, there can be mentioned the method of using a microscopic spectrophotometer. The microscopic spectrophotometer is a device capable of measuring an absorption spectrum of minute area, whereby a transmission spectrum of each grain can be measured. With respect to the measurement of an absorption spectrum of each grain by the microscopic spectrophotometry, reference can be made to the report of Yamashita et al. (page 15 of Abstracts of Papers presented before the 1996 Annual Meeting of the Society of Photographic Science and Technology of Japan). The absorption intensity per grain can be determined from the absorption spectrum. Because the light transmitted through grains is absorbed by two surfaces, i.e., upper surface and lower surface, however, the absorption intensity per grain surface area can be determined as ½ of the absorption intensity per grain obtained in the above manner. At that time, although the interval for absorption spectrum integration is from 5000 $cm^{-1}$ to 35,000 $cm^{-1}$ in view of the definition of light absorption intensity, experimentally, it is satisfactory to integrate over an interval including about 500 $cm^{-1}$ after and before the interval of absorption by sensitizing dye.

Apart from the microscopic spectrophotometry, the method of arranging grains in such a manner that the grains are not piled one upon another and measuring a transmission spectrum is also practical.

The light absorption intensity is a value unequivocally determined from the oscillator strength and number of adsorbed molecules per area with respect to the sensitizing dye. If, with respect to the sensitizing dye, the oscillator strength, dye adsorption amount and grain surface area are measured, these can be converted into the light absorption intensity.

The oscillator strength of sensitizing dye can be experimentally determined as a value proportional to the absorption area intensity (optical density×$cm^{-1}$) of sensitizing dye solution, so that the light absorption intensity can be calculated within an error of about 10% by the formula:

$$[\text{light absorption intensity}]=0.156\times A\times B/C$$

wherein A represents the absorption area intensity per M of dye (optical density×$cm^{-1}$), B represents the adsorption amount of sensitizing dye (mol/molAg) and C represents the grain surface area C ($m^2$/molAg).

Calculation of the light absorption intensity through this formula gives substantially the same value as the integral value, over wave number ($cm^{-1}$), of light absorption intensity (Log (Io/(Io-I))) measured in accordance with the aforementioned definition.

For increasing the light absorption intensity, there can be employed any of the method of adsorbing more than one layer of dye chromophore on grain surfaces, the method of increasing the molecular absorption coefficient of dye and the method of decreasing a dye-occupied area. Of these, the method of adsorbing more than one layer of dye chromophore on grain surfaces (multi-layer adsorption of sensitizing dye) is preferred.

The expression "adsorption of more than one layer of dye chromophore on grain surfaces" used herein means the presence of more than one layer of dye bound in the vicinity of silver halide grains. Thus, it is meant that dye present in a dispersion medium is not contained. Even if a dye chromophore is connected with a substance adsorbed on grain surfaces through a covalent bond, when the connecting group is so long that the dye chromophore is present in the dispersion medium, the effect of increasing the light absorption intensity is slight and hence it is not regarded as the more than one layer adsorption. Further, in the so-called multi-layer adsorption wherein more than one layer of dye chromophore is adsorbed on grain surfaces, it is required that a spectral sensitization be brought about by a dye not directly adsorbed on grain surfaces. For meeting this requirement, the transfer of excitation energy from the dye not directly adsorbed on silver halide to the dye directly adsorbed on grains is inevitable. Therefore, when the transfer of excitation energy must occur in more than 10 stages, the final transfer efficiency of excitation energy will unfavorably be low. As an example thereof, there can be mentioned such a case that, as experienced in the use of polymer dyes of, for example, JP-A-2-113239, most of dye chromophore is present in a dispersion medium, so that more than 10 stages are needed for the transfer of excitation energy. In the present invention, it is preferred that the number of excitation energy transfer stages per molecule range from 1 to 3.

The terminology "chromophore" used herein means an atomic group which is the main cause of molecular absorption bands as described on pages 985 and 986 of Physicochemical Dictionary (4th edition, published by Iwanami Shoten, Publishers in 1987), for example, any atomic group selected from among C═C, N═N and other atomic groups having unsaturated bonds.

Examples thereof include a cyanine dye, a styryl dye, a hemicyanine dye, a merocyanine dye, a trinuclear merocyanine dye, a tetranuclear merocyanine dye, a rhodacyanine dye, a complex cyanine dye, a complex merocyanine dye, an allopolar dye, an oxonol dye, a hemioxonol dye, a squarium dye, a croconium dye, an azamethine dye, a coumarin dye, an allylidene dye, an anthraquinone dye, a triphenylmethane dye, an azo dye, an azomethine dye, a spiro compound, a metallocene dye, a fluorenone dye, a fulgide dye, a perillene dye, a phenazine dye, a phenothiazine dye, a quinone dye, an indigo dye, a diphenylmethane dye, a polyene dye, an acridine dye, an acridinone dye, a diphenylamine dye, a quinacridone dye, a quinophthalone dye, a phenoxazine dye, a phthaloperillene dye, a porphyrin dye, a chlorophyll dye, a phthalocyanine dye and a metal complex dye. Of these, there can preferably be employed polymethine chromophores such as a cyanine dye, a styryl dye, a hemicyanine dye, a merocyanine dye, a trinuclear merocyanine dye, a tetranuclear merocyanine dye, a rhodacyanine dye, a complex cyanine dye, a complex merocyanine dye, an allopolar dye, an oxonol dye, a hemioxonol dye, a squarium dye, a croconium dye and an azamethine dye. More preferred are a cyanine dye, a merocyanine dye, a trinuclear merocyanine dye, a tetranuclear merocyanine dye and a rhodacyanine dye. Most preferred are a cyanine dye, a merocyanine dye and a rhodacyanine dye. A cyanine dye is optimally employed.

Details of these dyes are described in, for example, F. M. Harmer, "Heterocyclic Compounds-Cyanine Dyes and Related Compounds", John Wiley & Sons, New York, London, 1964 and D. M. Sturmer, "Heterocyclic Compounds-Special topics in heterocyclic chemistry", chapter 18, section 14, pages 482 to 515, John Wiley & Sons, New York, London, 1977. With respect to the general formulae for the cyanine dye, merocyanine dye and rhodacyanine dye, those shown in U.S. Pat. No. 5,340,694, columns 21 to 22, (XI), (XII) and (XIII), are preferred. In the formulae, the numbers n12, n15, n17 and n18 are not limited as long as each of these is an integer of 0 or greater (preferably, 4 or less).

The adsorption of a dye chromophore on silver halide grains is preferably carried out in at least 1.5 layers, more preferably at least 1.7 layers, and most preferably at least 2 layers. Although there is no particular upper limit, the number of layers is preferably 10 or less, more preferably 5 or less.

The expression "adsorption of more than one layer of chromophore on silver halide grain surfaces" used herein means that the adsorption amount of dye chromophore per area is greater than a one-layer saturated coating amount, this one-layer saturated coating amount defined as the saturated adsorption amount per area attained by a dye which exhibits the smallest dye-occupied area on silver halide grain surfaces among the sensitizing dyes added to the emulsion. The number of adsorption layers means the adsorption amount evaluated on the basis of one-layer saturated coating amount. With respect to dyes having dye chromophores connected to each other by covalent bonds, the dye-occupied area of unconnected individual dyes can be employed as the basis.

The dye-occupied area can be determined from an adsorption isothermal line showing the relationship between free dye concentration and adsorbed dye amount, and a grain surface area. The adsorption isothermal line can be determined with reference to, for example, A. Herz et al. "Adsorption from Aqueous Solution", Advances in Chemistry Series, No. 17, page 173 (1968).

The adsorption amount of a sensitizing dye onto emulsion grains can be determined by two methods. The one method comprises centrifuging an emulsion having undergone a dye adsorption to thereby separate the emulsion into emulsion grains and a supernatant aqueous solution of gelatin, determining an unadsorbed dye concentration from the measurement of spectral absorption of the supernatant, and subtracting the same from the added dye amount to thereby determine the adsorbed dye amount. The other method comprises depositing emulsion grains, drying the same, dissolving a given weight of the deposit in a 1:1 mixture of an aqueous solution of sodium thiosulfate and methanol, and effecting a spectral absorption measurement thereof to thereby determine the adsorbed dye amount. When a plurality of sensitizing dyes are employed, the absorption amount of each dye can be determined by high-performance liquid chromatography or other techniques. With respect to the method of determining the dye absorption amount by measuring the dye amount in a supernatant, reference can be made to, for example, W. West et al., Journal of Physical Chemistry, vol. 56, page 1054 (1952). However, even unadsorbed dye may be deposited when the addition amount of dye is large, so that an accurate absorption amount may not always be obtained by the method of measuring the dye concentration of the supernatant. On the other hand, in the method in which the absorption amount of dye is determined by dissolving deposited silver halide grains, the deposition velocity of emulsion grains is overwhelmingly faster, so that grains and deposited dye can easily be separated from each other. Thus, only the amount of dye adsorbed on grains can accurately be determined. Therefore, this method is most reliable as a means for determining the dye absorption amount.

As one method of measuring the surface area of silver halide grains, there can be employed the method wherein a transmission electron micrograph is taken according to the replica method and wherein the configuration and size of each individual grain are measured and calculated. In this method, the thickness of tabular grains is calculated from the length of shadow of the replica. With respect to the method of taking a transmission electron micrograph, reference can be made to, for example, Denshi Kenbikyo Shiryo Gijutsu Shu (Electron Microscope Specimen Technique Collection) edited by the Kanto Branch of the Society of Electron Microscope of Japan and published by Seibundo Shinkosha in 1970 and P. B. Hirsch, "Electron Microscopy of Thin Crystals", Buttwrworths, London (1965).

When a multi-layer of dye chromophore is adsorbed on silver halide grains in the present invention, although the reduction potentials and oxidation potentials of the dye chromophore of the first layer, namely the layer directly adsorbed on silver halide grains, vs. the dye chromophore of the second et seq. layers are not particularly limited, it is preferred that the reduction potential of the dye chromophore of the first layer be noble to the remainder of the reduction potential of the dye chromophore of the second et seq. layers minus 0.2 V.

Although the reduction potential and oxidation potential can be measured by various methods, the measurement is preferably carried out by the use of phase discrimination second harmonic a.c. polarography, whereby accurate values can be obtained. The method of measuring potentials by the use of phase discrimination second harmonic a.c. polarography is described in Journal of Imaging Science, vol. 30, page 27 (1986).

The dye chromophore of the second et seq. layers preferably consists of a luminescent dye. With respect to the type of luminescent dye, those having the skeletal structure of dye for use in dye laser are preferred. These are edited in, for example, Mitsuo Maeda, Laser Kenkyu (Laser Research), vol. 8, pp. 694, 803 and 958 (1980) and ditto, vol. 9, page 85 (1981), and F. Sehaefer, "Dye Lasers", Springer (1973).

Moreover, the absorption maximum wavelength of dye chromophore of the first layer in the silver halide photographic light-sensitive material is preferably greater than that of dye chromophore of the second et seq. layers. Further, preferably, the light emission of dye chromophore of the second et seq. layers and the absorption of dye chromophore of the first layer overlap each other. Also, it is preferred that the dye chromophore of the first layer form a J-association product. Still further, for exhibiting absorption and spectral sensitivity within a desired wavelength range, it is preferred that the dye chromophore of the second et seq. layers also form a J-association product.

The meanings of terminologies employed in the present invention are set forth below.

Dye-occupied area: Area occupied by each molecule of dye, which can experimentally be determined from adsorption isothermal lines. With respect to dyes having dye chromophores connected to each other by covalent bonds, the dye-occupied area of unconnected individual dyes can be employed as the basis.

One-layer saturated coating amount: Dye adsorption amount per grain surface area at one-layer saturated coating, which is the inverse number of the smallest dye-occupied area exhibited by added dyes.

Multi-layer adsorption: In such a state that the adsorption amount of dye chromophore per grain surface area is greater than the one-layer saturated coating amount.

Number of adsorption layers: Adsorption amount of dye chromophore per grain surface area on the basis of one-layer saturated coating amount.

The first preferable method for realizing silver halide grains of less than 500 nm spectral absorption maximum wavelength and 60 or more light absorption intensity, or 500 nm or more spectral absorption maximum wavelength and 100 or more light absorption intensity, is any of those using the following specified dyes.

For example, there can preferably be employed the method of using a dye having an aromatic group, or using a cationic dye having an aromatic group and an anionic dye having an aromatic group in combination as described in JP-A's 10-239789, 8-269009, 10-123650 and 8-328189, the method of using a dye of polyvalent charge as described in JP-A-10-171058, the method of using a dye having a pyridinium group as described in JP-A-10-104774, the method of using a dye having a hydrophobic group as described in JP-A-10-186559, and the method of using a dye having a coordination bond group as described in JP-A-10-197980.

The method of using a dye having at least one aromatic group is most preferred. In particular, the method wherein a positively charged dye, or a dye having intra-molecularly offset charges, or a dye having no charges is used alone, and the method wherein positively and negatively charged dyes are used in combination, at least one thereof having at least one aromatic group as a substituent, are preferred.

The aromatic group will now be described in detail. The aromatic group may be a hydrocarbon aromatic group or a heteroaromatic group. Further, the aromatic group may be a group having the structure of a polycyclic condensed ring resulting from mutual condensation of hydrocarbon aromatic rings or mutual condensation of heteroaromatic rings, or a polycyclic condensed ring consisting of a combination of an aromatic hydrocarbon ring and an aromatic heterocycle. The aromatic group may have a substituent. Examples of preferred aromatic rings contained in the aromatic group include benzene, naphthalene, anthracene, phenanthrene, fluorene, triphenylene, naphthacene, biphenyl, pyrrole, furan, thiophene, imidazole, oxazole, thiazole, pyridine, pyrazine, pyrimidine, pyridazine, indolizine, indole, benzofuran, benzothiophene, isobenzofuran, quinolizine, quinoline, phthalazine, naphthyridine, quinoxaline, quinoxazoline, quinoline, carbazole, phenanthridine, acridine, phenanthroline, thianthrene, chromene, xanthene, phenoxathiin, phenothiazine and phenazine. The above hydrocarbon aromatic rings are more preferred. Benzene and naphthalene are most preferred. Benzene is optimal.

For example, any of those aforementioned as examples of dye chromophores can be used as the dye. The dyes aforementioned as examples of polymethine dye chromophores can preferably be employed.

More preferred are a cyanine dye, a styryl dye, a hemicyanine dye, a merocyanine dye, a trinuclear merocyanine dye, a tetranuclear merocyanine dye, a rhodacyanine dye, a complex cyanine dye, a complex merocyanine dye, an allopolar dye, an oxonol dye, a hemioxonol dye, a squarium dye, a croconium dye and an azamethine dye. Still more preferred are a cyanine dye, a merocyanine dye, a trinuclear merocyanine dye, a tetranuclear merocyanine dye and a rhodacyanine dye. Most preferred are a cyanine dye, a merocyanine dye and a rhodacyanine dye. A cyanine dye is optimal.

The following methods of using a dye (a) and (b) are preferred. Of them, the method (b) is more preferred.

(a) The method comprises using at least one of cationic, betaine and nonionic methine dyes.

(b) The method comprises using at least one cationic methine dye and at least one anionic methine dye in combination.

Although the cationic dye for use in the present invention is not particularly limited as long as the charges of dye exclusive of counter ions are cationic, it is preferred that the cationic dye be a dye having no anionic substituents. Further, although the anionic dye for use in the present invention is not particularly limited as long as the charges of dye exclusive of counter ions are anionic, it is preferred that the anionic dye be a dye having at least one anionic substituent. The betaine dye for use in the present invention is a dye which, although having charges in its molecule, forms such an intra-molecular salt that the molecule as a whole has no charges. The nonionic dye for use in the present invention is a dye having no charges at all in its molecule.

The anionic substituent refers to a substituent having a negative charge, and can be, for example, a proton-dissociable acid group, at least 90% of which is dissociated at a pH of 5 to 8. Examples of suitable anionic substituents include a sulfo group, a carboxyl group, a sulfato group, a phosphoric acid group, a boric acid group, an alkylsulfonylcarbamoylalkyl group (e.g., methanesulfonylcarbamoylmethyl), an acylcarbamoylalkyl group (e.g., acetylcarbamoylmethyl), an acylsulfamoylalkyl group (e.g., acetylsulfamoylmethyl) and an alkylsulfonylsulfamoylalkyl group (e.g., methanesulfonylsulfamoylmethyl). A sulfo group and a carboxyl group are preferably employed, and a sulfo group is more preferably employed. As the cationic substituent, there can be mentioned, for example, a substituted or unsubstituted ammonium group and pyridinium group.

Although silver halide grains of less than 500 nm spectral absorption maximum wavelength and 60 or more light absorption intensity, or 500 nm or more spectral absorption maximum wavelength and 100 or more light absorption intensity, can be realized by the above preferred method, the dye of the second layer is generally adsorbed in the form of a monomer, so that most often the absorption width and spectral sensitivity width are larger than those desired. Therefore, for realizing a high sensitivity within a desired wavelength region, it is requisite that the dye adsorbed into the second layer form a J-association product. Further, the J-association product is preferred from the viewpoint of transmitting light energy absorbed by the dye of the second layer to the dye of the first layer with a proximate light absorption wavelength by the energy transfer of the Foster type, because of the high fluorescent yield and slight Stokes shift exhibited thereby.

For forming the J-association product of the dye of the second layer from a cationic dye, a betaine dye, a nonionic dye or an anionic dye, it is preferred that the addition of dye adsorbed as the first layer be separated from the addition of dye adsorbed in the formation of the second et seq. layers, and it is more preferred that the structure of the dye of the first layer be different from that of the dye of the second et seq. layers. With respect to the dye of the second et seq. layers, it is preferred that a cationic dye, a betaine dye and a nonionic dye be added individually, or a cationic dye and an anionic dye be added in combination.

The dye of the first layer, although not particularly limited, preferably consists of a cationic dye, a betaine dye, a nonionic dye or an anionic dye, more preferably a cationic dye, a betaine dye or a nonionic dye. In the second layer, it is preferred that a cationic dye, a betaine dye or a nonionic dye be used alone. When a cationic dye and an anionic dye are used in combination, which is also a preferred use in the second layer, the ratio of cationic dye to anionic dye in the dye of the second layer is preferably in the range of 0.5 to 2, more preferably 0.75 to 1.33, and most preferably 0.9 to 1.11.

The second preferable method for realizing silver halide grains of less than 500 nm spectral absorption maximum wavelength and 60 or more light absorption intensity, or 500 nm or more spectral absorption maximum wavelength and 100 or more light absorption intensity, comprises utilizing a dye compound (linked dye) having two or more dye chromophore portions linked to each other by a covalent bond through a linking group.

The usable dye chromophore is not particularly limited, and, for example, the aforementioned dye chromophores can be employed. The aforementioned polymethine dye chromophores are preferred. More preferred are a cyanine dye, a merocyanine dye, a rhodacyanine dye and an oxonol dye. Most preferred are a cyanine dye, a rhodacyanine dye and a merocyanine dye. A cyanine dye is optimal.

The linking group refers to a single bond or, preferably, a divalent substituent. This linking group preferably consists of an atom or atomic group including at least one member selected from among a carbon atom, a nitrogen atom, a sulfur atom and an oxygen atom. Also, the linking group preferably includes a divalent substituent having 0 to 100 carbon atoms, more preferably 1 to 20 carbon atoms, constituted of one member or a combination of at least two members selected from among an alkylene group (e.g., methylene, ethylene, propylene, butylene or pentylene), an arylene group (e.g., phenylene or naphthylene), an alkenylene group (e.g., ethenylene or propenylene), an alkynylene group (e.g., ethynylene or propynylene), an amido group, an ester group, a sulfoamido group, a sulfonic ester group, a ureido group, a sulfonyl group, a sulfinyl group, a thioether group, an ether group, a carbonyl group, —N(Va)- (Va represents a hydrogen atom or a monovalent substituent) and a heterocyclic divalent group (e.g., 6-chloro-1,3,5-triazine-2,4-diyl group, pyrimidine-2,4-diyl group or quinoxarine-2,3-diyl group). The linking group may further have a substituent, and may contain an aromatic ring or a nonaromatic hydrocarbon ring or heterocycle. As especially preferred linking groups, there can be mentioned divalent substituents having 1 to 10 carbon atoms, constituted of one member of a combination of at least two members selected from among alkylene groups each having 1 to 10 carbon atoms (e.g., methylene, ethylene, propylene and butylene), arylene groups each having 6 to 10 carbon atoms (e.g., phenylene and naphthylene), alkenylene groups each having 2 to 10 carbon atoms (e.g., ethenylene and propenylene), alkynylene groups each having 2 to 10 carbon atoms (e.g., ethynylene and propynylene), ether group, an amido group, an ester group, a sulfoamido group and a sulfonic ester group and having 1 to 10 carbon atoms.

The linking group is preferably one capable of energy transfering or electron moving by through-bond interaction. The through-bond interaction includes, for example, tunnel interaction and super-exchange interaction. Especially, the through-bond interaction based on super-exchange interaction is preferred. The through-bond interaction and super-exchange interaction are as defined in Shammai Speiser, Chem. Rev., vol. 96, pp. 1960–1963, 1996. As the linking group capable of inducing an energy transfer or electron moving by such an interaction, there can preferably be employed those described in Shammai Speiser, Chem. Rev., vol. 96, pp. 1967–1969, 1996.

Preferred examples thereof include the method of using dyes linked to each other by methine chains as described in JP-A-9-265144, the method of using a dye comprising oxonol dyes linked to each other as described in JP-A-10-226758, the method of using linked dyes of specified structure as described in JP-A's 10-110107, 10-307358, 10-307359, 10-310715 and 10-204306, the method of using linked dyes of specified structure as described in JP-A's 2000-231174, 2000-231172 and 2000-231173, and the method of using a dye having a reactive group to thereby form a linked dye in the emulsion as described in JP-A-2000-81678.

Examples of especially preferably employed dyes will be listed below, to which, however, the present invention is in no way limited.

(I) Examples of cationic dyes, betaine dyes and nonion dyes:

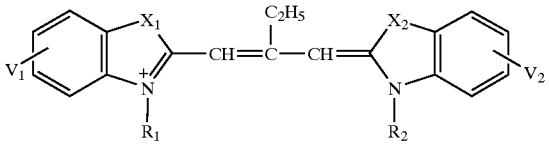

Y

| | $X_1$ | $X_2$ | $V_1$ | $V_2$ | $R_1$ |
|---|---|---|---|---|---|
| D-1 | O | O | 5-Ph | 5'-Ph | 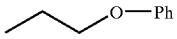 |
| D-2 | O | O | 5-Ph | 5'-Ph | 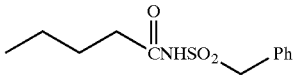 |
| D-3 | O | S | 5-Ph | 5'-Ph | 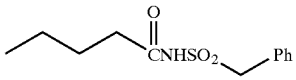 |

-continued
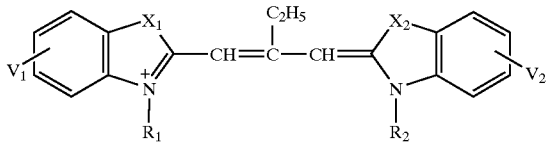
Y
| | | | | | |
|---|---|---|---|---|---|
| D-4 | O | S | 5-Ph | 5'-Ph | 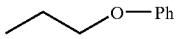 |
| D-5 | O | O | 4,5-Benzo | 4',5'-Benzo | 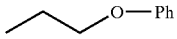 |
| D-6 | O | O | 5,6-Benzo | 5',6'-Benzo | 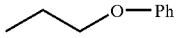 |
| D-7 | O | O | 5,6-Benzo | 5',6'-Benzo | 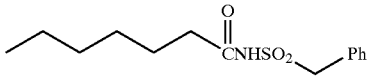 |
| D-8 | O | O | 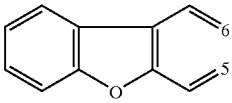 | 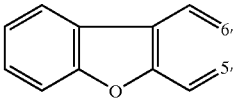 | 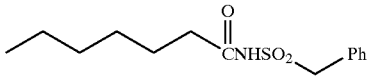 |
| D-9 | O | O | 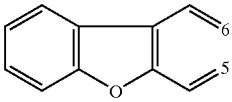 | 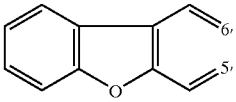 | 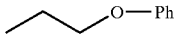 |
| D-10 | O | O | 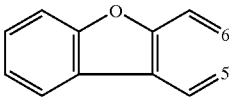 | 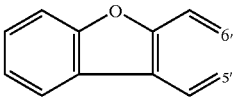 | 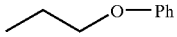 |
| D-11 | S | S | 5-Ph | 5'-Ph | 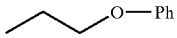 |
| D-12 | S | S | 5-Cl | 5'-Cl | 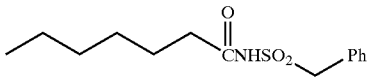 |
| D-13 | S | S | 5,6-Benzo | 5',6'-Benzo | 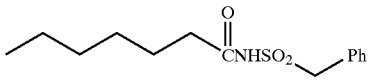 |
| D-14 | S | S | 5-Ph | 5'-Ph | 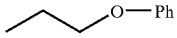 |
| D-15 | S | S | 5-Ph | 5'-Ph | 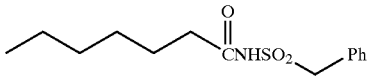 |
| D-16 | S | S | 5,6-Benzo | 5',6'-Benzo | 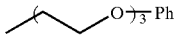 |
| D-17 | S | O | 5,6-Benzo | 5',6'-Benzo | 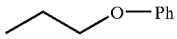 |
| D-18 | O | O | 5,6-Benzo | 5',6'-Benzo | 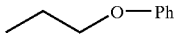 |
| D-19 | S | S | 5,6-Benzo | 5',6'-Benzo | 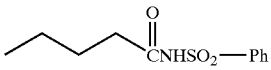 |
| D-20 | S | S | 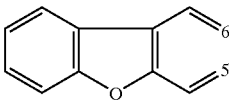 | 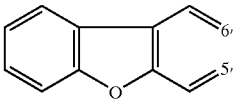 | 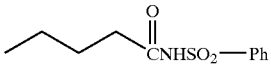 |

-continued
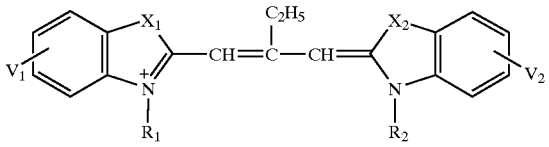
Y
| | $R_2$ | Y |
|---|---|---|
| D-1 | 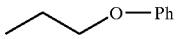 | 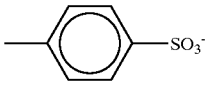 |
| D-2 | 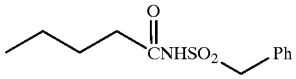 | $Br^-$ |
| D-3 | 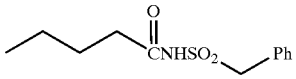 | 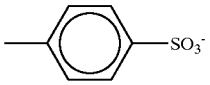 |
| D-4 | 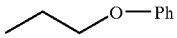 | $Br^-$ |
| D-5 | 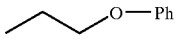 | 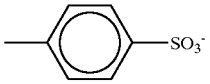 |
| D-6 | 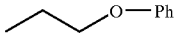 | 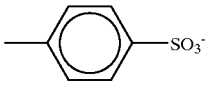 |
| D-7 | 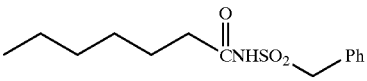 | 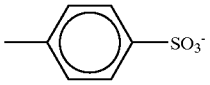 |
| D-8 | 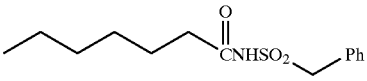 | 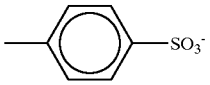 |
| D-9 | 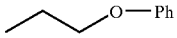 | 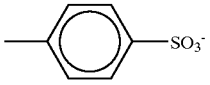 |
| D-10 | 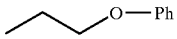 | 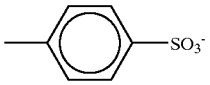 |
| D-11 | 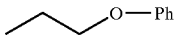 | 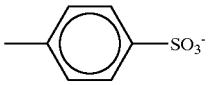 |
| D-12 | 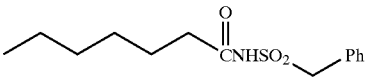 | 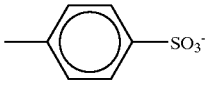 |
| D-13 | 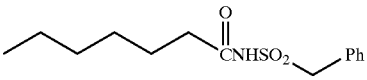 | 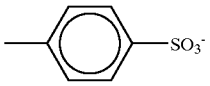 |
| D-14 | 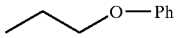 | 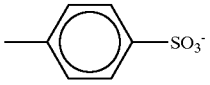 |

-continued
| | | |
|---|---|---|
| | 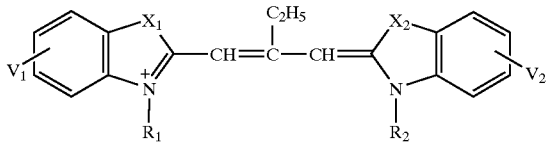 | |
| | Y | |
| D-15 | 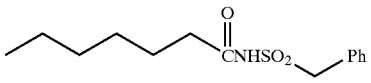 | 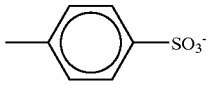 |
| D-16 | 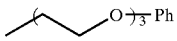 | 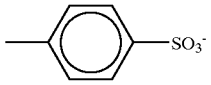 |
| D-17 | 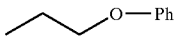 | 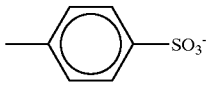 |
| D-18 | 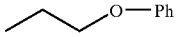 | 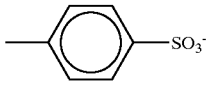 |
| D-19 | 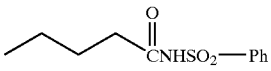 | 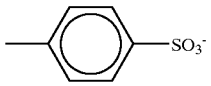 |
| D-20 | 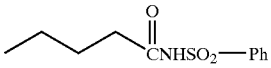 | 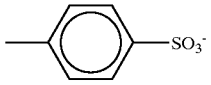 |
(II) Esamples of anionic dyes:
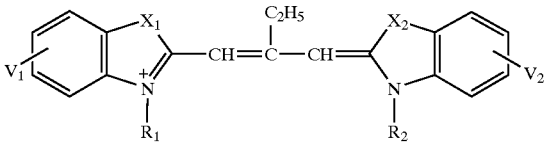
Y
| | $X_1$ | $X_2$ | $V_1$ | $V_2$ | $R_1$ | $R_2$ | Y |
|---|---|---|---|---|---|---|---|
| D-21 | O | O | 5-Ph | 5'-Ph | 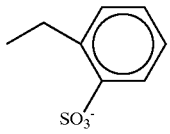 | 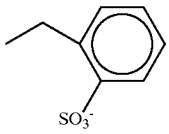 | $Na^+$ |
| D-22 | O | O | 5-Ph | 5'-Ph | 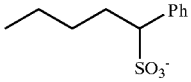 | 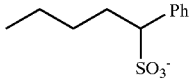 | $Na^+$ |
| D-23 | O | S | 5-Ph | 5'-Ph | 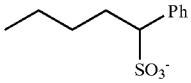 | 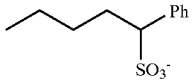 | + $HN(C_2H_5)_3$ |
| D-24 | S | S | 5-Ph | 5'-Ph | 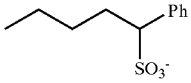 | 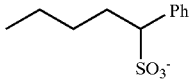 | + $HN(C_2H_5)_3$ |

-continued
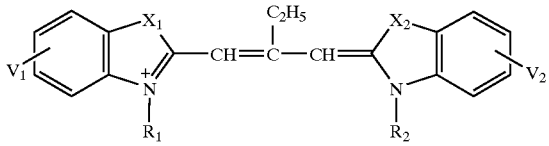
Y
| | $X_1$ | $X_2$ | $V_1$ | $V_2$ | $R_1$ | $R_2$ | Y |
|---|---|---|---|---|---|---|---|
| D-25 | S | S | 5-Ph | 5'-Ph | 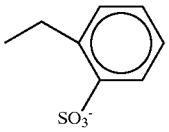 | 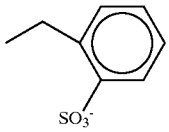 | $+HN(C_2H_5)_3$ |
| D-26 | O | O | 5,6-Benzo | 5',6'-Benzo | 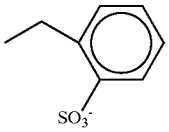 | 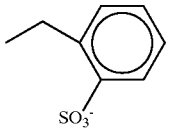 | $+HN(C_2H_5)_3$ |
| D-27 | O | O | 4,5-Benzo | 5',6'-Benzo | 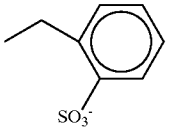 | 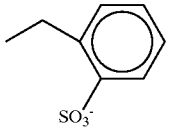 | $+HN(C_2H_5)_3$ |
| D-28 | O | O | 5,6-Benzo | 5',6'-Benzo | 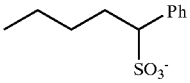 | 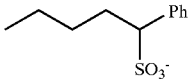 | $+HN(C_2H_5)_3$ |
| D-29 | O | O | 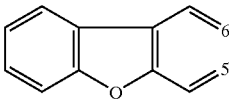 | 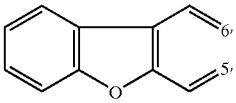 | 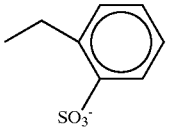 | 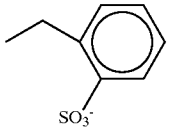 | $+HN(C_2H_5)_3$ |
| D-30 | S | S | 5-Cl | 5'-Cl | 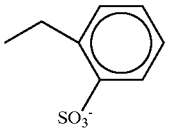 | 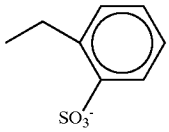 | $+HN(C_2H_5)_3$ |
| D-31 | S | S | 5-Ph | 5'-Ph | 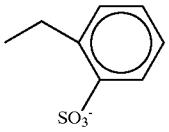 | 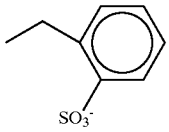 | $Na^+$ |
| D-32 | S | S | 5,6-Benzo | 5',6'-Benzo | 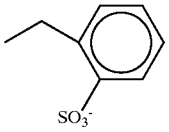 | 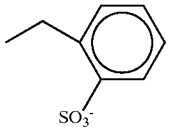 | $Na^+$ |
| D-33 | S | O | 5,6-Benzo | 5',6'-Benzo | 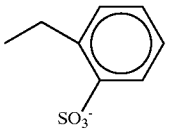 | 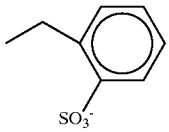 | $Na^+$ |

-continued

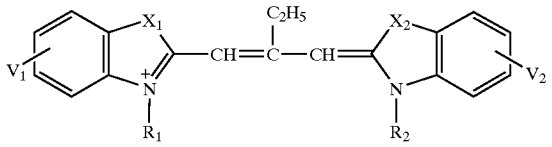

Y

| | $X_1$ | $X_2$ | $V_1$ | $V_2$ | $R_1$ | $R_2$ | Y |
|---|---|---|---|---|---|---|---|
| D-34 | O | O | 5,6-Benzo | 5',6'-Benzo | 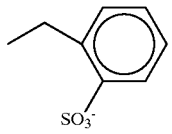 | 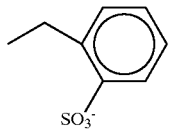 | $Na^+$ |
| D-35 | S | O | 5,6-Benzo | 5'-Ph | 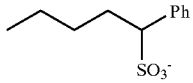 | 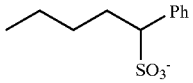 | $Na^+$ |

(III) Examples of linked dyes:

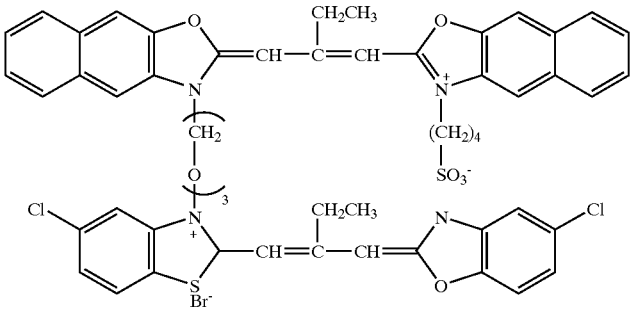

The dyes for use in the present invention can be synthesized by the methods described in, for example, F. M. Harmer, "Heterocyclic Compounds-Cyanine Dyes and Related Compounds", John Wiley & Sons, New York, London, 1964, D. M. Sturmer, "Heterocyclic Compounds—Special topics in heterocyclic chemistry", chapter 18, section 14, pages 482 to 515, John Wiley & Sons, New York, London, 1977, and Rodd's Chemistry of Carbon Compounds, 2nd. Ed. vol. IV, part B, 1977, chapter 15, pages 369 to 422, Elsevier Science Publishing Company Inc., New York.

In the present invention, it is preferred that, in combination with the light-sensitive silver halide emulsion, an organometallic salt be used as an oxidizer. Among suitable organometallic salts, organosilver salts are especially preferably employed.

An organosilver salt which can be employed in the present invention is one that is relatively stable when exposed to light but forms a silver image when heated at 80° C. or higher in the presence of an exposed photo-catalyst (for example, latent image of light-sensitive silver halide) and a reducing agent. The organosilver salt may be any organic substance containing a source capable of reducing silver ions. A silver salt of organic acid, especially a silver salt of a long-chain aliphatic carboxylic acid (having 10 to 30, preferably 15 to 28, carbon atoms), is preferred. A complex of organic or inorganic silver salt containing a ligand having a complex stability constant of 4.0 to 10.0 is also preferred. A silver supply material can preferably constitute about 5 to 30% by weight of each image forming layer.

Preferred organosilver salts include silver salts of carboxylated organic compounds. Examples thereof include silver salts of aliphatic carboxylic acids and silver salts of aromatic carboxylic acids, to which however the present invention is in no way limited. Preferred examples of aliphatic carboxylic acid silver salts include silver behenate, silver stearate, silver oleate, silver laurate, silver caproate, silver myristate, silver palmitate, silver maleate, silver fumarate, silver tartrate, silver linolate, silver butyrate, silver camphorate and mixtures thereof.

Also, use can be made of silver salts of compounds containing a mercapto or thione group or derivatives thereof. Preferred examples of these compounds include silver salt of 3-mercapto-4-phenyl-1,2,4-triazole, silver salt of 2-mercaptobenzimidazole, silver salt of 2-mercapto-5-aminothiadiazole, silver salt of 2-(ethylglycolamido) benzothiazole, thioglycolic acid silver salts such as silver salt of s-alkylthioglycolic acid (wherein the alkyl group has 12 to 22 carbon atoms), dithiocarboxylic acid silver salts such as silver salt of dithioacetic acid, thioamide silver salt, silver salt of 5-carboxyl-1-methyl-2-phenyl-4-thiopyridine, mercaptotriazine silver salt, silver salt of 2-mercaptobenzoxazole, silver salts of U.S. Pat. No. 4,123,274 including silver salts of 1,2,4-mercaptothiazole derivatives such as silver salt of 3-amino-5-benzylthio-1,2,4-thiazole, and thione compound silver salts such as silver salt of 3-(3-carboxyethyl)-4-methyl-4-thiazoline-2-thione described in U.S. Pat. No. 3,301,678. Further, use can be made of compounds containing an imino group. Preferred examples of these compounds include benzotriazole silver salts and derivatives thereof, for example, benzotriazole silver salts such as silver salt of methylbenzotriazole and silver salts of halogenated benzotriazoles such as silver salt of 5-chlorobenzotriazole, silver salts of 1,2,4-triazole or 1-H-tetrazole described in U.S. Pat. No. 4,220,709, and silver salts of imidazole and imidazole derivatives. Still further, use can be made of various silver acetylide compounds as described in, for example, U.S. Pat. Nos. 4,761,361 and 4,775,613. These organosilver salts may be used in combination.

Preferred particular examples of organosilver salts for use in the present invention are set forth in JP-A-1-100177, which are silver salts obtained by reacting at least one member selected from among the compounds of the following general formulae (I), (II) and (III) with a silver ion supplier such as silver nitrate.

(I)

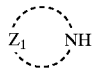

(II)

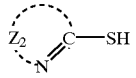

(III)

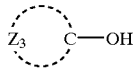

In the formulae, each of $Z_1$, $Z_2$ and $Z_3$ independently represents an atomic group required for forming a 5 to 9-membered heterocycle. Herein, the heterocycle comprehends a product of condensation with a benzene ring or naphthalene ring.

The compound for use in the production of the organosilver salt in the present invention will be described in detail below. In the general formula (I), $Z_1$ represents an atomic group required for forming a 5 to 9-membered (especially, 5-, 6- or 9-membered) heterocycle. As the heterocycle completed by $Z_1$ of the general formula (I), a 5-, 6- or 9-membered heterocycle containing at least one nitrogen atom (including a nitrogen atom of the formula) is preferred. More preferred is a 5-, 6- or 9-membered heterocycle containing two or more nitrogen atoms, or containing at least one nitrogen atom together with an oxygen atom or sulfur atom. Herein, the heterocycle comprehends a product of condensation with a benzene ring or naphthalene ring. The heterocycle formed with $Z_1$ may have a substituent.

Examples of such compounds include benzotriazoles, benzotriazoles described in, for example, JP-A-58-118638 and JP-A-58-118639, benzimidazoles, pyrazoloazoles described in JP-A-62-96940 {for example, 1H-imidazo[1, 2-b]pyrazoles, 1H-pyrazolo[1, 5-b]pyrazoles, 1H-pyrazolo[5, 1-c][1, 2, 4]triazoles, 1H-pyrazolo[1, 5-b][1, 2, 4]triazoles, 1H-pyrazolo[1, 5-d]tetrazoles and 1H-pyrazolo[1, 5-a]benzimidazoles}, triazoles, 1H-tetrazoles, carbazoles, saccharins, imidazoles and 6-aminopurines.

Among the compounds of the general formula (I), the compounds of the following general formula (I-1) are preferred.

(I-1)

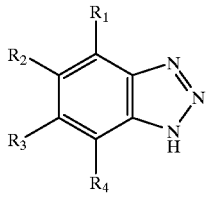

In the formula, each of $R_1$, $R_2$, $R_3$ and $R_4$ independently represents a hydrogen atom, a halogen atom, an alkyl group, an aralkyl group, an alkenyl group, an alkoxy group, an aryl group, a hydroxy group, a sulfo group or a salt thereof (for example, sodium salt, potassium salt or ammonium salt), a carboxy group or a salt thereof (for example, sodium salt, potassium salt or ammonium salt), —CN, —$NO_2$, —NRR', —COOR, —CONRR', —$NHSO_2R$ or —$SO_2NRR'$ (provided that each of R and R' represents a hydrogen atom, an alkyl group, an aryl group or an aralkyl group).

Examples of the compounds of the general formula (I) include benzotriazole, 4-hydroxybenzotriazole, 5-hydroxybenzotriazole, 4-sulfobenzotriazole, 5-sulfobenzotriazole, sodium benzotriazole-4-sulfonate, sodium benzotriazole-5-sulfonate, potassium benzotriazole-4-sulfonate, potassium benzotriazole-5-sulfonate, ammonium benzotriazole-4-sulfonate, ammonium benzotriazole-5-sulfonate, 4-carboxybenzotriazole, 5-carboxybenzotriazole, 4-sulfo-5-benzenesulfonamidobenzotriazole, 4-sulfo-5-hydroxycarbonylmethoxybenzotriazole, 4-sulfo-5-ethoxycarbonylmethoxybenzotriazole, 4-hydroxy-5-carboxybenzotriazole, 4-sulfo-5-carboxymethylbenzotriazole, 4-sulfo-5-ethoxycarbonylmethylbenzotriazole, 4-sulfo-5-phenylbenzotriazole, 4-sulfo-5- (p-nitrophenyl) benzotriazole, 4-sulfo-5- (p-sulfophenyl)benzotriazole, 4-sulfo-5-methoxy-6-chlorobenzotriazole, 4-sulfo-5-chloro-6-carboxybenzotriazole, 4-carboxy-5-chlorobenzotriazole, 4- carboxy-5-methylbenzotriazole, 4-carboxy-5-nitrobenzotriazole, 4-carboxy-5-aminobenzotriazole, 4-carboxy-5-methoxybenzotriazole, 4-hydroxy-5-aminobenzotriazole, 4-hydroxy-5-acetamidobenzotriazole, 4-hydroxy-5-benzenesulfonamidobenzotriazole, 4-hydroxy-5-hydroxycarbonylmethoxybenzotriazole, 4-hydroxy-5-ethoxycarbonylmethoxybenzotriazole, 4-hydroxy-5-carboxymethylbenzotriazole, 4-hydroxy-5-ethoxycarbonylmethylbenzotriazole, 4-hydroxy-5-phenylbenzotriazole, 4-hydroxy-5-(p-nitrophenyl) benzotriazole, 4-hydroxy-5-(p-sulfophenyl)benzotriazole, 4-sulfo-5-chlorobenzotriazole, 4-sulfo-5-methylbenzotriazole, 4-sulfo-5-methoxybenzotriazole, 4-sulfo-5-cyanobenzotriazole, 4-sulfo-5-aminobenzotriazole, 4-sulfo-5-acetoamidobenzotriazole, sodium benzotriazole-4-caroboxylate, sodium benzotriazole-5-caroboxylate, potassium benzotriazole-4-caroboxylate, potassium benzotriazole-5-caroboxylate, ammonium benzotriazole-4-caroboxylate, ammonium benzotriazole-5-caroboxylate, 5-carbamoylbenzotriazole, 4-sulfamoylbenzotriazole, 5-carboxy-6-hydroxybenzotriazole, 5-carboxy-7-sulfobenzotriazole, 4-hydroxy-5-sulfobenzotriazole, 4-hydroxy-7-sulfobenzotriazole, 5,6-dicarboxybenzotriazole, 4,6-dihydroxybenzotriazole, 4-hydroxy-5-chlorobenzotriazole, 4-hydroxy-5-methylbenzotriazole, 4-hydroxy-5-methoxybenzotriazole, 4-hydroxy-5-nitrobenzotriazole, 4-hydroxy-5-cyanobenzotriazole, 4-carboxy-5-acetamidobenzotriazole, 4-carboxy-5-ethoxycarbonylmethoxybenzotriazole, 4-carboxy-5-carboxymethylbenzotriazole, 4-carboxy-5-phenylbenzotriazole, 4-carboxy-5-(p-nitrophenyl)benzotriazole, 4-carboxy-5-methyl-7-sulfobenzotriazole, imidazole, benzimidazole, pyrazole, urazole, 6-aminopurine,

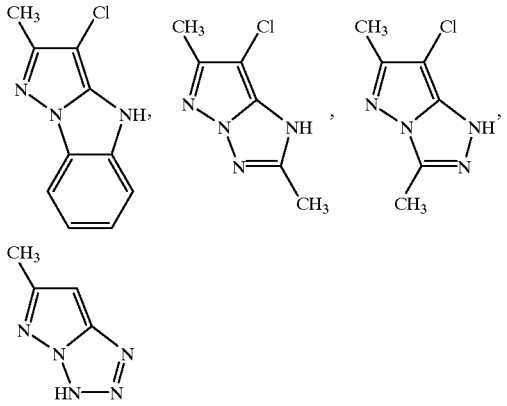

These may be used in combination.

The compounds represented by the general formula (II) will now be described. In the general formula (II), $Z_2$ represents an atomic group required for forming a 5 to 9-membered (especially, 5-, 6- or 9-membered) heterocycle. As the heterocycle completed by $Z_2$ of the above general formula (including C and N of the formula), a 5-, 6- or 9-membered heterocycle containing at least one nitrogen atom is preferred. More preferred is a 5-, 6- or 9-membered heterocycle containing two or more nitrogen atoms, or containing at least one nitrogen atom together with an oxygen atom or sulfur atom. Herein, the heterocycle comprehends a product of condensation with a benzene ring or naphthalene ring. The heterocycle formed with $Z_2$ may have a substituent.

Examples of such compounds include 2-mercaptobenzothiazoles, 2-mercaptobenzimidazoles, 2-mercaptothiadiazoles and 5-mercaptotetrazoles.

Particular examples of the compounds represented by the above general formula (II) include the following compounds, to which, however, the present invention is in no way limited.

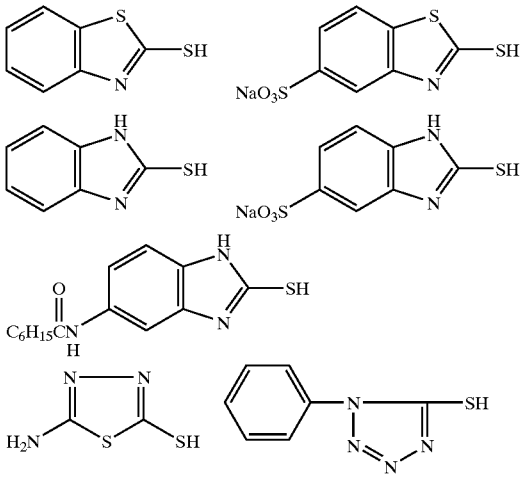

-continued

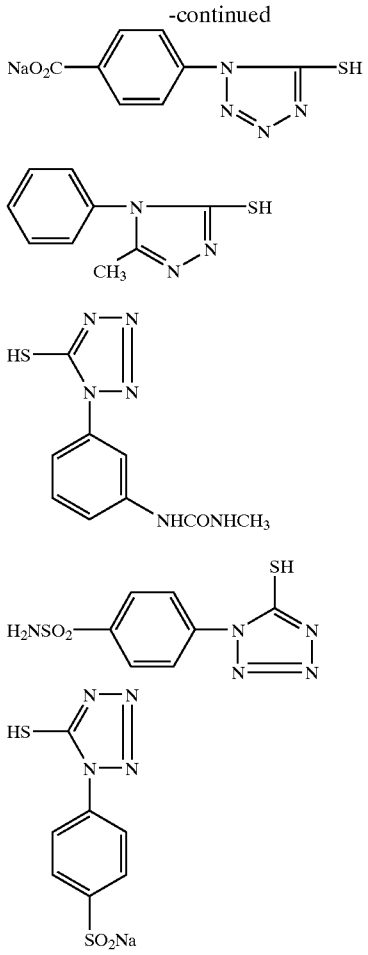

The compounds represented by the general formula (III) will be described below. In the general formula (III), $Z_3$ represents an atomic group required for forming a 5 to 9-membered (especially, 5-, 6- or 9-membered) heterocycle. As the heterocycle completed by $Z_3$ of the above general formula (including C of the formula), a 5-, 6- or 9-membered heterocycle containing at least one nitrogen atom is preferred. More preferred is a 5-, 6- or 9-membered heterocycle containing two or more nitrogen atoms, or containing at least one nitrogen atom together with an oxygen atom or sulfur atom. Herein, the heterocycle comprehends a product of condensation with a benzene ring, or naphthalene ring, or nitrogen-containing heterocycle having various substituents.

Examples of such compounds include hydroxytetrazaindenes, hydroxypyrimidines, hydroxypyridazines an hydroxypyrazines.

Particular examples of the compounds represented by the above general formula (III) include the following compounds, to which, however, the present invention is in no way limited.

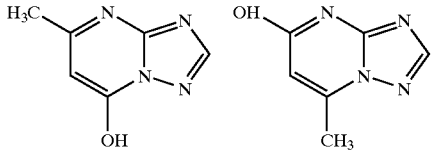

-continued

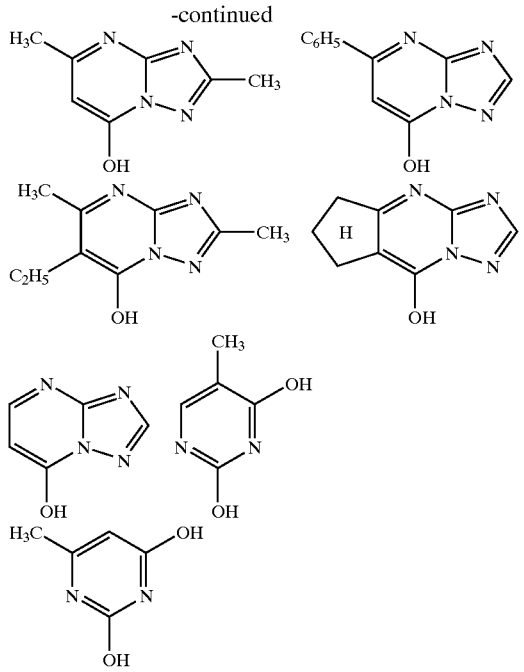

In the present invention, any of the compounds of the general formulae (I), (II) and (III) is mixed with silver nitrate in an appropriate reaction medium to thereby form a silver salt of the compound (hereinafter referred to as "organosilver salt"). Part of the silver nitrate can be replaced by another silver ion supplier (for example, silver chloride or silver acetate).

The method of adding such reactants is arbitrary. A compound of the general formula (I) to (III) may first be placed in a reaction vessel and thereafter loaded with silver nitrate. Alternatively, silver nitrate may first be placed in a reaction vessel and thereafter loaded with a compound of the general formula (I) to (III). Still alternatively, part of a compound of the general formula (I) to (III) may first be placed in a reaction vessel, subsequently loaded with part of silver nitrate, and thereafter sequentially loaded with the remainders of compound of the general formula (I) to (III) and silver nitrate. Still alternatively, silver nitrate and a compound of the general formula (I) to (III) may be simultaneously placed in a reaction vessel. During the reaction, it is preferred to effect agitation.

Although the compound of the general formula (I) to (III) is generally mixed with silver nitrate at a proportion of 0.8 to 100 mol per mol of silver, the reactants can be used outside this proportion, depending on the type of the compound. The addition rates of silver nitrate and the compound may be regulated so as to control the silver ion concentration during the reaction.

The layer to be loaded with the organosilver salt is not limited, and the organosilver salt may be incorporated in one layer or a plurality of layers. Incorporating the organosilver salt in a layer containing no light-sensitive silver halide emulsion in the hydrophilic colloid layers provided on the side having silver halide emulsion layers, such as a protective layer, an interlayer or a so-called substratum disposed between a support and an emulsion layer, is preferred from the viewpoint of storage life improvement.

This organosilver salt can be jointly used in an amount of 0.01 to 10 mol, preferably 0.05 to 1 mol, per mol of light-sensitive silver halide that is contained in the layer to which the organosilver salt is added. It is appropriate for the coating amount total of light-sensitive silver halide and organosilver salt to be in the range of 0.01 to 10 g/m$^2$, preferably 0.1 to 6 g/m$^2$, in terms of silver.

The silver halide emulsion and/or organosilver salt of the present invention can be protected against additional fogging and can be stabilized so as to be free from sensitivity change during storage by the use of an antifoggant, a stabilizer and a stabilizer precursor. As a suitable antifoggant, stabilizer and stabilizer precursor which can be used individually or in combination, there can be mentioned thiazonium salts described in U.S. Pat. Nos. 2,131,038 and 2,694,716; azaindenes described in U.S. Pat. Nos. 2,886,437 and 2,444,605; mercury salts described in U.S. Pat. No. 2,728,663; urazoles described in U.S. Pat. No. 3,287,135; sulfocatechols described in U.S. Pat. No. 3,235,652; oximes, nitrons and nitroindazoles described in GB No. 623,448; polyvalent metal salts described in U.S. Pat. No. 2,839,405; thiuronium salts described in U.S. Pat. No. 3,220,839; palladium, platinum and gold salts described in U.S. Pat. Nos. 2,566,263 and 2,597,915; halogenated organic compounds described in U.S. Pat. Nos. 4,108,665 and 4,442,202; triazines described in U.S. Pat. Nos. 4,128,557, 4,137,079, 4,138,365 and 4,459,350; and phosphorus compounds described in U.S. Pat. No. 4,411,985.

As the antifoggant which can preferably be employed in the present invention, there can be mentioned organic halides, examples of which include compounds disclosed in, for example, JP-A's 50-119624, 50-120328, 51-121332, 54-58022, 56-70543, 56-99335, 59-90842, 61-129642, 62-129845, 6-208191, 7-5621, 7-2781 and 8-15809, and U.S. Pat. Nos. 5,340,712, 5,369,000 and 5,463,737.

The antifoggant for use in the present invention may be added to a coating liquid in the form of any of, for example, a solution, powder and a solid particulate dispersion. The solid particulate dispersion is obtained by the use of known atomizing means (for example, ball mill, vibration ball mill, sand mill, colloid mill, jet mill or roller mill). In the preparation of the solid particulate dispersion, use may be made of a dispersion auxiliary.

The light-sensitive material of the present invention may contain benzoic acids for attaining sensitivity enhancement and fogging prevention. Although the benzoic acids which can be added in the present invention may be any of benzoic acid derivatives, compounds described in, for example, U.S. Pat. Nos. 4,784,939 and 4,152,160 can be mentioned as providing preferable forms of structures thereof.

The benzoic acids of the present invention, although may be added to any portion of the light-sensitive material, are preferably added to a layer of the light-sensitive layer side, more preferably to a layer containing an organosilver salt. The timing of addition of benzoic acids of the present invention may be any stage of the process for preparing the coating liquid. In the addition to a layer containing an organosilver salt, the addition, although may be effected at any stage between preparation of the organosilver salt to preparation of the coating liquid, is preferably carried out between preparation of the organosilver salt and just before a coating operation. With respect to the method of adding the benzoic acids of the present invention, the addition may be effected in the form of, for example, a powder, a solution or a particulate dispersion. Also, the addition may be effected in the form of a solution wherein the benzoic acid is mixed with other additives such as a sensitizing dye and a reducing agent. The addition amount of benzoic acids of the present invention, although not limited, is preferably in the range of $1\times10^{-6}$ to 2 mol, more preferably $1\times10^{-3}$ to 0.5 mol, per mol of silver.

The light-sensitive material of the present invention can be loaded with a mercapto compound, a disulfide compound and a thione compound in order to control development through development inhibition or acceleration, to enhance spectral sensitization efficiency and to prolong storage life before and after development.

When a mercapto compound is used in the present invention, although the structure thereof is not limited, compounds of the formula Ar—SM or Ar—S—S—Ar can preferably be employed. In the formula, M represents a hydrogen atom or an alkali metal atom. Ar represents an aromatic ring group or condensed aromatic ring group containing at least one nitrogen, sulfur, selenium or tellurium atom. Preferably, the heteroaromatic ring consists of benzimidazole, naphthimidazole, benzothiazole, naphthothiazole, benzoxazole, naphthoxazole, benzoselenazole, benzotellurazole, imidazole, oxazole, pyrazole, triazole, thiadiazole, tetrazole, triazine, pyrimidine, pyridazine, pyrazine, pyridine, purine, quinoline or quinazolinone. This heteroaromatic ring may have a substituent, for example, selected from the group consisting of halogens (e.g., Br and Cl), hydroxy, amino, carboxy, alkyls (e.g., alkyls having 1 or more carbon atoms, preferably 1 to 4 carbon atoms) and alkoxies (e.g., alkoxies having 1 or more carbon atoms, preferably 1 to 4 carbon atoms). As mercapto-substituted heteroaromatic compounds, there can be mentioned, for example, 2-mercaptobenzimidazole, 2-mercaptobenzoxazole, 2-mercaptobenzothiazole, 2-mercapto-5-methylbenzimidazole, 6-ethoxy-2-mercaptobenzothiazole, 2,2'-dithiobisbenzothiazole, 3-mercapto-1,2,4-triazole, 4,5-diphenyl-2-imidazolethiol, 2-mercaptoimidazole, 1-ethyl-2-mercaptobenzimidazole, 2-mercaptoquinoline, 8-mercaptopurine, 2-mercapto-4(3H)-quinazolinone, 7-trifluoromethyl-4-quinolinethiol, 2,3,5,6-tetrachloro-4-pyridinethiol, 4-amino-6-hydroxy-2-mercaptopyrimidine monohydrate, 2-amino-5-mercapto-1,3,4-thiadiazole, 3-amino-5-mercapto-1,2,4-triazole, 4-hydroxy-2-mercaptopyrimidine, 2-mercaptopyrimidine, 4,6-diamino-2-mercaptopyrimidine, 2-mercapto-4-methylpyrimidine hydrochloride, 3-mercapto-5-phenyl-1,2,4-triazole and 2-nercapto-4-phenyloxazole. The present invention is however in no way limited to these.

The addition amount of these mercapto compounds is preferably in the range of 0.001 to 1.0 mol, more preferably 0.01 to 0.3 mol, per mol of silver in an emulsion layer.

In the light-sensitive material of the present invention. there can preferably be employed a silver halide solvent. For example, there can preferably be employed thiosulfates, sulfites, thiocyanates, thioether compounds described in JP-B-47-11386, compounds having a 5- or 6-membered imido group, such as uracil or hydantoin, described in JP-A-8-179458, compounds having a carbon to sulfur double bond as described in JP-A-53-144319, and mesoionic thiolate compounds such as trimethyltriazolium thiolate as described in Analytica Chimica Acta, vol. 248, pages 604 to 614 (1991). Also, compounds which can fix and stabilize silver halides as described in JP-A-8-69097 can be used as the silver halide solvent.

The amount of silver halide solvent contained in the light-sensitive material is in the range of 0.01 to 100 mmol/$m^2$, preferably 0.1 to 50 mmol/$m^2$, and more preferably 10 to 50 mmol/$m^2$. The molar ratio of silver halide solvent to coating silver of the light-sensitive material is in the range of 1/20 to 20, preferably 1/10 to 10, and more preferably 1/3 to 3. The silver halide solvent may be added to a solvent such as water, methanol, ethanol, acetone, dimethylformamide or methylpropylglycol, or an alkali or acid aqueous solution, or may be dispersed so as to form a solid particulate dispersion, before addition to the coating liquid. The silver halide solvents may be used individually. Also, preferably, a plurality thereof can be used in combination.

Hydrophilic binders are preferably employed in the constituent layers of the light-sensitive material of the present invention. Examples of such hydrophilic binders include those described in the aforementioned RDs and JP-A-64-13546, pages 71 to 75. In particular, transparent or translucent hydrophilic binders are preferred, which can be constituted of, for example, natural compounds including a protein, such as gelatin or a gelatin derivative, and a polysaccharide, such as a cellulose derivative, starch, gum arabic, dextran or pulluran, or synthetic polymer compounds, such as polyvinyl alcohol, modified polyvinyl alcohol (e.g., terminal-alkylated Poval MP 103 and MP 203 produced by Kuraray Co., Ltd.), polyvinylpyrrolidone and an acrylamide polymer. Also, use can be made of highly water absorbent polymers described in, for example, U.S. Pat. No. 4,960,681 and JP-A-62-245260, namely, a homopolymer of any of vinyl monomers having —COOM or —$SO_3$M (M is a hydrogen atom or an alkali metal), a copolymer of such vinyl monomers and a copolymer of any of such vinyl monomers and another vinyl monomer (e.g., sodium methacrylate or ammonium methacrylate, Sumikagel L-5H produced by Sumitomo Chemical Co., Ltd.). These binders can be used individually or in combination. A combination of gelatin and other binders mentioned above is preferred. The gelatin can be selected from among lime-processed gelatin, acid-processed gelatin and delimed gelatin which is one having a content of calcium and the like reduced to conform with various purposes. These can be used in combination.

Polymer latex is also preferably employed as the binder in the present invention. Polymer latex is a dispersion of a water-insoluble hydrophobic polymer, as fine particles, in a water-soluble dispersion medium. The state of dispersion is not limited, and the polymer latex may be any of a latex comprising a polymer emulsified in a dispersion medium, a product of emulsion polymerization, a micelle dispersion, and a molecular dispersion of molecular chains per se due to the presence of a partial hydrophilic structure in the polymer molecule. With respect to the polymer latex for use in the present invention, reference can be made to, for example, Gosei Jushi Emulsion (Synthetic Resin Emulsion) edited by Taira Okuda and Hiroshi Inagaki and published by Polymer Publishing Association (1978), Gosei Latex no Oyo (Application of Synthetic Latex) edited by Takaaki Sugimura, Yasuo Kataoka, Soichi Suzuki and Keiji Kasahara and published by Polymer Publishing Association (1993), and Gosei Latex no Kagaku (Chemistry of Synthetic Latex) edited by Soichi Muroi and published by Polymer Publishing Association (1970).

The average particle diameter of dispersed particles is preferably in the range of about 1 to 50,000 nm, more preferably 5 to 1000 nm. The particle diameter distribution of dispersed particles is not particularly limited. The polymer species for use in the polymer latex are, for example, an acrylic resin, a vinyl acetate resin, a polyester resin, a polyurethane resin, a rubber resin, a vinyl chloride resin, a vinylidene chloride resin and a polyolefin resin.

The polymer may be linear, or branched, or crosslinked. The polymer may be a product of polymerization of a single monomer, known as a homopolymer, or a copolymer obtained by polymerization of a plurality of monomers. The copolymer may be a random copolymer, or a block copolymer.

The molecular weight of the polymer is preferably in the range of about 5 to 1000 thousand, more preferably 10 to 500 thousand, in terms of number average molecular weight Mn. When the molecular weight is extremely small, the mechanical strength of the light-sensitive layer is unsatisfactory. On the other hand, when the molecular weight is extremely large, the film forming properties are unfavorably deteriorated.

With respect to the polymer of the polymer latex for use in the present invention, the equilibrium water content at 25° C. 60% RH is 2 wt % or less, preferably 1 wt % or less. The lower limit of the equilibrium water content, although not particularly limited, is preferably 0.01 wt % or more, more preferably 0.03 wt % or more. With respect to the definition and measuring method of the equilibrium water content, reference can be made to, for example, "Kobunshi Kogaku Koza 14, Kobunshi Zairyo Shiken Hou (Polymer Engineering Course 14, Polymer Material Testing Method)" edited by the Society of Polymer Science of Japan and published by Chijin Shokan Co., Ltd. Specifically, the equilibrium water content at 25° C. 60% RH can be expressed by the following formula including the mass $W_1$ of polymer humidity-controlled and equilibrated in an atmosphere of 25° C. 60% RH and the mass $W_0$ of polymer absolutely dried at 25° C.:

"Equilibrium water content at 25° C. in 60% relative humidity (hereinafter also referred to as RH)"=$\{W_1-W_0)/W_0\}\times 100$ (wt %).

These polymers are commercially available, and the following polymers can be used in the form of polymer latexes. Examples of acrylic resins include Cevian A-4635, 46583 and 4601 (produced by Daicel Chemical Industries, Ltd.) and Nipol Lx811, 814, 821, 820 and 857 (produced by Nippon Zeon Co., Ltd.). Examples of polyester resins include Finetex ES650, 611, 675 and 850 (produced by Dainippon Ink & Chemicals, Inc.) and WD-size, WMS (produced by Eastman Chemical). Examples of polyurethane resins include Hydran AP10, 20, 30 and 40 (produced by Dainippon Ink & Chemicals, Inc.). Examples of rubber resins include Lacstar 7310K, 3307B, 4700H, 7132C and DS206 (produced by Dainippon Ink & Chemicals, Inc.) and Nipol Lx416, 433, 410, 438C and 2507 (produced by Nippon Zeon Co., Ltd.). Examples of vinyl chloride resins include G351 and G576 (produced by Nippon Zeon Co., Ltd.). Examples of vinylidene chloride resins include L502 and L513 (produced by Asahi Chemical Industry Co., Ltd.). Examples of olefin resins include Chemipearl S120 and SA100 (produced by Mitsui Chemicals, Inc.). These polymers may be used individually in the form of polymer latexes, or a plurality thereof may be blended together before use according to necessity.

It is especially preferred that the polymer latex for use in the present invention consist of a latex of styrene/butadiene copolymer. In the styrene/butadiene copolymer, the weight ratio of styrene monomer units to butadiene monomer units is preferably in the range of 50:50 to 95:5. The ratio of styrene monomer units and butadiene monomer units to the whole copolymer is preferably in the range of 50 to 99% by weight. The preferred range of molecular weight thereof is as aforementioned.

As the latex of styrene/butadiene copolymer preferably employed in the present invention, there can be mentioned, for example, commercially available Lacstar 3307B, 7132C and DS206 and Nipol Lx416 and Lx 433.

In the present invention, it is appropriate for the coating amount of binder to be in the range of 1 to 20 g/m$^2$, preferably 2 to 15 g/m$^2$, and more preferably 3 to 12 g/m$^2$. In the binder, the gelatin can be used in an amount of 50 to 100%, preferably 70 to 100%.

Now, the developing agents and/or precursors thereof which can preferably be contained in the light-sensitive material of the present invention will be described.

In the light-sensitive material of the present invention, it is preferred that the developing agents and/or precursors thereof be contained in at least one light-sensitive silver halide emulsion layer and/or at least one nonlight-sensitive layer.

As the developing agent, although p-phenylenediamine compounds and p-aminophenol compounds can be used, it is preferred to employ the compounds of the following general formulae (1) to (5).

(1)

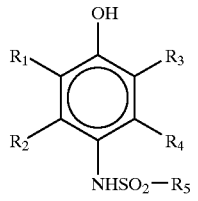

(2)

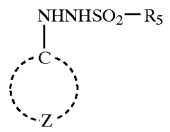

(3)

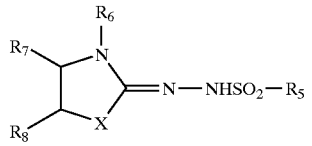

(4)

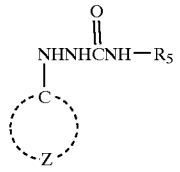

(5)

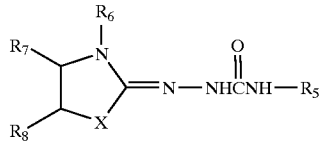

The compounds of the general formula (1) are those generally termed "sulfonamidophenols".

In the general formula (1), each of $R_1$ to $R_4$ independently represents a hydrogen atom, a halogen atom (e.g., chloro or bromo), an alkyl group (e.g., methyl, ethyl, isopropyl, n-butyl or t-butyl), an aryl group (e.g., phenyl, tolyl or xylyl), an alkylcarbonamido group (e.g., acetylamino, propionylamino or butyroylamino), an arylcarbonamido group (e.g., benzoylamino), an alkylsulfonamido group (e.g., methanesulfonylamino or ethanesulfonylamino), an arylsulfonamido group (e.g., benzenesulfonylamino or toluenesulfonylamino), an alkoxy group (e.g., methoxy, ethoxy or butoxy), an aryloxy group (e.g., phenoxy), an alkylthio group (e.g., methylthio, ethylthio or butylthio), an arylthio group (e.g., phenylthio or tolylthio), an alkylcarbamoyl group (e.g., methylcarbamoyl, dimethylcarbamoyl, ethylcarbamoyl, diethylcarbamoyl, dibutylcarbamoyl, piperidylcarbamoyl or morpholinylcarbamoyl), an arylcarbamoyl group (e.g., phenylcarbamoyl, methylphenylcarbamoyl, ethylphenylcarbamoyl or benzylphenylcarbamoyl), a carbamoyl group, an alkylsulfamoyl group (e.g., methylsulfamoyl, dimethylsulfamoyl, ethylsulfamoyl, diethylsulfamoyl, dibutylsulfamoyl, piperidylsulfamoyl or morpholynosulfamoyl), an arylsulfamoyl group (e.g., phenylsulfamoyl, methylphenylsulfamoyl, ethylphenylsulfamoyl or benzylphenylsulfamoyl), a sulfamoyl group, a cyano group, an alkylsulfonyl group (e.g., methanesulfonyl or ethanesulfonyl), an arylsulfonyl group (e.g., phenylsulfonyl, 4-chlorophenylsulfonyl or p-toluenesulfonyl), an alkoxycarbonyl group (e.g., methoxycarbonyl, ethoxycarbonyl or butoxycarbonyl), an aryloxycarbonyl group (e.g., phenoxycarbonyl), an alkylcarbonyl group (e.g., acetyl, propionyl or butyroyl), an arylcarbonyl group (e.g., benzoyl or alkylbenzoyl), or an acyloxy group (e.g., acetyloxy, propionyloxy or butyroyloxy). Among $R_1$ to $R_4$, each of $R_2$ and $R_4$ preferably represents a hydrogen atom, a halogen atom, an alkyl group, an aryl group, an alkylcarbonamido group, an arylcarbonamido group, an alkylcarbamoyl group, an arylcarbamoyl group, a carbamoyl group, an alkylsulfamoyl group, an arylsulfamoyl group, a sulfamoyl group, a cyano group, an alkylsulfonyl group, an arylsulfonyl group, an alkoxycarbonyl group, an aryloxycarbonyl group or an acyl group. $R_1$ to $R_4$ are preferably such electron attractive substituents that the total of Hammett's constant a values thereof is 0 or more.

$R_5$ represents an alkyl group (e.g., methyl, ethyl, butyl, octyl, lauryl, cetyl or stearyl), an aryl group (e.g., phenyl, tolyl, xylyl, 4-methoxyphenyl, dodecylphenyl, chlorophenyl, trichlorophenyl, nitrochlorophenyl, triisopropylphenyl, 4-dodecyloxyphenyl or 3,5-di-(methoxycarbonyl)phenyl) or a heterocyclic group (e.g., pyridyl). $R_5$ has preferably 6 or more carbon atoms, more preferably 15 or more carbon atoms. The upper limit of the number of carbon atoms of $R_5$ is preferably 40.

The compounds of the general formula (2) are those generally termed "sulfonylhydrazines". The compounds of the general formula (4) are those generally termed "carbamoylhydrazines".

In the general formulae (2) and (4), RS is the same as mentioned above for $R_5$ in the general formula (1). Z represents an atomic group forming an aromatic ring. The aromatic ring formed by Z must have satisfactory electron withdrawing properties for providing the above compounds with a silver development activity. Accordingly, a nitrogen-containing aromatic ring, or an aromatic ring such as one comprising a benzene ring having electron attractive groups introduced therein, is preferred. As such an aromatic ring, there can be preferably employed, for example, a pyridine ring, a pyrazine ring, a pyrimidine ring, a quinoline ring or a quinoxaline ring.

When Z is a benzene ring, as substituents thereof, there can be mentioned, for example, an alkylsulfonyl group (e.g., methanesulfonyl or ethanesulfonyl), a halogen atom (e.g., chloro or bromo), an alkylcarbamoyl group (e.g., methylcarbamoyl, dimethylcarbamoyl, ethylcarbamoyl, diethylcarbamoyl, dibutylcarbamoyl, piperidylcarbamoyl or morpholynocarbamoyl), an arylcarbamoyl group (e.g., phenylcarbamoyl, methylphenylcarbamoyl, ethylphenylcarbamoyl or benzylphenylcarbamoyl), a carbamoyl group, an alkylsulfamoyl group (e.g., methylsulfamoyl, dimethylsulfamoyl, ethylsulfamoyl, diethylsulfamoyl, dibutylsulfamoyl, piperidylsulfamoyl or morpholynosulfamoyl), an arylsulfamoyl group (e.g., phenylsulfamoyl, methylphenylsulfamoyl, ethylphenylsulfamoyl or benzylphenylsulfamoyl), a sulfamoyl group, a cyano group, an alkylsulfonyl group (e.g., methanesulfonyl or ethanesulfonyl), an arylsulfonyl group (e.g., phenylsulfonyl, 4-chlorophenylsulfonyl or p-toluenesulfonyl), an alkoxycarbonyl group (e.g., methoxycarbonyl, ethoxycarbonyl or butoxycarbonyl), an aryloxycarbonyl group (e.g., phenoxycarbonyl), an alkylcarbonyl group (e.g., acetyl, propionyl or butyroyl), and an arylcarbonyl group (e.g., benzoyl or alkylbenzoyl). These substituents are preferably such electron attractive substituents that the total of Hammett's constant a values thereof is 1 or more.

The compounds of the general formula (3) are those generally termed "sulfonylhydrazones". The compounds of the general formula (5) are those generally termed "carbamoylhydrazones".

In the general formulae (3) and (5), $R_5$ is the same as mentioned above for $R_5$ in the general formula (1). $R_6$ represents a substituted or unsubstituted alkyl group (e.g., methyl or ethyl). X represents any of an oxygen atom, a sulfur atom, a selenium atom and an alkyl-substituted or aryl-substituted tertiary nitrogen atom. Of these, an alkyl-substituted tertiary nitrogen atom is preferred. $R_7$ and $R_8$ each represent a hydrogen atom or a substituent, provided that $R_7$ and $R_8$ may be bonded to each other to thereby form a double bond or a ring.

Particular examples of the compounds represented by the general formulae (1) to (5) will be set forth below, to which, however, the compounds of the present invention are not limited.

D-1

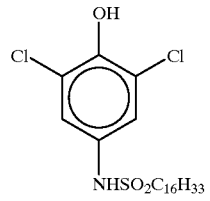

D-2

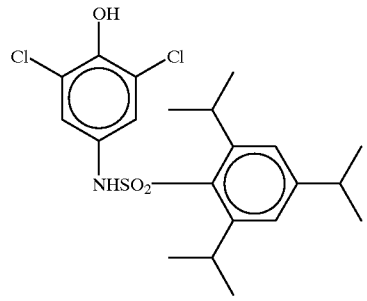

D-3

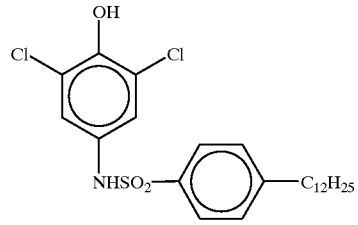

-continued
D-4
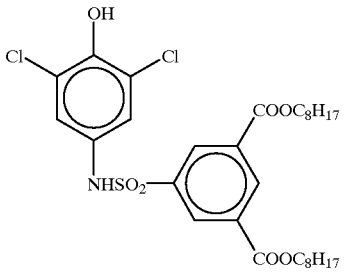
D-5
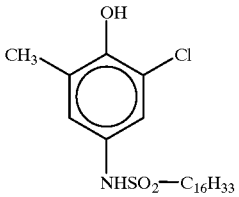
D-6
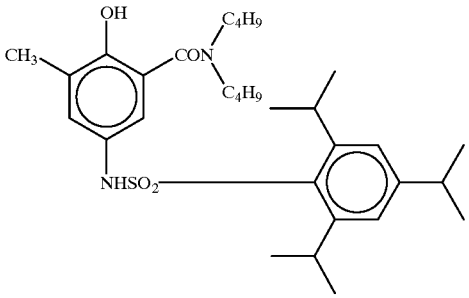
D-7
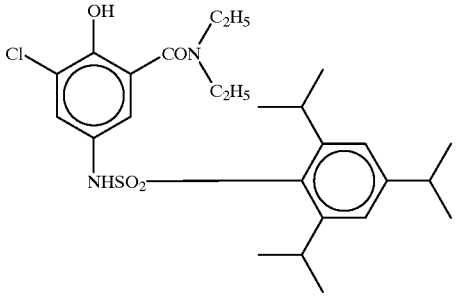
D-8
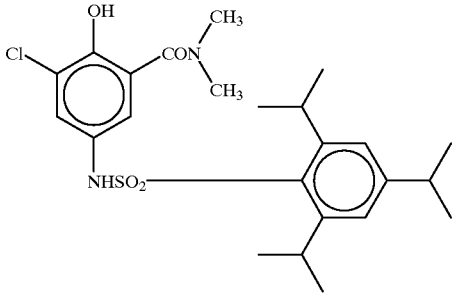
-continued
D-9
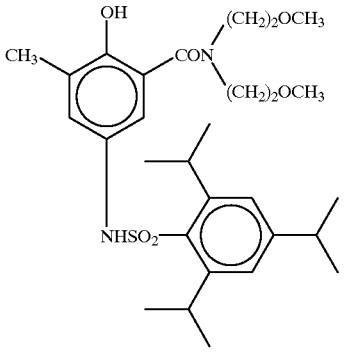
D-10
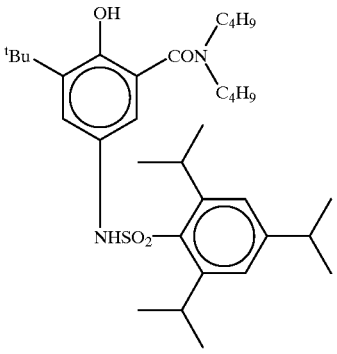
D-11
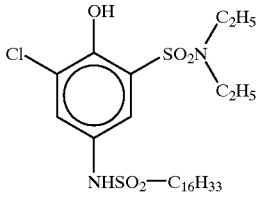
D-12
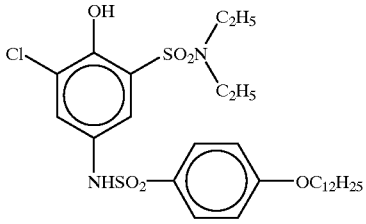
D-13
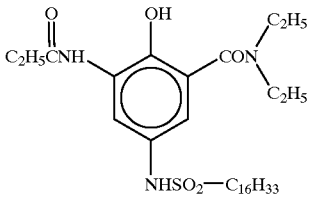
D-14
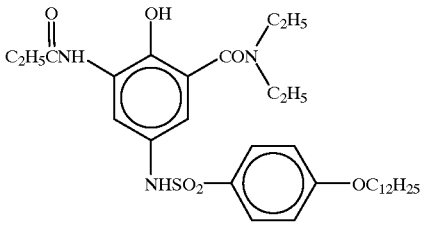

-continued
D-15
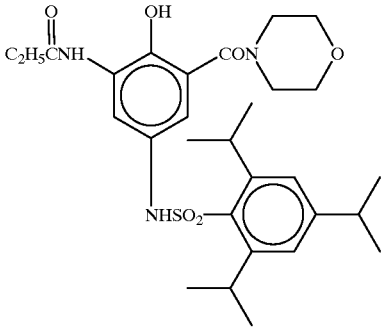
D-16
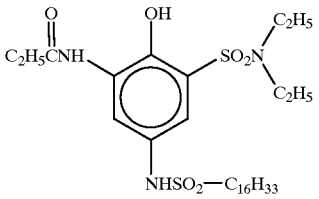
D-17
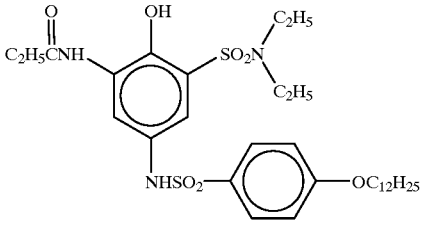
D-18
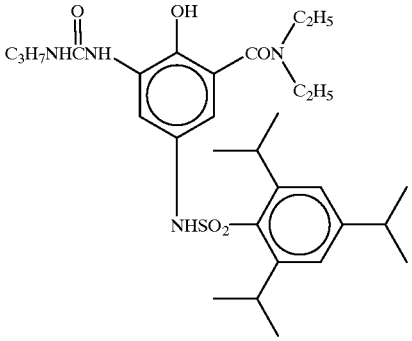
D-19
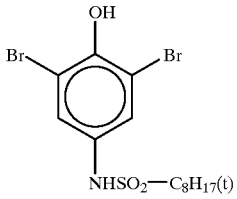
-continued
D-20
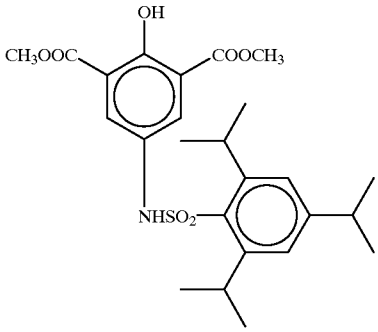
D-21
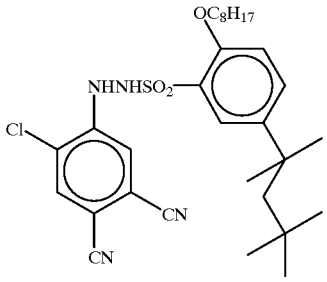
D-22
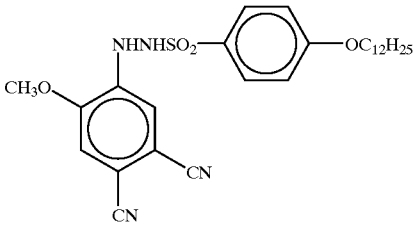
D-23
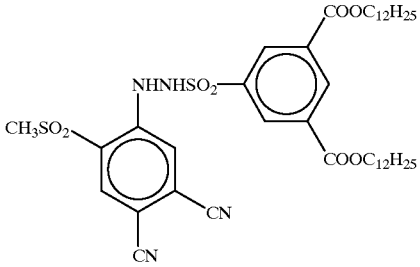
D-24
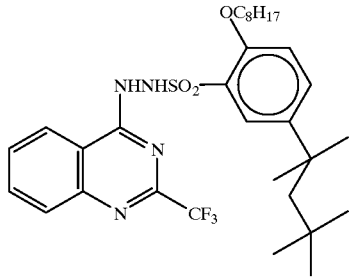

-continued
D-25
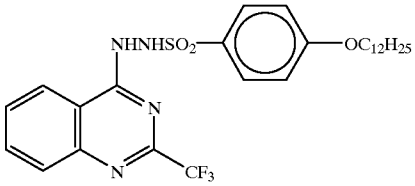
D-26
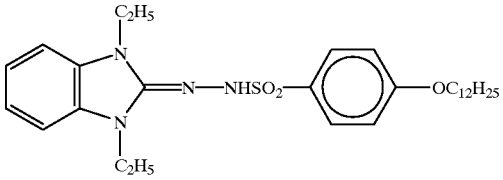
D-27
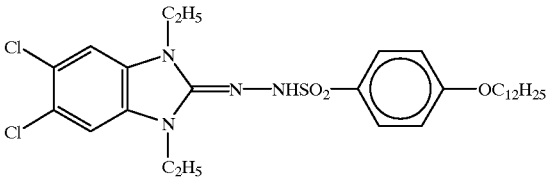
D-28
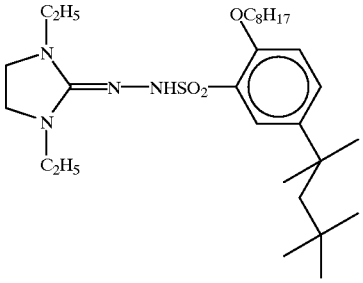
D-29
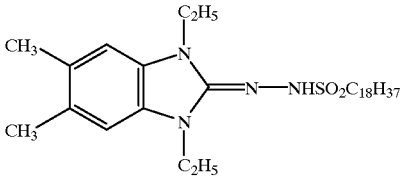
D-30
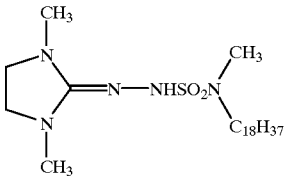
D-31
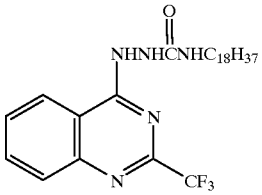
-continued
D-32
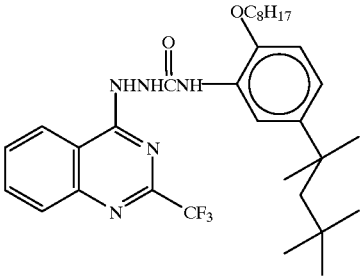
D-33
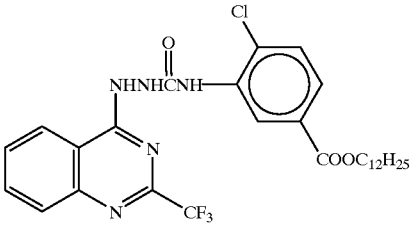
D-34
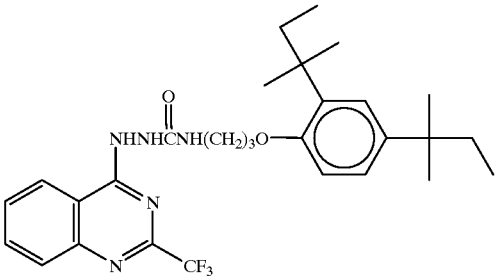
D-35
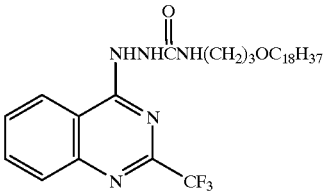
D-36
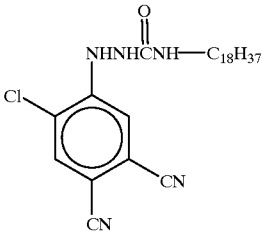
D-37
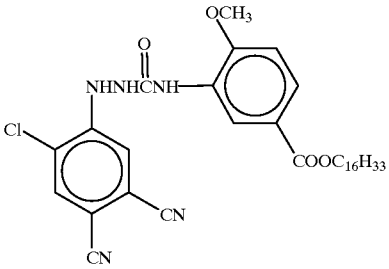

-continued
D-38
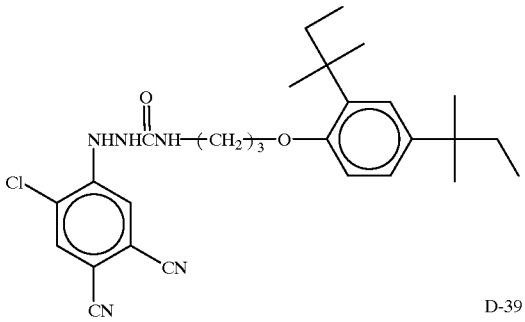
D-39
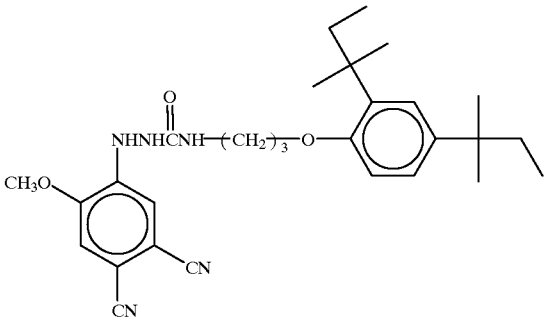
D-40
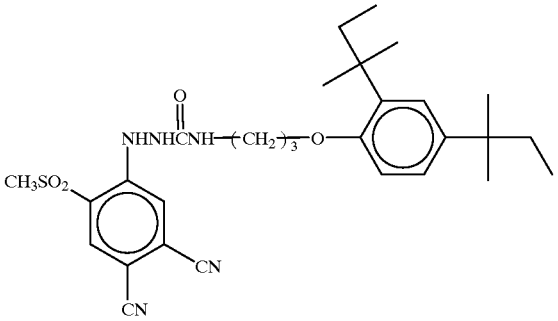
D-41
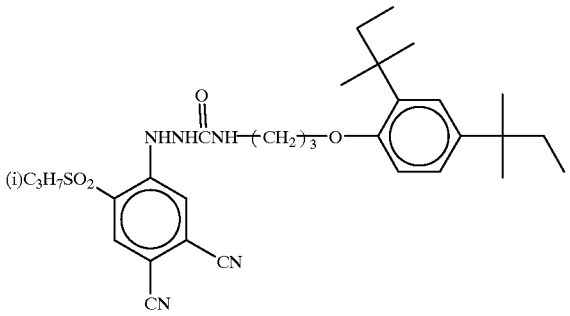
D-42
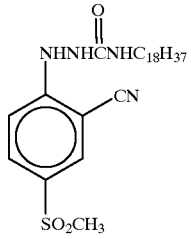
-continued
D-43
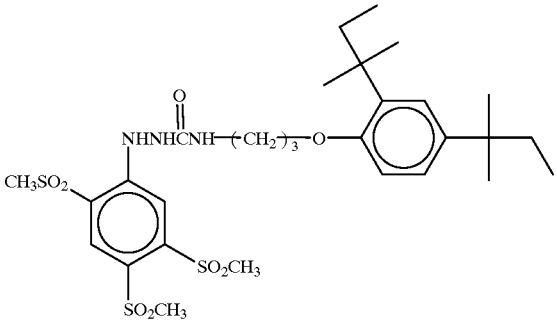
D-44
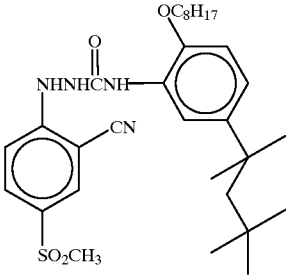
D-45
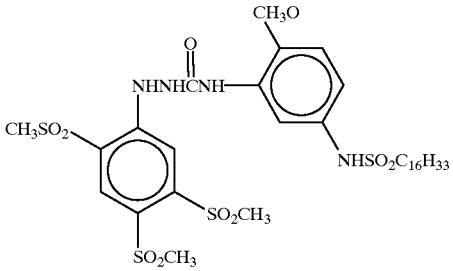
D-46
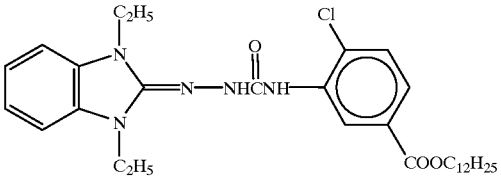
D-47
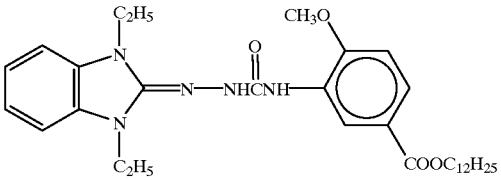
D-48
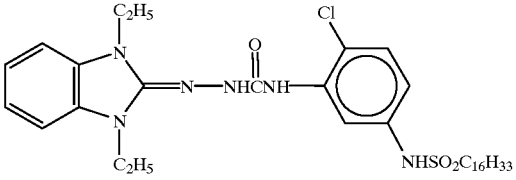

-continued

D-49

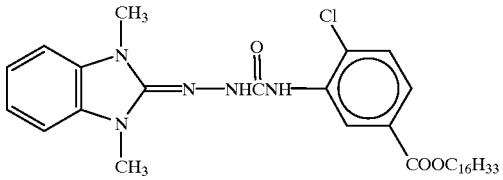

D-50

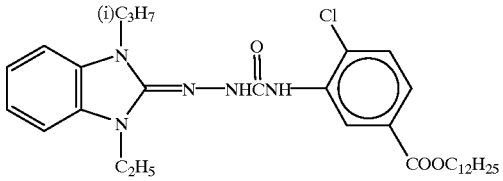

D-51

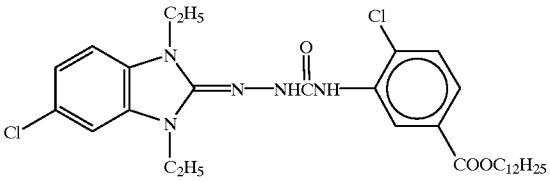

D-52

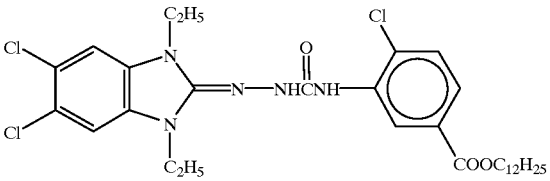

D-53

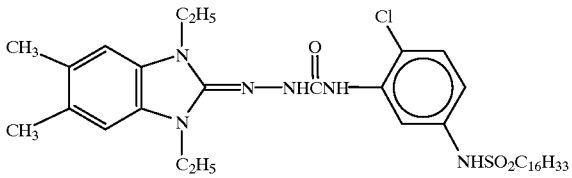

D-54

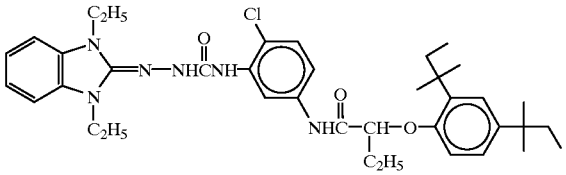

D-55

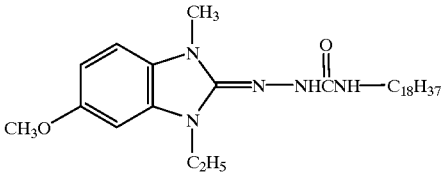

-continued

D-56

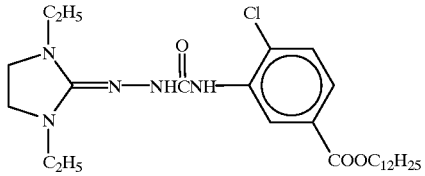

D-57

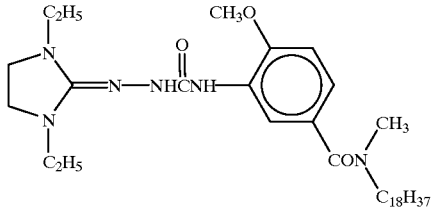

D-58

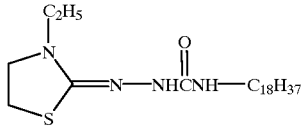

D-59

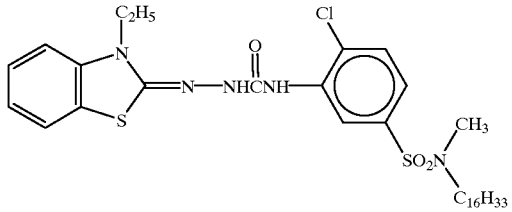

D-60

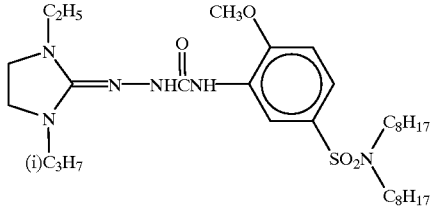

Further, as preferable developing agent precursors which can be contained in the light-sensitive material of the present invention, there can be mentioned the compounds represented by the following general formula (6).

(6)

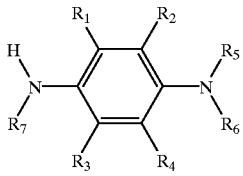

Each of $R_1$, $R_2$, $R_3$ and $R_4$ independently represents a hydrogen atom or a substituent. The substituent represented by $R_1$, $R_2$, $R_3$ or $R_4$ can be a halogen atom, an alkyl group (including a cycloalkyl and a bicycloalkyl), an alkenyl group (including a cycloalkenyl and a bicycloalkenyl), an alkynyl group, an aryl group, a heterocyclic group, a cyano group, a hydroxyl group, a nitro group, a carboxyl group, an alkoxy group, an aryloxy group, a silyloxy group, a heterocyclic oxy group, an acyloxy group, a carbamoyloxy group, an alkoxycarbonyloxy group, an aryloxycarbonyloxy group, an amino group (including anilino), an acylamino group, an aminocarbonylamino group, an alkoxycarbonylamino group, an aryloxycarbonylamino group, a sulfamoylamino group, an alkyl- or arylsulfonylamino group, a mercapto group, an alkylthio group, an arylthio group, a heterocyclic thio group, a sulfamoyl group, a sulfo group, an alkyl- or arylsulfinyl group, an alkyl- or arylsulfonyl group, an acyl group, an aryloxycarbonyl group, an alkoxycarbonyl group, a carbamoyl group, an aryl- or heterocyclic azo group, an imido group, a phosphino group, a phosphinyl group, a phosphinyloxy group, a phosphinylamino group, or a silyl group.

More specifically, the substituent represented by $R_1$, $R_2$, $R_3$ or $R_4$ can be a halogen atom (e.g., a chlorine atom, a bromine atom or an iodine atom); an alkyl group [representing a linear, branched or cyclic substituted or unsubstituted alkyl group, and including an alkyl group (preferably an alkyl group having 1 to 30 carbon atoms, such as methyl, ethyl, n-propyl, isopropyl, t-butyl, n-octyl, eicosyl, 2-chloroethyl, 2-cyanoethyl or 2-ethylhexyl), a cycloalkyl group (preferably a substituted or unsubstituted cycloalkyl group having 3 to 30 carbon atoms, such as cyclohexyl, cyclopentyl or 4-n-dodecylcyclohexyl), a bicycloalkyl group (preferably a substituted or unsubstituted bicycloalkyl group having 5 to 30 carbon atoms, which is a monovalent group corresponding to a bicycloalkane having 5 to 30 carbon atoms from which one hydrogen atom is removed, such as bicyclo[1,2,2]heptan-2-yl or bicyclo[2,2,2]octan-3-yl), and a tricyclo or more cycle structure; the alkyl contained in the following substituents (for example, the alkyl of alkylthio group) also means the alkyl group of this concept]; an alkenyl group [representing a linear, branched or cyclic substituted or unsubstituted alkenyl group, and including an alkenyl group (preferably a substituted or unsubstituted alkenyl group having 2 to 30 carbon atoms, such as vinyl, allyl, pulenyl, geranyl or oleyl), a cycloalkenyl group (preferably a substituted or unsubstituted cycloalkenyl group having 3 to 30 carbon atoms, which is a monovalent group corresponding to a cycloalkene having 3 to 30 carbon atoms from which one hydrogen atom is removed, such as 2-cyclopenten-1-yl or 2-cyclohexen-1-yl), and a bicycloalkenyl group (substituted or unsubstituted bicycloalkenyl group, preferably a substituted or unsubstituted bicycloalkenyl group having 5 to 30 carbon atoms, which is a monovalent group corresponding to a bicycloalkene having one double bond from which one hydrogen atom is removed, such as bicyclo[2,2,1]hept-2-en-1-yl or bicyclo[2,2,2]oct-2-en-4-yl)]; an alkynyl group (preferably a substituted or unsubstituted alkynyl group having 2 to 30 carbon atoms, such as ethynyl, propargyl or trimethylsilylethynyl); an aryl group (preferably a substituted or unsubstituted aryl group having 6 to 30 carbon atoms, such as phenyl, p-tolyl, naphthyl, m-chlorophenyl or o-hexadecanoylaminophenyl); a heterocyclic group (preferably a monovalent group corresponding to a 5- or 6-membered substituted or unsubstituted aromatic or nonaromatic heterocyclic compound from which one hydrogen atom is removed, and to which an aromatic hydrocarbon ring such as benzen ring may be condences, more preferably a 5- or 6-membered aromatic heterocyclic group having 3 to 30 carbon atoms, such as 2-furyl, 2-thienyl, 2-pyrimidinyl or 2-benzothiazolyl); a cyano group; a hydroxyl group; a nitro group; a carboxyl group; an alkoxy group (preferably a substituted or unsubstituted alkoxy group having 1 to 30 carbon atoms, such as methoxy, ethoxy, isopropoxy, t-butoxy, n-octyloxy or 2-methoxyethoxy); an aryloxy group (preferably a substituted or unsubstituted aryloxy group having 6 to 30 carbon atoms, such as phenoxy, 2-methylphenoxy, 4-t-butylphenoxy, 3-nitrophenoxy or 2-tetradecanoylaminophenoxy); a silyloxy group (preferably a silyloxy group having 3 to 20 carbon atoms, such as trimethylsilyloxy or t-butyldimethylsilyloxy); a heterocyclic oxy group (preferably a substituted or unsubstituted heterocyclic oxy group having 2 to 30 carbon atoms, such as 1-phenyltetrazol-5-oxy or 2-tetrahydropyranyloxy); an acyloxy group (preferably a formyloxy group, a substituted or unsubstituted alkylcarbonyloxy group having 2 to 30 carbon atoms or a substituted or unsubstituted arylcarbonyloxy group having 6 to 30 carbon atoms, such as formyloxy, acetyloxy, pivaloyloxy, stearoyloxy, benzoyloxy or p-methoxyphenylcarbonyloxy); a carbamoyloxy group (preferably a substituted or unsubstituted carbamoyloxy group having 1 to 30 carbon atoms, such as N,N-dimethylcarbamoyloxy, N,N-diethylcarbamoyloxy, morpholinocarbonyloxy, N,N-di-n-octylaminocarbonyloxy or N-n-octylcarbamoyloxy); an alkoxycarbonyloxy group (preferably a substituted or unsubstituted alkoxycarbonyloxy group having 2 to 30 carbon atoms, such as methoxycarbonyloxy, ethoxycarbonyloxy, t-butoxycarbonyloxy or n-octylcarbonyloxy); an aryloxycarbonyloxy group (preferably a substituted or unsubstituted aryloxycarbonyloxy group having 7 to 30 carbon atoms, such as phenoxycarbonyloxy, p-methoxyphenoxycarbonyloxy or p-n-hexadecyloxyphenoxycarbonyloxy); an amino group (preferably an amino group, a substituted or unsubstituted alkylamino group having 1 to 30 carbon atoms or a substituted or unsubstituted anilino group having 6 to 30 carbon atoms, such as amino, methylamino, dimethylamino, anilino, N-methylanilino or diphenylamino); an acylamino group (preferably an formylamino group, a substituted or unsubstituted alkylcarbonylamino group having 1 to 30 carbon atoms or a substituted or unsubstituted arylcarbonylamino group having 6 to 30 carbon atoms, such as formylamino, acetylamino, pivaloylamino, lauroylamino, benzoylamino or 3,4,5-tri-n-octyloxyphenylcarbonylamino); an aminocarbonylamino group (preferably a substituted or unsubstituted aminocarbonylamino group having 1 to 30 carbon atoms, such as carbamoylamino, N,N-dimethylaminocarbonylamino, N,N-diethylaminocarbonylamino or morpholinocarbonylamino); an alkoxycarbonylamino group (preferably a substituted or unsubstituted alkoxycarbonylamino group having 2 to 30 carbon atoms, such as methoxycarbonylamino, ethoxycarbonylamino, t-butoxycarbonylamino, n-octadecyloxycarbonylamino or N-methylmethoxycarbonylamino); an aryloxycarbonylamino group (preferably a substituted or unsubstituted aryloxycarbonylamino group having 7 to 30 carbon atoms, such as phenoxycarbonylamino, p-chlorophenoxycarbonylamino or m-n-octyloxyphenoxycarbonylamino); a sulfamoylamino group (preferably a substituted or unsubstituted sulfamoylamino group having 0 to 30 carbon atoms, such as sulfamoylamino, N,N-dimethylaminosulfonylamino or N-n-octylaminosulfonylamino); an alkyl- or arylsulfonylamino group (preferably a substituted or unsubstituted alkylsulfonylamino group having 1 to 30 carbon atoms or a substituted or unsubstituted arylsulfonylamino group having 6 to 30 carbon atoms, such as methylsulfonylamino, butylsulfonylamino, phenylsulfonylamino, 2,3,5-trichlorophenylsulfonylamino or p-methylphenylsulfonylamino); a mercapto group; an alkylthio group (preferably a substituted or unsubstituted alkylthio group having 1 to 30 carbon atoms, such as methylthio, ethylthio or n-hexadecylthio); an arylthio group (preferably a substituted or unsubstituted arylthio group having 6 to 30 carbon atoms, such as phenylthio, p-chlorophenylthio or m-methoxyphenylthio); a heterocyclic thio group (preferably a substituted or unsubstituted heterocyclic thio group having 2 to 30 carbon atoms, such as 2-benzothiazolylthio or 1-phenyltetrazol-5-ylthio); a sulfamoyl group (preferably a substituted or unsubstituted sulfamoyl group having 0 to 30 carbon atoms, such as N-ethylsulfamoyl, N-(3-dodecyloxypropyl)sulfamoyl, N,N-dimethylsulfamoyl, N-acetylsulfamoyl, N-benzoylsulfamoyl or N-(N'-phenylcarbamoyl)sulfamoyl); a sulfo group; an alkyl- or arylsulfinyl group (preferably a substituted or unsubstituted alkylsulfinyl group having 1 to 30 carbon atoms or a substituted or unsubstituted arylsulfinyl group having 6 to 30 carbon atoms, such as methylsulfinyl, ethylsulfinyl, phenylsulfinyl or p-methylphenylsulfinyl); an alkyl- or arylsulfonyl group (preferably a substituted or unsubstituted alkylsulfonyl group having 1 to 30 carbon atoms or a substituted or unsubstituted arylsulfonyl group having 6 to 30 carbon atoms, such as methylsulfonyl, ethylsulfonyl, phenylsulfonyl or p-methylphenylsulfonyl); an acyl group (preferably a formyl group, a substituted or unsubstituted alkylcarbonyl group having 2 to 30 carbon atoms or a substituted or unsubstituted arylcarbonyl group having 7 to 30 carbon atoms, such as acetyl, pivaloyl, 2-chloroacetyl, stearoyl, benzoyl or p-n-octyloxyphenylcarbonyl); an aryloxycarbonyl group (preferably a substituted or unsubstituted aryloxycarbonyl group having 7 to 30 carbon atoms, such as phenoxycarbonyl, o-chlorophenoxycarbonyl, m-nitrophenoxycarbonyl or p-t-butylphenoxycarbonyl); an alkoxycarbonyl group (preferably a substituted or unsubstituted alkoxycarbonyl group having 2 to 30 carbon atoms, such as methoxycarbonyl, ethoxycarbonyl, t-butoxycarbonyl or n-octadecyloxycarbonyl); a carbamoyl group (preferably a substituted or unsubstituted carbamoyl group having 1 to 30 carbon atoms, such as carbamoyl, N-methylcarbamoyl, N,N-dimethylcarbamoyl, N,N-di-n-octylcarbamoyl or N-(methylsulfonyl)carbamoyl); an aryl- or heterocyclic azo group (preferably a substituted or unsubstituted arylazo group having 6 to 30 carbon atoms or a substituted or unsubstituted heterocyclic azo group having 3 to 30 carbon atoms, such as phenylazo, p-chlorophenylazo or 5-ethylthio-1,3,4-thiadiazol-2-ylazo); an imido group (preferably N-succinimido or N-phthalimido); a phosphino group (preferably a substituted or unsubstituted phosphino group having 2 to 30 carbon atoms, such as dimethylphosphino, diphenylphosphino or methylphenoxyphosphino); a phosphinyl group (preferably a substituted or unsubstituted phosphinyl group having 0 to 30 carbon atoms, such as phosphinyl, dioctyloxyphosphinyl or diethoxyphosphinyl); a phosphinyloxy group (preferably a substituted or unsubstituted phosphinyloxy group having 2 to 30 carbon atoms, such as diphenoxyphosphinyloxy or dioctyloxyphosphinyloxy); a phosphinylamino group (preferably a substituted or unsubstituted phosphinylamino group having 2 to 30 carbon atoms, such as dimethoxyphosphinylamino or dimethylaminophosphinylamino); or a silyl group (preferably a substituted or unsubstituted silyl group having 0 to 30 carbon atoms, such as trimethylsilyl, t-butyldimethylsilyl or phenyldimethylsilyl).

When the groups represented by $R_1$ to $R_4$ are further substitutable groups, the groups represented by $R_1$ to $R_4$ may further have substituents. Preferred substituents are the same as the substituents described with respect to $R_1$ to $R_4$. When the substitution is effected by two or more substituents, the substituents may be identical with or different from each other.

In the general formula (6), each of $R_5$ and $R_6$ independently represents an alkyl group, an aryl group, a heterocyclic group, an acyl group, an alkylsulfonyl group or an arylsulfonyl group. With respect to the preferred scope of the alkyl group, aryl group, heterocyclic group, acyl group, alkylsulfonyl group and arylsulfonyl group, these are the same as the alkyl group, aryl group, heterocyclic group, acyl group, alkylsulfonyl group and arylsulfonyl group described above in connection with the substituents represented by $R_1$ to $R_4$. When the groups represented by $R_5$ and $R_6$ are further substitutable groups, the groups represented by $R_5$ and $R_6$ may further have substituents. Preferred substituents are the same as the substituents described with respect to $R_1$ to $R_4$. When the substitution is effected by two or more substituents, the substituents may be identical with or different from each other.

$R_1$ and $R_2$, $R_3$ and $R_4$, $R_5$ and $R_6$, $R_2$ and $R_5$, and/or $R_4$ and $R_6$ may be bonded to each other to thereby form a 5-membered, 6-membered or 7-membered ring.

In the general formula (6), $R_7$ represents $R_{11}$-O—CO—, $R_{12}$-CO—CO—, $R_{13}$-NH—CO—, $R_{14}$-$SO_2$—, $R_{15}$-W—C($R_{16}$)($R_{17}$)- or $(M)_{1/n}OSO_2$—, wherein each of $R_{11}$, $R_{12}$, $R_{13}$ and $R_{14}$ independently represents an alkyl group, an aryl group or a heterocyclic group, $R_{15}$ represents a hydrogen atom or a block group, W represents an oxygen atom, a sulfur atom or >N-$R_{18}$, and each of $R_{16}$, $R_{17}$ and $R_{18}$ independently represents a hydrogen atom, an alkyl group or $(M)_{1/n}OSO_2$—. The alkyl group, aryl group and heterocyclic group represented by $R_{11}$, $R_{12}$, $R_{13}$ and $R_{14}$ are the same as the alkyl group, aryl group and heterocyclic group described above in connection with the substituents represented by $R_1$ to $R_4$. M represents a n-valence cation, such as, for example, $Na^+$ and $K^+$. n represents a natural number. When the groups represented by $R_{11}$, $R_{12}$, $R_{13}$ and $R_{14}$ are further substitutable groups, the groups represented by $R_{11}$, $R_{12}$, $R_{13}$ and $R_{14}$ may further have substituents. Preferred substituents are the same as the substituents described with respect to $R_1$ to $R_4$. When the substitution is effected by two or more substituents, the substituents may be identical with or different from each other. When $R_{16}$, $R_{17}$ and $R_{18}$ represent alkyl groups, these are the same as the alkyl group described above in connection with the substituents represented by $R_1$ to $R_4$. When $R_{15}$ represents a block group, it is the same as the block group represented by BLK described later.

The compounds of the general formula (6) will now be described with respect to the preferred scope thereof.

Each of $R_1$ to $R_4$ preferably represents a hydrogen atom, a halogen atom, an alkyl group, an aryl group, an acylamino group, an alkyl- or arylsulfonylamino group, an alkoxy group, an aryloxy group, an alkylthio group, an arylthio group, an acyl group, an alkoxycarbonyl group, an aryloxycarbonyl group, a carbamoyl group, a cyano group, a hydroxyl group, a carboxyl group, a sulfo group, a nitro group, a sulfamoyl group, an alkylsulfonyl group, an arylsulfonyl group or an acyloxy group. Each of $R_1$ to $R_4$ more preferably represents a hydrogen atom, a halogen atom, an alkyl group, an acylamino group, an alkyl- or arylsulfonylamino group, an alkoxy group, an alkylthio group, an arylthio group, an alkoxycarbonyl group, a carbamoyl group, a cyano group, a hydroxyl group, a carboxyl group, a sulfo group, a nitro group, a sulfamoyl group, an alkylsulfonyl group or an arylsulfonyl group. It is especially preferred that, among $R_1$ to $R_4$, either of $R_1$ or $R_3$ be a hydrogen atom.

Each of $R_5$ and $R_6$ preferably represents an alkyl group, an aryl group or a heterocyclic group, most preferably an alkyl group.

With respect to the compounds of the general formula (6), it is preferred that the formula weight of moiety excluding $R_7$ be 300 or more. Further, it is preferred that the oxidation potential in pH 10 water of p-phenylenediamine derivative, i.e., compound of the general formula (6) wherein $R_7$ is a hydrogen atom do not exceed 5 mV (vs. SCE).

$R_7$ preferably represents $R_{11}$-O—CO—, $R_{14}$-$SO_2$— or $R_{15}$-W—C($R_{16}$)($R_{17}$)-, most preferably $R_{11}$-O—CO—.

$R_{11}$ preferably represents an alkyl group, or a group containing a timing group capable of inducing a cleavage reaction with the use of electron transfer reaction as described in U.S. Pat. Nos. 4,409,323 and 4,421,845, or a group of the following formula (T-1) having a timing group whose terminal capable of inducing an electron transfer reaction is blocked.

Formula (T-1): BLK-W-(X=Y)j-C($R_{21}$)$R_{22}$-** wherein BLK represents a block group; ** represents a position for bonding with —O—CO—; W represents an oxygen atom, a sulfur atom or >N-$R_{23}$; each of X and Y represents a methine or a nitrogen atom; j is 0, 1 or 2; and each of $R_{21}$, $R_{22}$ and $R_{23}$ represents a hydrogen atom or any of the same groups as the substituents described with respect to $R_1$ to $R_4$. When X and Y represent substituted methines, the substituents and any two of the substituents of $R_{21}$, $R_{22}$ and $R_{23}$ may be connected to each other to thereby form a cyclic structure (e.g, a benzene ring or a pyrazole ring). It is also possible to avoid such a cyclic structure formation.

As the block group represented by BLK, there can be employed known block groups, which include block groups such as acyl and sulfonyl groups as described in, for example, JP-B-48-9968, JP-A's 52-8828 and 57-82834, U.S. Pat. No. 3,311,476 and JP-B-47-44805 (U.S. Pat. No. 3,615,617); block groups utilizing the reverse Michael reaction as described in, for example, JP-B-55-17369 (U.S. Pat. No. 3,888,677), JP-B-55-9696 (U.S. Pat. No. 3,791,830), JP-B-55-34927 (U.S. Pat. No. 4,009,029), JP-A-56-77842 (U.S. Pat. No. 4,307,175) and JP-A's 59-105640, 59-105641 and 59-105642; block groups utilizing the formation of a quinone methide or quinone methide homologue through intramolecular electron transfer as described in, for example, JP-B-54-39727, U.S. Pat. Nos. 3,674,478, 3,932,480 and 3,993,661, JP-A-57-135944, JP-A-57-135945 (U.S. Pat. No. 4,420,554), JP-A's 57-136640 and 61-196239, JP-A-61-196240 (U.S. Pat. No. 4,702,999), JP-A-61-185743, JP-A-61-124941 (U.S. Pat. No. 4,639,408) and JP-A-2-280140; block groups utilizing an intramolecular nucleophilic substitution reaction as described in, for example, U.S. Pat. Nos. 4,358,525 and 4,330,617, JP-A-55-53330 (U.S. Pat. No. 4,310,612), JP-A's 59-121328 and 59-218439 and JP-A-63-318555 (EP No. 0295729); block groups utilizing a cleavage reaction of 5- or 6-membered ring as described in, for example, JP-A-57-76541 (U.S. Pat. No. 4,335,200), JP-A-57-135949 (U.S. Pat. No. 4,350,752), JP-A's 57-179842, 59-137945, 59-140445, 59-219741 and 59-202459, JP-A-60-41034 (U.S. Pat. No. 4,618,563), JP-A-62-59945 (U.S. Pat. No.4,888,268), JP-A-62-65039 (U.S. Pat. No. 4,772,537), and JP-A's 62-80647, 3-236047 and 3-238445; block groups utilizing a reaction of addition of nucleophilic agent to conjugated unsaturated bond as described in, for example, JP-A's 59-201057 (U.S. Pat. No. 4,518,685), 61-43739 (U.S. Pat. No. 4,659,651), 61-95346 (U.S. Pat. No. 4,690,885), 61-95347 (U.S. Pat. No. 4,892,811), 64-7035, 4-42650 (U.S. Pat. No. 5,066,573), 1-245255, 2-207249, 2-235055 (U.S. Pat. No. 5,118,596) and 4-186344; block groups utilizing a β-leaving reaction as described in, for example, JP-A's 59-93442, 61-32839 and 62-163051 and JP-B-5-37299; block groups utilizing a nucleophilic substitution reaction of diarylmethane as described in JP-A-61-188540; block groups utilizing Lossen rearrangement reaction as described in JP-A-62-187850; block groups utilizing a reaction between an N-acyl derivative of thiazolidine-2-thione and an amine as described in, for example, JP-A's 62-80646, 62-144163 and 62-147457; block groups having two electrophilic groups and capable of reacting with a binucleophilic agent as described in, for example, JP-A's 2-296240 (U.S. Pat. No. 5,019,492), 4-177243, 4-177244, 4-177245, 4-177246, 4-177247, 4-177248, 4-177249, 4-179948, 4-184337 and 4-184338, PCT International Publication No. 92/21064, JP-A-4-330438, PCT International Publication No. 93/03419 and JP-A-5-45816; and block groups of JP-A's 3-236047 and 3-238445, all the contents of which disclosing the block groups are incorporated herein by reference. Of these block groups, block groups having two electrophilic groups and capable of reacting with a binucleophilic agent as described in, for example, JP-A's 2-296240 (U.S. Pat. No. 5,019,492), 4-177243, 4-177244, 4-177245, 4-177246, 4-177247, 4-177248, 4-177249, 4-179948, 4-184337 and 4-184338, PCT International Publication No. 92/21064, JP-A-4-330438, PCT International Publication No. 93/03419 and JP-A-5-45816 are especially preferred.

Particular examples of the timing group moieties, corresponding to the group of formula (T-1) from which BLK is removed, include the following. In the following, * represents a position for bonding with BLK, and ** represents a position for bonding with —O—CO—.

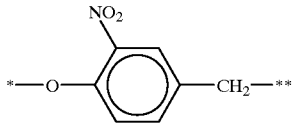

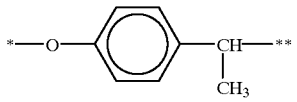

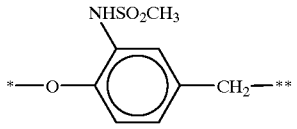

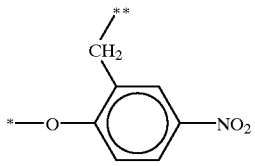

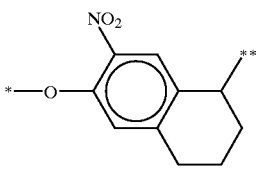

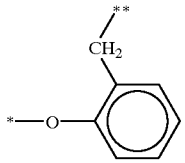

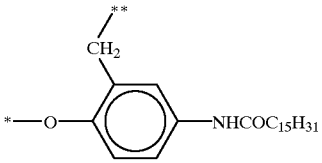

-continued

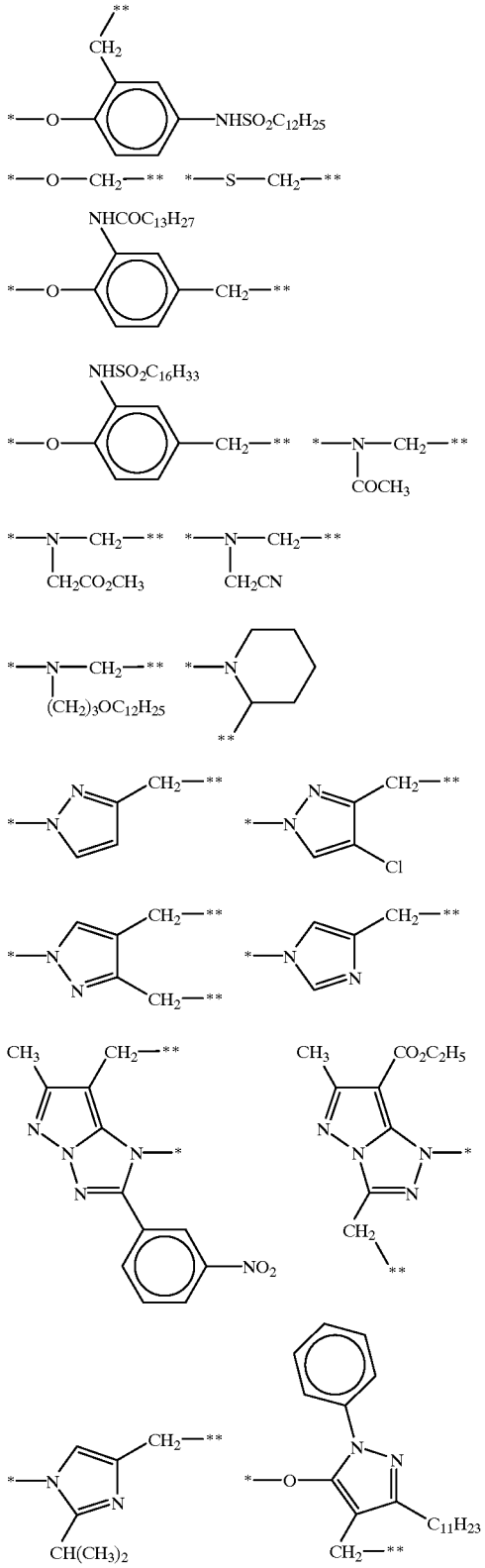

It is preferred that each of $R_{12}$ and $R_{13}$ be an alkyl or aryl group, and that $R_{14}$ be an aryl group. $R_{15}$ is preferably a block group, which is preferably the same as the preferred BLK contained in the group of the formula (T-1). Each of $R_{16}$, $R_{17}$ and $R_{18}$ preferably represents a hydrogen atom.

Particular examples of the compounds represented by the general formula (6) of the present invention will be set forth below, to which, however, the present invention is in no way limited.

DEVP-1

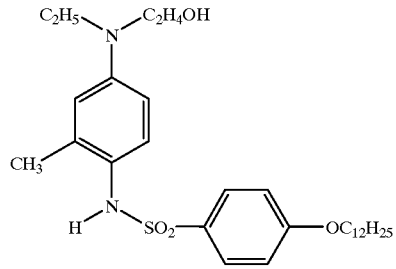

DEVP-2

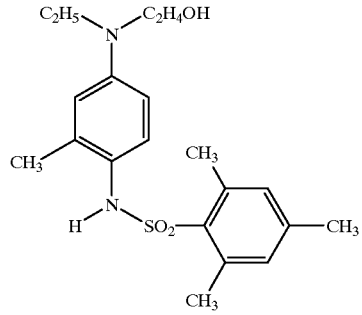

DEVP-3

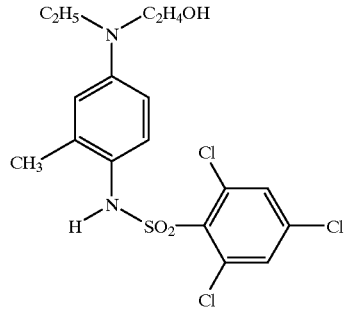

DEVP-4

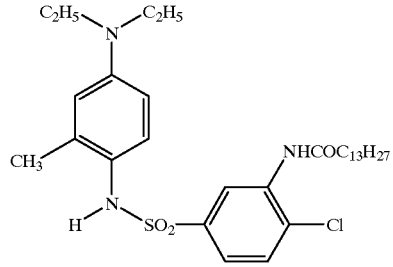

DEVP-5

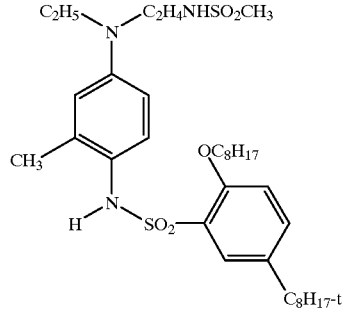

-continued
DEVP-6
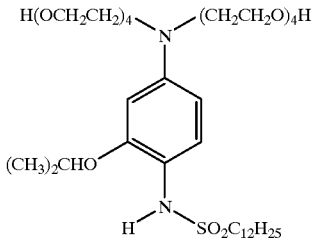
DEVP-7
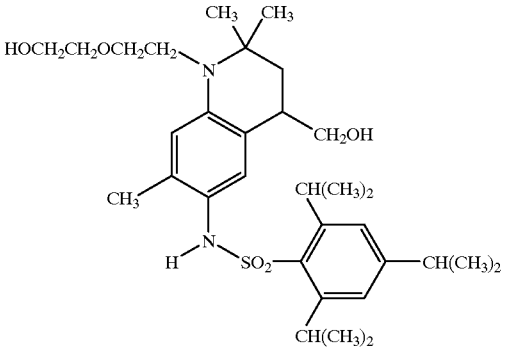
DEVP-8
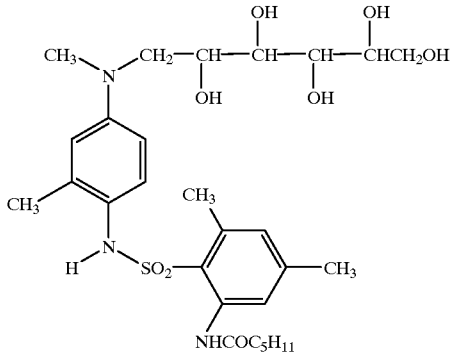
DEVP-9
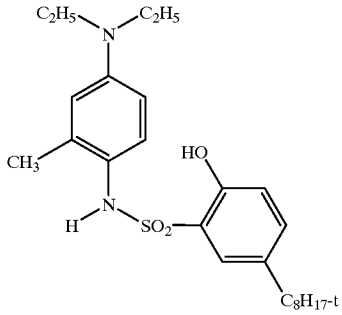
DEVP-10
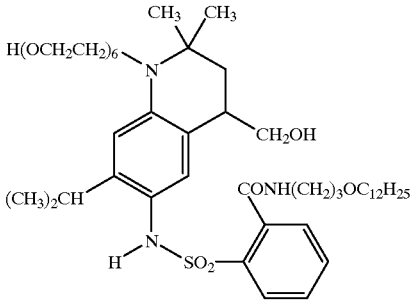
-continued
DEVP-11
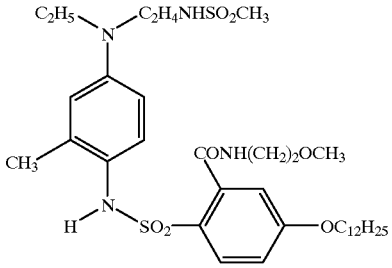
DEVP-12
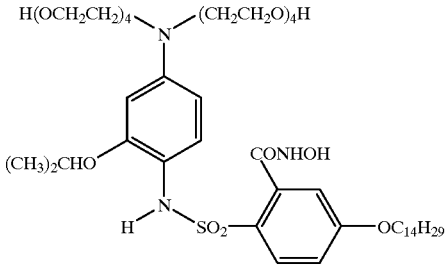
DEVP-13
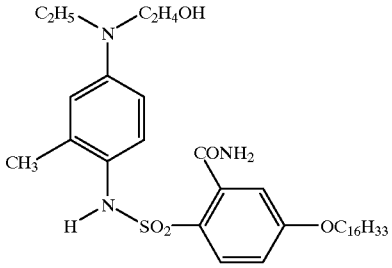
DEVP-14
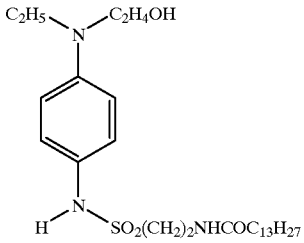
DEVP-15
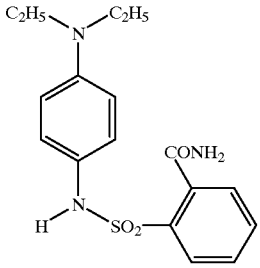

-continued
DEVP-16
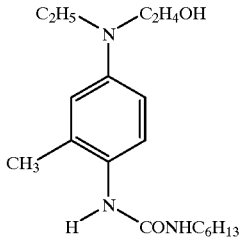
DEVP-17
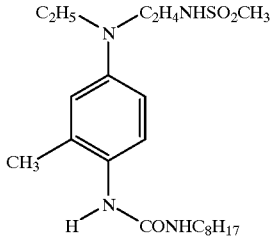
EVP-18
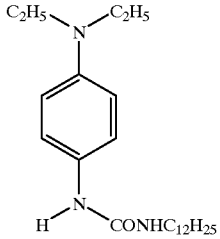
DEVP-19
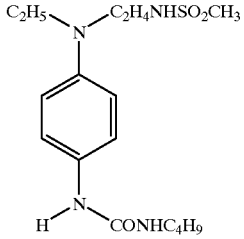
EVP-20
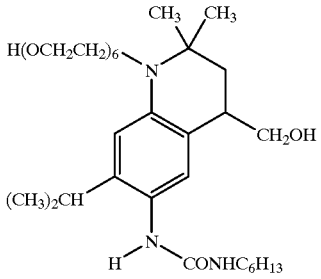
DEVP-21
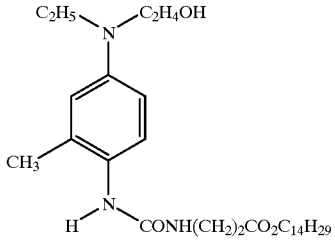
-continued
EVP-22
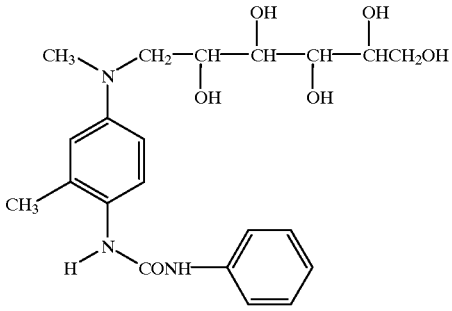
DEVP-23
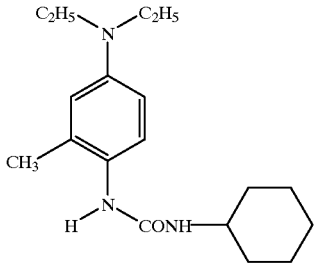
DEVP-24
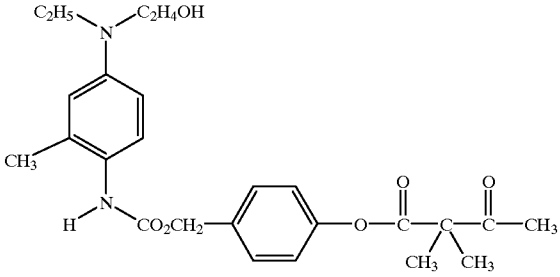
DEVP-25
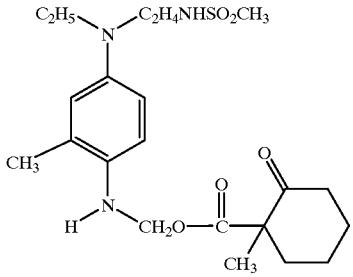
DEVP-26
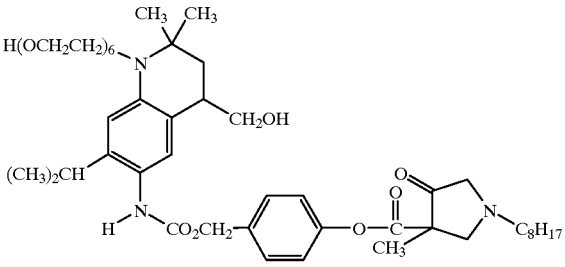

-continued
DEVP-27
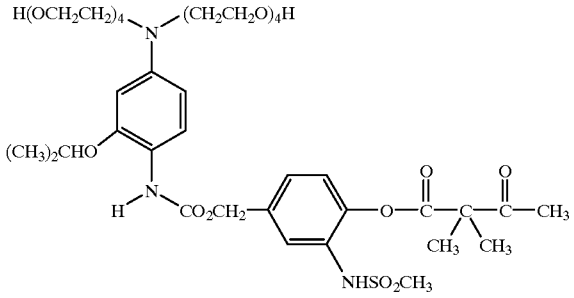
DEVP-28
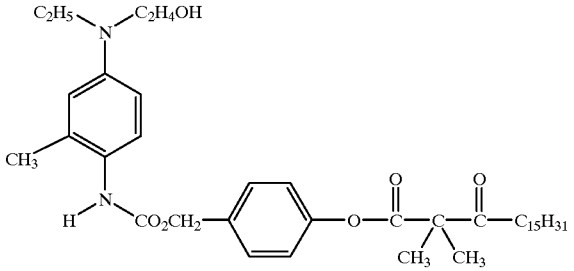
DEVP-29
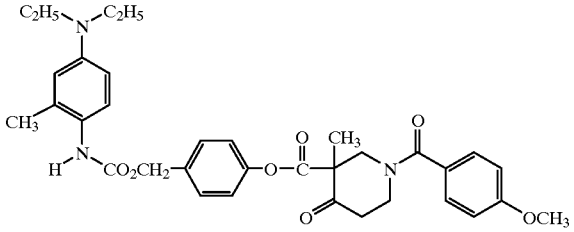
DEVP-30
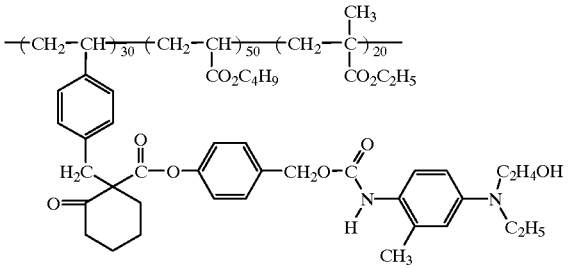
DEVP-31
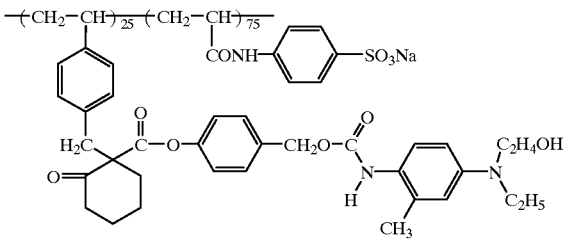
-continued
DEVP-32
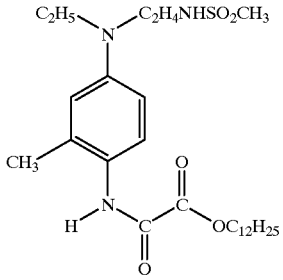
DEVP-33
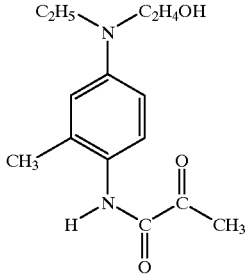
DEVP-34
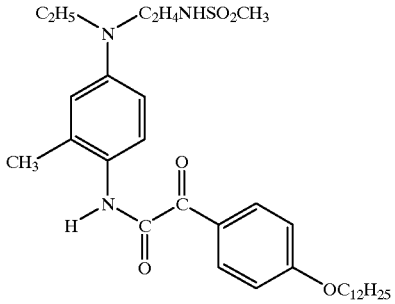
DEVP-35
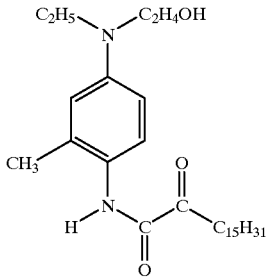
DEVP-36
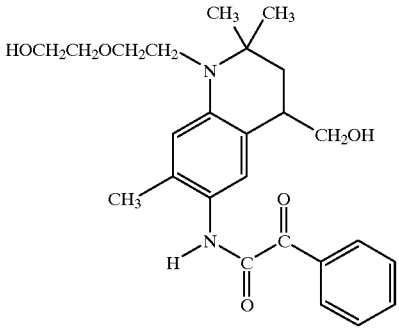

-continued
DEVP-37
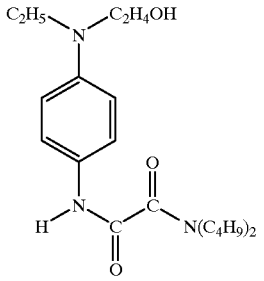
DEVP-38
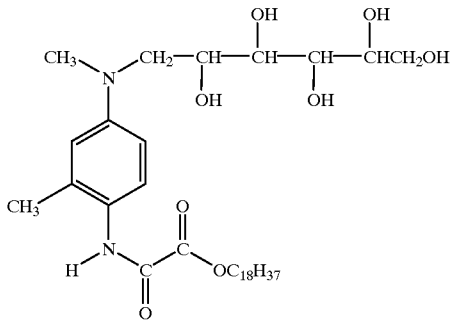
DEVP-39
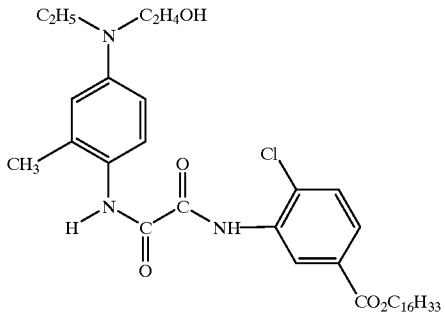
DEVP-40
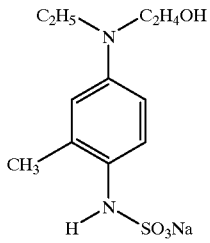
DEVP-41
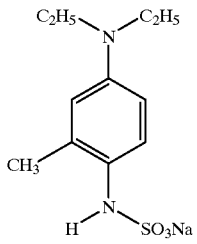
-continued
EVP-42
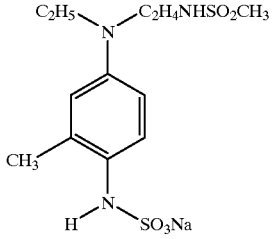
DEVP-43
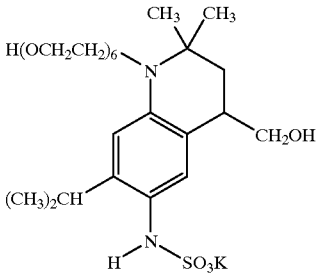
EVP-44
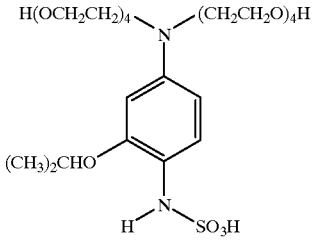
DEVP-45
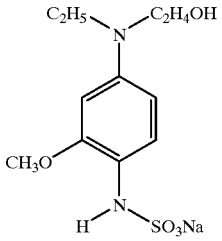
EVP-46
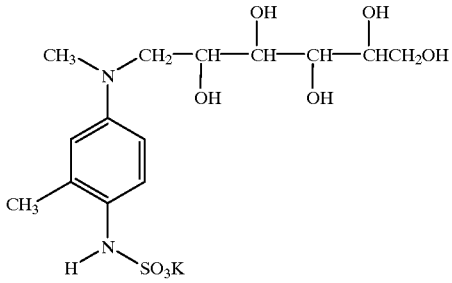
DEVP-47
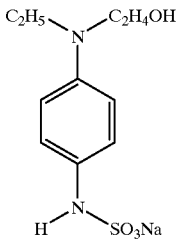

Compounds of U.S. Pat. Nos. 5,242,783 and 4,426,441 and JP-A's 62-227141, 5-257225, 5-249602, 6-43607 and 7-333780 are also preferably employed as the compound of the general formula (6) for use in the present invention.

Any of the compounds of the general formulae (1) to (6), although the addition amount thereof can be varied widely, is preferably used in a molar amount of 0.01 to 100 times, more preferably 0.1 to 10 times.

The compounds of the general formulae (1) to (6) can be added to a coating liquid in the form of any of, for example, a solution, powder, a solid fine grain dispersion, an emulsion and an oil protection dispersion. The solid particulate dispersion is obtained by the use of known atomizing means (for example, ball mill, vibration ball mill, sand mill, colloid mill, jet mill or roll mill). In the preparation of the solid particulate dispersion, use may be made of a dispersion auxiliary.

The above compounds are used individually or in combination as the developing agent or precursor thereof. A different developing agent may be used in each layer. The total use amount of developing agent is in the range of 0.05 to 20 mmol/$m^2$, preferably 0.1 to 10 mmol/$m^2$.

The coupler will now be described. The coupler used in the present invention refers to a compound capable of performing a coupling reaction with an oxidation product of developing agent described above to thereby form a dye.

The couplers preferably used in the present invention are compounds generally termed "active methylenes, 5-pyrazolones, pyrazoloazoles, phenols, naphthols or pyrrolotriazoles". Compounds cited in RD No. 38957 (September 1996), pages 616 to 624, "X. Dye image formers and modifiers", can preferably be used as the above couplers.

The above couplers can be classified into so-termed 2-equivalent couplers and 4-equivalent couplers.

As the group which acts as an anionic split-off group of 2-equivalent couplers, there can be mentioned, for example, a halogen atom (e.g., chloro or bromo), an alkoxy group (e.g., methoxy or ethoxy), an aryloxy group (e.g., phenoxy, 4-cyanophenoxy or 4-alkoxycarbonylphenyloxy), an alkylthio group (e.g., methylthio, ethylthio or butylthio), an arylthio group (e.g., phenylthio or tolylthio), an alkylcarbamoyl group (e.g., methylcarbamoyl, dimethylcarbamoyl, ethylcarbamoyl, diethylcarbamoyl, dibutylcarbamoyl), a heterocycliccarbamoyl (e.g., piperidylcarbamoyl or morpholinocarbamoyl), an arylcarbamoyl group (e.g., phenylcarbamoyl, methylphenylcarbamoyl, ethylphenylcarbamoyl or benzylphenylcarbamoyl), a carbamoyl group, an alkylsulfamoyl group (e.g., methylsulfamoyl, dimethylsulfamoyl, ethylsulfamoyl, diethylsulfamoyl, dibutylsulfamoyl, piperidylsulfamoyl or morpholinosulfamoyl), an arylsulfamoyl group (e.g., phenylsulfamoyl, methylphenylsulfamoyl, ethylphenylsulfamoyl or benzylphenylsulfamoyl), a sulfamoyl group, a cyano group, an alkylsulfonyl group (e.g., methanesulfonyl or ethanesulfonyl), an arylsulfonyl group (e.g., phenylsulfonyl, 4-chlorophenylsulfonyl or p-toluenesulfonyl), an alkylcarbonyloxy group (e.g., acetyloxy, propionyloxy or butyroyloxy), an arylcarbonyloxy group (e.g., benzoyloxy, toluyloxy or anisyloxy), and a nitrogen-containing heterocycle (e.g., imidazolyl or benzotriazolyl).

As the group which acts as a cationic split-off group of 4-equivalent couplers, there can be mentioned, for example, a hydrogen atom, a formyl group, a carbamoyl group, a substituted methylene group (the substituent is, for example, an aryl group, a sulfamoyl group, a carbamoyl group, an alkoxy group, an amino group or a hydroxyl group), an acyl group, and a sulfonyl group.

Besides the above compounds described in RD No. 38957, the following couplers can also preferably be employed.

As active methylene couplers, there can be employed couplers represented by the formulae (I) and (II) of EP No. 502,424A; couplers represented by the formulae (1) and (2) of EP No. 513,496A; couplers represented by the formula (I) of claim 1 of EP No. 568,037A; couplers represented by the general formula (I) of column 1, lines 45–55, of U.S. Pat. No. 5,066,576; couplers represented by the general formula (I) of paragraph 0008 of JP-A-4-274425; couplers recited in claim 1 of page 40 of EP No. 498,381A1; couplers represented by the formula (Y) of page 4 of EP No. 447,969A1; and couplers represented by the formulae (II) to (IV) of column 7, lines 36–58, of U.S. Pat. No. 4,476,219.

As 5-pyrazolone magenta couplers, there can preferably be employed compounds described in JP-A's 57-35858 and 51-20826.

As pyrazoloazole couplers, there can preferably be employed imidazo[1, 2-b]pyrazoles described in U.S. Pat. No. 4,500,630; pyrazolo[1, 5-b][1, 2, 4]triazoles described in U.S. Pat. No. 4,540,654; and pyrazolo[5, 1-c][1, 2, 4]triazoles described in U.S. Pat. No. 3,725,067. Of these, pyrazolo[1, 5-b][1, 2, 4]triazoles are most preferred from the viewpoint of light fastness.

Also, there can preferably be employed pyrazoloazole couplers comprising a pyrazolotriazole group having a branched alkyl group directly bonded to 2-, 3- or 6-position thereof as described in JP-A-61-65245; pyrazoloazole couplers having a sulfonamido group in molecules thereof as described in JP-A-61-65245; pyrazoloazole couplers having an alkoxyphenylsulfonamido balast group as described in JP-A-61-147254; pyrazolotriazole couplers having an alkoxy or aryloxy group at 6-position thereof as described in JP-A's 62-209457 and 63-307453; and pyrazolotriazole couplers having a carbonamido group in molecules thereof as described in JP-A-2-201443.

As preferred examples of phenol couplers, there can be mentioned, for example, 2-alkylamino-5-alkylphenol couplers described in U.S. Pat. Nos. 2,369,929, 2,801,171, 2,772,162, 2,895,826 and 3,772,002; 2,5-diacylaminophenol couplers described in U.S. Pat. Nos. 2,772,162, 3,758,308, 4,126,396, 4,334,011 and 4,327,173, DE No. 3,329,729 and JP-A-59-166956; and 2-phenylureido-5-acylaminophenol couplers described in U.S. Pat. Nos. 3,446,622, 4,333,999, 4,451,559 and 4,427,767.

As preferred examples of naphthol couplers, there can be mentioned, for example, 2-carbamoyl-1-naphthol couplers described in U.S. Pat. Nos. 2,474,293, 4,052,212, 4,146,396, 4,228,233 and 4,296,200; and 2-carbamoyl-5-amido-1-naphthol couplers described in U.S. Pat. No. 4,690,889.

As preferred examples of pyrrolotriazole couplers, there can be mentioned those described in EP Nos. 488,248A1, 491,197A1 and 545,300.

Moreover, use can be made of couplers with the condensed ring phenol, imidazole, pyrrole, 3-hydroxypyridine, active methine, 5,5-condensed heterocycle and 5,6-condensed heterocycle structures.

As condensed ring phenol couplers, there can be employed those described in, for example, U.S. Pat. Nos. 4,327,173, 4,564,586 and 4,904,575.

As imidazole couplers, there can be employed those described in, for example, U.S. Pat. Nos. 4,818,672 and 5,051,347.

As pyrrole couplers, there can be employed those described in, for example, JP-A's 4-188137 and 4-190347.

As 3-hydroxypyridine couplers, there can be employed those described in, for example, JP-A-1-315736.

As active methine couplers, there can be employed those described in, for example, U.S. Pat. Nos. 5,104,783 and 5,162,196.

As 5,5-condensed heterocycle couplers, there can be employed, for example, pyrrolopyrazole couplers described in U.S. Pat. No. 5,164,289 and pyrroloimidazole couplers described in JP-A-4-174429.

As 5,6-condensed heterocycle couplers, there can be employed, for example, pyrazolopyrimidine couplers described in U.S. Pat. No. 4,950,585, pyrrolotriazine couplers described in JP-A-4-204730 and couplers described in EP No. 556,700.

In the present invention, besides the above couplers, use can also be made of couplers described in, for example, DE Nos. 3,819,051A and 3,823,049, U.S. Pat. Nos. 4,840,883, 5,024,930, 5,051,347 and 4,481,268, EP Nos. 304,856A2, 329,036, 354,549A2, 374,781A2, 379,110A2 and 386, 930A1, JP-A's 63-141055, 64-32260, 64-32261, 2-297547, 2-44340, 2-110555, 3-7938, 3-160440, 3-172839, 4-172447, 4-179949, 4-182645, 4-184437, 4-188138, 4-188139, 4-194847, 4-204532, 4-204731 and 4-204732.

These couplers are used in an amount of 0.05 to 10 mmol/$m^2$, preferably 0.1 to 5 mmol/$m^2$, for each color.

Furthermore, the following functional couplers may be contained.

As couplers for forming a colored dye with appropriate diffusibility, there can preferably be employed those described in U.S. Pat. No. 4,366,237, GB No. 2,125,570, EP No. 96,873B and DE No. 3,234,533.

As couplers for correcting any unneeded absorption of a colored dye, there can be mentioned yellow colored cyan couplers represented by the formulae (CI), (CII), (CIII) and (CIV) (especially, YC-86 of page 84) of page 5 of EP No. 456,257A1; yellow colored magenta couplers ExM-7 (page 202), Ex-1 (page 249) and Ex-7 (page 251) described in the same EP; magenta colored cyan couplers CC-9 (column 8), CC-13 (column 10) described in U.S. Pat. No. 4,833,069; colorless masking couplers represented by the formula (2) (column 8) of U.S. Pat. No. 4,837,136 and represented by the formula (A) of claim 1 of WO 92/11575 (especially, compound examples of pages 36 to 45).

As compounds (including couplers) capable of reacting with a developing agent in an oxidized form to thereby release photographically useful compound residues, there can be mentioned the following:

Development inhibitor-releasing compounds: compounds represented by the formulae (I) to (IV) of page 11 of EP No. 378,236A1(especially, T-101 (page 30), T-104 (page 31), T-113 (page 36), T-131 (page 45), T-144 (page 51) and T-158 (page 58)), compounds represented by the formula (I) of page 7 of EP No. 436, 938A2 (especially, D-49 (page 51)), compounds represented by the formula (1) of EP No. 568,037A (especially, (23) (page 11)), and compounds represented by the formulae (I), (II) and (III) of pages 5–6 of EP No. 440,195A2 (especially, I-(1) (page 29));

Bleaching accelerator-releasing compounds: compounds represented by the formulae (I) and (I') of page 5 of EP No. 310,125A2 (especially, (60) and (61) of page 61) and compounds represented by the formula (I) of claim 1 of JP-A-6-59411 (especially, (7) of page 7);

Ligand-releasing compounds: compounds represented by LIG-X described in claim 1 of U.S. Pat. No. 4,555,478 (especially, the compound of column 12);

Leuco dye-releasing compounds: compounds 1 to 6 of columns 3 to 8 of U.S. Pat. No. 4,749,641;

Fluorescent dye-releasing compounds: compounds represented by COUP-DYE of claim 1 of U.S. Pat. No. 4,774,181 (especially, compounds 1 to 11 of columns 7 to 10);

Development accelerator or fogging agent-releasing compounds: compounds represented by the formulae (1), (2) and (3) of column 3 of U.S. Pat. No. 4,656,123 and ExZK-2 of page 75, lines 36 to 38, of EP No. 450, 637A2;

Compounds which release a group becoming a dye only after being split off: compounds represented by formula (I) of claim 1 of U.S. Pat. No. 4,857,447 (especially, Y-1 to Y-19 of columns 25 to 36).

As noncoupler additives, there can be preferably employed the following.

Dispersion mediums for oil-soluble organic compounds: P-3, 5, 16, 19, 25, 30, 42, 49, 54, 55, 66, 81, 85, 86 and 93 (pages 140–144) of JP-A-62-215272;

Latexes for impregnation of oil-soluble organic compounds: latexes described in U.S. Pat. No. 4,199,363;

Scavengers for developing agent oxidation product: compounds of the formula (I) of column 2, lines 54–62, of U.S. Pat. No. 4,978,606 (especially, I-(1), (2), (6) and (12) (columns 4–5)), and formula of column 2, lines 5–10, of U.S. Pat. No. 4,923,787 (especially, compound 1 (column 3));

Antistaining agents: formulae (I) to (III) of page 4, lines 30–33, of EP No. 298321A, especially I-47 and 72 and III-1 and 27 (pages 24–48);

Discoloration preventives: A-6, 7, 20, 21, 23, 24, 25, 26, 30, 37, 40, 42, 48, 63, 90, 92, 94 and 164 (pages 69–118) of EP No. 298321A, II-1 to III-23 of columns 25–38 of U.S. Pat. No. 5,122,444, especially III-10, I-1 to III-4 of pages 8–12 of EP No. 471347A, especially II-2, and A-1 to -48 of columns 32 to 40 of U.S. Pat. No. 5,139,931, especially A-39 and -42;

Materials for reducing the use amount of color enhancer and color mixing inhibitor: I-1 to II-15 of pages 5 to 24 of EP No. 41132A, especially I-46;

Formalin scavengers: SCV-1 to -28 of pages 24 to 29 of EP No. 477932A, especially SCV-8;

Film hardeners: H-1, 4, 6, 8 and 14 of page 17 of JP-A-1-214845, compounds (H-1 to -54) of formulae (VII) to (XII) of columns 13 to 23 of U.S. Pat. No. 4,618,573, compounds (H-1 to -76) of the formula (6) of page 8, right lower column, of JP-A-2-214852, especially H-14, and compounds of claim 1 of U.S. Pat. No. 3,325,287;

Development inhibitor precursors: P-24, 37 and 39 (pages 6–7) of JP-A-62-168139, and compounds of claim 1 of U.S. Pat. No. 5,019,492, especially 28 and 29 of column 7;

Antiseptics and mildewproofing agents: I-1 to III-43 of columns 3 to 15 of U.S. Pat. No. 4,923,790, especially II-1, 9, 10 and 18 and III-25;

Stabilizers and antifoggants: I-1 to (14) of columns 6 to 16 of U.S. Pat. No. 4,923,793, especially I-1, 60, (2) and (13), and compounds 1 to 65 of columns 25 to 32 of U.S. Pat. No. 4,952,483, especially 36;

Chemical sensitizers: triphenylphosphine selenides, and compound 50 of JP-A-5-40324;

Dyes: a-1 to b-20, especially a-1, 12, 18, 27, 35, 36 and b-5, of pages 15 to 18, and V-1 to 23, especially V-1, of pages 27 to 29 of JP-A-3-156450, F-I-1 to F-II-43, especially F-I-11 and F-II-8, of pages 33 to 55 of EP No. 445627A, III-1 to 36, especially III-1 and 3, of pages 17 to 28 of EP No. 457153A, microcrystalline dispersions of dye-1 to 124 of pages 8 to 26 of WO 88/04794, compounds 1 to 22, especially compound 1, of pages 6 to 11 of EP No. 319999A, compounds D-1 to 87 (pages 3 to 28) of formulae (1) to (3) of EP No. 519306A, compounds 1 to 22 (columns 3 to 10) of formula (I) of U.S. Pat. No. 4,268,622, and compounds 1 to 31 (columns 2 to 9) of formula (I) of U.S. Pat. No. 4,923,788; and UV absorbents: compounds (18b) to (18r) and 101 to 427 (pages 6 to 9) of formula (1) of JP-A-46-3335, compounds (3) to (66) of formula (I) (pages 10 to 44) and compounds HBT-1 to 10 of formula (III) (page 14) of EP No. 520938A, and compounds (1) to (31) of formula (1) (columns 2 to 9) of EP No. 521823A.

These functional couplers are preferably used in a molar amount of 0.05 to 10 times, more preferably 0.1 to 5 times, that of the aforementioned couplers which contribute to coloring.

Hydrophobic additives such as couplers and color developing agents can be introduced in layers of light-sensitive materials by known methods such as the method described in U.S. Pat. No. 2,322,027. In the introduction, use can be made of high-boiling organic solvents described in, for example, U.S. Pat. Nos. 4,555,470, 4,536,466, 4,536,467, 4,587,206, 4,555,476 and 4,599,296 and JP-B-3-62256, optionally in combination with low-boiling organic solvents having a boiling point of 50 to 160° C. With respect to dye donating couplers, high-boiling organic solvents, etc., a plurality thereof can be used in combination.

The amount of high-boiling organic solvents is 10 g or less, preferably 5 g or less, and more preferably in the range of 1 to 0.1 g, perg of introduced hydrophobic additive. The amount of high-boiling organic solvents is appropriately 1 mL or less, more appropriately 0.5 mL or less, and most appropriately 0.3 mL or less, perg of binder.

Also, use can be made of the method of effecting a dispersion by polymer as described in JP-B-51-39853 and JP-A-51-59943, and the method of adding in the form of a particulate dispersion as described in, for example, JP-A-62-30242.

With respect to compounds which are substantially insoluble in water, besides the above methods, the compounds can be atomized and dispersed in binders.

When hydrophobic compounds are dispersed in hydrophilic colloids, various surfactants can be employed. For example, use can be made of those described as surfactants in JP-A-59-157636, pages 37 and 38, and the above cited RDs. Further, use can be made of phosphoric ester surfactants described in Japanese Patent Application Nos. 5-204325 and 6-19247 and DE No. 1,932,299A.

Various antifoggants and photographic stabilizers can be used in the light-sensitive material of the present invention. Examples thereof include azoles and azaindenes described in RD No. 17643 (1978) pages 24–25, nitrogenous carboxylic acids and phosphoric acids described in JP-A-59-168442, mercapto compounds and metal salts thereof described in JP-A-59-111636 and acetylene compounds described in JP-A-62-87957.

When a nondiffusing reducing agent or color developing agent is used in the light-sensitive material of the present invention, according to necessity, an electron transferring agent and/or electron transferring agent precursor can be used in combination therewith in order to promote the electron transport between the nondiffusing reducing agent or color developing agent and developable silver halides. It is preferred that the transferrability of the electron transferring agent or precursor thereof be greater than that of the nondiffusing reducing agent (electron donor). Especially useful electron transferring agents are 1-phenyl-3-pyrazolidones or aminophenols.

In the light-sensitive material of the present invention, it is only required that at least one silver halide emulsion layer be formed on a support. A typical example is a silver halide photographic light-sensitive material having, on its support, at least one light-sensitive layer constituted by a plurality of silver halide emulsion layers which are sensitive to essentially the same color but have different sensitivities. This light-sensitive layer includes a unit light-sensitive layer which is sensitive to one of blue light, green light and red light. In a multilayered silver halide color photographic light-sensitive material, these unit light-sensitive layers are generally arranged in the order of red-, green- and blue-sensitive layers from a support. However, according to the intended use, this arrangement order may be reversed, or light-sensitive layers sensitive to the same color can sandwich another light-sensitive layer sensitive to a different color. Various non light-sensitive layers such as an intermediate layer can be formed between the silver halide light-sensitive layers and as the uppermost layer and the lowermost layer. These intermediate layers may contain, e.g., couplers described above, developing agents, DIR compounds, color-mixing inhibitors and dyes. As for a plurality of silver halide emulsion layers constituting respective unit light-sensitive layer, a two-layered structure of high- and low-speed emulsion layers can be preferably used in this order so as to the speed becomes lower toward the support as described in DE (German Patent) 1,121,470 or GB 923,045. Also, as described in JP-A's-57-112751, 62-200350, 62-206541 and 62-206543, layers can be arranged such that a low-speed emulsion layer is formed farther from a support and a high-speed layer is formed closer to the support.

More specifically, layers can be arranged from the farthest side from a support in the order of low-speed blue-sensitive layer (BL)/high-speed blue-sensitive layer (BH)/high-speed green-sensitive layer (GH)/low-speed green-sensitive layer (GL)/high-speed red-sensitive layer (RH)/low-speed red-sensitive layer (RL), the order of BH/BL/GL/GH/RH/RL or the order of BH/BL/GH/GL/RL/RH.

In addition, as described in JP-B-55-34932 layers can be arranged from the farthest side from a support in the order of blue-sensitive layer/GH/RH/GL/RL. Furthermore, as described in JP-A's-56-25738 and 62-63936 layers can be arranged from the farthest side from a support in the order of blue-sensitive layer/GL/RL/GH/RH.

As described in JP-B-49-15495 three layers can be arranged such that a silver halide emulsion layer having the highest sensitivity is arranged as an upper layer, a silver halide emulsion layer having sensitivity lower than that of the upper layer is arranged as an interlayer, and a silver halide emulsion layer having sensitivity lower than that of the interlayer is arranged as a lower layer; i.e., three layers having different sensitivities can be arranged such that the sensitivity is sequentially decreased toward the support. Even when a layer structure is constituted by three layers having different sensitivities, these layers can be arranged in the order of medium-speed emulsion layer/high-speed emulsion layer/low-speed emulsion layer from the farthest side from a support in a layer sensitive to one color as described in JP-A-59-202 464.

In addition, the order of high-speed emulsion layer/low-speed emulsion layer/medium-speed emulsion layer or low-speed emulsion layer/medium-speed emulsion layer/high-speed emulsion layer can be adopted. Furthermore, the arrangement can be changed as described above even when four or more layers are formed.

In order to improve color reproduction, an inter layer effect-donating layer (CL), whose spectral sensitivity distribution is different from those of the main light-sensitive layers of BL, GL and RL, can be arranged adjacent to the main light-sensitive layer or near the main light-sensitive layer, as described in U.S. Pat. Nos. 4,663,271, 4,705,744 and 4,707,436, and JP-A's-62-160448 and 63-89850.

As apparent from the above, various layer constitutions and arrangements can be selected in conformity with the intended use of each light-sensitive material.

In the present invention, the silver halide emulsion, the dye forming coupler and the color developing agent, although may be contained in a single layer, can be divided and incorporated in separate layers as long as a reaction can be effected therebetween. For example, when the layer containing a color developing agent is separate from the layer containing a silver halide emulsion, the raw shelf life of the light-sensitive material can be prolonged.

Although the relationship between the spectral sensitivity and coupler hue of each layer is arbitrary, the use of cyan coupler in a red-sensitive layer, magenta coupler in a green-sensitive layer and yellow coupler in a blue-sensitive layer enables direct projection exposure on conventional color paper or the like.

In the light-sensitive material, various nonlight-sensitive layers such as a protective layer, a substratum, an interlayer, a yellow filter layer and an antihalation layer may be provided between aforementioned silver halide emulsion layers, or as an uppermost layer or a lowermost layer. The opposite side of the support can be furnished with various auxiliary layers such as a back layer.

For example, the light-sensitive material can be provided with a layer arrangement as described in the above patents; a substratum as described in U.S. Pat. No. 5,051,335; an interlayer containing a solid pigment as described in JP-A's 1-167838 and 61-20943; an interlayer containing a reducing agent and a DIR compound as described in JP-A's 1-120553, 5-34884 and 2-64634; an interlayer containing an electron transferring agent as described in U.S. Pat. Nos. 5,017,454 and 5,139,919 and JP-A-2-235044; a protective layer containing a reducing agent as described in JP-A-4-249245; or a combination of these layers.

The dye which can be used in a yellow filter layer and an antihalation layer is preferably one decolorized or removed at the time of development and hence not contributing to density after processing.

The expression "dye of a yellow filter layer and an antihalation layer is decolorized or removed at the time of development" used herein means that the amount of dye remaining after processing is reduced to ⅓ or less, preferably 1/10 or less, of that just before coating. Dye components may be transferred from the light-sensitive material to the processing material at the time of development. Alternatively, at the time of development, the dye may react so as to convert itself to a colorless compound.

For example, there can be mentioned dyes described in EP No. 549,489A and ExF2 to 6 dyes described in JP-A-7-152129. Also, use can ba made of solid-dispersed dyes as described in JP-A-8-101487.

The dye can be mordanted in advance with the use of a mordanting agent and a binder. As the mordanting agent and dye, there can be employed those known in the art of photography. For example, use can be made of mordanting agents described in U.S. Pat. No. 4,500,626 columns 58-59, JP-A-61-88256 pages 32–41, and JP-A's 62-244043 and 62-244036.

Further, use can be made of a compound capable of reacting with a reducing agent to thereby release a diffusive dye together with a reducing agent, so that a mobile dye can be released by an alkali at the time of development, transferred to the processing material and removed. Relevant descriptions are found in U.S. Pat. Nos. 4,559,290 and 4,783,396, EP No. 220,746A2 and JIII Journal of Technical Disclosure No. 87-6119.

A decolorizable leuco dye or the like can also be employed. For example, JP-A-1-150132 discloses a silver halide light-sensitive material containing a leuco dye which has been colored in advance by the use of a developer of a metal salt of organic acid. The complex of leuco dye and developer is decolorized by heating or reaction with an alkali agent.

Known leuco dyes can be used, which are described in, for example, Moriga and Yoshida, "Senryo to Yakuhin (Dyestuff and Chemical)" 9, page 84 (Kaseihin Kogyo Kyokai (Japan Dyestuff & Chemical Industry Association)); "Shinpan Senryo Binran (New Edition Dyestuff Manual)", page 242 (Maruzen Co., Ltd., 1970); R. Garner "Reports on the Progress of Appl. Chem." 56, page 199 (1971); "Senryo to Yakuhin (Dyestuff and Chemical)" 19, page 230 (Kaseihin Kogyo Kyokai (Japan Dyestuff & Chemical Industry Association), 1974); "Shikizai (Color Material)" 62, 288 (1989); and "Senshoku Kogyo (Dyeing Industry)" 32, 208.

As the developer, there can preferably be employed acid clay developers, phenol formaldehyde resin and metal salts of organic acid. Examples of suitable metal salts of organic acid include metal salts of salicylic acids, metal salts of phenol-salicylic acid-formaldehyde resins, and metal salts of rhodanate and xanthate. Zinc is especially preferably used as the metal. With respect to oil-soluble zinc salicylate among the above developers, use can be made of those described in, for example, U.S. Pat. Nos. 3,864,146 and 4,046,941 and JP-B-52-1327.

The coating layers of the light-sensitive material of the present invention are preferably hardened by film hardeners.

Examples of film hardeners include those described in, for example, U.S. Pat. Nos. 4,678,739 column 41 and 4,791,042, and JP-A's 59-116655, 62-245261, 61-18942 and 4-218044. More specifically, use can be made of aldehyde film hardeners (e.g., formaldehyde), aziridine film hardeners, epoxy film hardeners, vinylsulfone film hardeners (e.g., N,N'-ethylene-bis(vinylsulfonylacetamido)ethane), N-methylol film hardeners (e.g., dimethylolurea), and boric acid, metaboric acid or polymer film hardeners (compounds described in, for example, JP-A-62-234157).

These film hardeners are used in an amount of 0.001 to 1 g, preferably 0.005 to 0.5 g, perg of hydrophilic binder.

In the light-sensitive material, use can be made of various antifoggants, photographic stabilizers and precursors thereof. Examples thereof include compounds described in, for example, the aforementioned RDs, U.S. Pat. Nos. 5,089,378, 4,500,627 and 4,614,702, JP-A-64-13564 pages 7–9, 57–71 and 81–97, U.S. Pat. Nos. 4,775,610, 4,626,500 and 4,983,494, JP-A's 62-174747, 62-239148, 1-150135, 2-110557 and 2-178650, and RD No. 17643 (1978) pages 24–25.

These compounds are preferably used in an amount of $5\times10^{-6}$ to $1\times10^{-1}$ mol, more preferably $1\times10^{-5}$ to $1\times10^{-2}$ mol, per mol of silver.

In the light-sensitive material, various surfactants can be used for the purpose of coating aid, frilling amelioration, sliding improvement, static electricity prevention, development acceleration, etc. Examples of surfactants are described in, for example, Public Technology No. 5 (Mar. 22, 1991, issued by Aztek) pages 136–138 and JP-A's 62-173463 and 62-183457.

An organic fluorocompound may be incorporated in the light-sensitive material for the purpose of sliding prevention, static electricity prevention, frilling amelioration, etc. As representative examples of organic fluorocompounds, there can be mentioned fluorinated surfactants described in, for example, JP-B-57-9053 columns 8 to 17 and JP-A's 61-20944 and 62-135826, and hydrophobic fluorocompounds including an oily fluorocompound such as fluoroil and a solid fluorocompound resin such as ethylene tetrafluoride resin. Fluorinated surfactants having a hydrophilic group can also preferably be employed for the purpose of reconciling the wettability and static electricity prevention of light-sensitive material.

It is preferred that the light-sensitive material have sliding properties. A layer containing a sliding agent is preferably provided on both the light-sensitive layer side and the back side. Preferred sliding properties range from 0.25 to 0.01 in terms of kinematic friction coefficient.

By the measurement, there can be obtained the value at 60 cm/min carriage on a stainless steel ball of 5 mm diameter (25° C., 60% RH). Even if the evaluation is made with the opposite material replaced by a light-sensitive layer surface, the value of substantially the same level can be obtained.

Examples of suitable sliding agents include polyorganosiloxanes, higher fatty acid amides, higher fatty acid metal salts and esters of higher fatty acids and higher alcohols. As the polyorganosiloxanes, there can be employed, for example, polydimethylsiloxane, polydiethylsiloxane, polystyrylmethylsiloxane and polymethylphenylsiloxane. The layer to be loaded with the sliding agent is preferably an outermost one of emulsion layers or a back layer. Polydimethylsiloxane and an ester having a long-chain alkyl group are especially preferred. For preventing silver halide pressure marks and desensitization, silicone oil and chlorinated paraffin are preferably used.

In the present invention, further, an antistatic agent is preferably used. As the antistatic agent, there can be mentioned a polymer containing a carboxylic acid and a carboxylic acid salt or sulfonic acid salt, a cationic polymer and an ionic surfactant compound.

Most preferable antistatic agent consists of fine particles of a crystalline metal oxide of $10^7$ Ω·cm or less, preferably $10^5$ Ω·cm or less, volume resistivity with a particle size of 0.001 to 1.0 μm, constituted of at least one member selected from among ZnO, $TiO_2$, $SnO_2$, $Al_2O_3$, $In_2O_3$, $SiO_2$, MgO, BaO, $MoO_3$ and $V_2O_5$, or a composite oxide thereof (e.g., Sb, P, B, In, S, Si or C), or fine particles of such a metal oxide or composite oxide thereof in sol form. The content of antistatic agent in the light-sensitive material is preferably in the range of 5 to 500 mg/m$^2$, more preferably 10 to 350 mg/m$^2$. The quantitative ratio of conductive crystalline oxide or composite oxide thereof to binder is preferably in the range of 1/300 to 100/1, more preferably 1/100 to 100/5. The back of the support of the light-sensitive material is preferably coated with a water resistant polymer described in JP-A-8-292514.

The light-sensitive material or later described processing material constitution (including back layer) can be loaded with various polymer latexes for the purpose of film property improvements, such as dimension stabilization, curling prevention, sticking prevention, film cracking prevention and pressure increase desensitization prevention. For example, use can be made of any of polymer latexes described in JP-A's 62-245258, 62-136648 and 62-110066. In particular, when a polymer latex of low glass transition temperature (40° C. or below) is used in a mordant layer, the cracking of the mordant layer can be prevented. Further, when a polymer latex of high glass transition temperature is used in a back layer, a curling preventive effect can be exerted.

In the light-sensitive material of the present invention, a matting agent is preferably contained. The matting agent, although can be contained in the emulsion side or the back side, is most preferably incorporated in an outermost layer of the emulsion side. The matting agent may be soluble, or insoluble, in processing solutions. It is preferred that soluble and insoluble matting agents be used in combination. For example, polymethyl methacrylate, polymethyl methacrylate/methacrylic acid (9/1 or 5/5 in molar ratio) and polystyrene particles are preferred. The particle diameter is preferably in the range of 0.8 to 10 μm, and a narrow particle diameter distribution is preferred. It is preferred that 90% or more of all the particles have diameters which fall within 0.9 to 1.1 times the average particle diameter. For enhancing matting properties, it is also preferred to simultaneously add fine particles of up to 0.8 μm. As such fine particles, there can be mentioned, for example, polymethyl methacrylate (0.2 μm), polymethyl methacrylate/methacrylic acid (9/1 in molar ratio, 0.3 μm), polystyrene particles (0.25 μm) and colloidal silica (0.03 μm)

Specific examples are described in JP-A-61-88256, page 29. In addition, use can be made of compounds described in JP-A's 63-274944 and 63-274952, such as benzoguanamine resin beads, polycarbonate resin beads and AS resin beads. Also, use can be made of compounds described in the aforementioned RDs.

These matting agents, according to necessity, can be dispersed in various binders, as described in the above paragraphs relating to binder, and applied in the form of a dispersion. In particular, the dispersion in various gelatins, for example, acid-processed gelatin, enables easily preparing stable coating liquids. In the preparation, according to necessity, it is preferred to optimize the pH, ionic strength and binder concentration.

In the present invention, as the support of the light-sensitive material, there can be employed a transparent one capable of resisting processing temperatures. Generally, use can be made of photographic supports of paper, synthetic polymers (films), etc. as described in pages 223 to 240 of "Shashinkogaku no Kiso —Gin-en Shashin Hen— (Fundamental of Photographic Technology—Silver Salt Photography—)" edited by The Society of Photographic Science and Technology of Japan and published by CMC Co., Ltd. (1979). For example, use can be made of supports of polyethylene terephthalate, polyethylene naphthalate, polycarbonate, polyvinyl chloride, polystyrene, polypropylene, polyimide and cellulose (e.g., triacetylcellulose).

Also, use can be made of supports described in, for example, JP-A's 62-253159 pages 29 to 31, 1-161236 pages 14 to 17, 63-316848, 2-22651 and 3-56955 and U.S. Pat. No. 5,001,033. In order to improve optical properties and physical properties, these supports can be subjected to, for example, heat treatment (crystallization degree and orientation control), monoaxial or biaxial drawing (orientation control), blending of various polymers and surface treatment.

When requirements on heat resistance and curling properties are especially strict, supports described in JP-A's 6-41281, 6-43581, 6-51426, 6-51437 and 6-51442 can preferably be employed as the support of the light-sensitive material.

Moreover, a support of a styrene polymer of mainly syndiotactic structure can preferably be employed. The thickness of the supports is preferably in the range of 5 to 200 μm, more preferably 40 to 120 μm.

The polyester support preferably used in the present invention will be described below. Particulars thereof together with the below mentioned light-sensitive material, processing, cartridge and working examples are specified in JIII Journal of Technical Disclosure No. 94-6023 (issued by Japan Institute of Invention and Innovation on Mar. 15, 1994). The polyester for use in the present invention is prepared from a diol and an aromatic dicarboxylic acid as essential components. Examples of suitable aromatic dicarboxylic acids include 2,6-, 1,5-, 1,4- and 2,7-naphthalenedicarboxylic acids, terephthalic acid, isophthalic acid and phthalic acid, and examples of suitable diols include diethylene glycol, triethylene glycol, cyclohexanedimethanol, bisphenol A and other bisphenols. The resultant polymers include homopolymers such as polyethylene terephthalate, polyethylene naphthalate and polycyclohexanedimethanol terephthalate. Polyesters containing 2,6-naphthalenedicarboxylic acid in an amount of 50 to 100 mol. % are especially preferred. Polyethylene 2,6-naphthalate is most preferred. The average molecular weight thereof ranges from approximately 5,000 to 200,000. The Tg of the polyester for use in the present invention is at least 50° C., preferably at least 90° C.

The polyester support is subjected to heat treatment at a temperature of from 40° C. to less than Tg, preferably from Tg minus 20° C. to less than Tg, in order to suppress curling. This heat treatment may be conducted at a temperature held constant within the above temperature range or may be conducted while cooling. The period of heat treatment ranges from 0.1 to 1500 hr, preferably 0.5 to 200 hr. The support may be heat treated either in the form of a roll or while being carried in the form of a web. The surface form of the support may be improved by rendering the surface irregular (e.g., coating with conductive inorganic fine grains of $SnO_2$, $Sb_2O_5$, etc.). Moreover, a scheme is desired such that edges of the support are knurled so as to render only the edges slightly high, thereby preventing photographing of core sections. The above heat treatment may be carried out in any of stages after support film formation, after surface treatment, after back layer application (e.g., application of an antistatic agent or a lubricant) and after undercoating application. The heat treatment is preferably performed after antistatic agent application.

An ultraviolet absorber may be milled into the polyester. Light piping can be prevented by milling, into the polyester, dyes and pigments commercially available as polyester additives, such as Diaresin produced by Mitsubishi Chemical Industries, Ltd. and Kayaset produced by NIPPON KAYAKU CO., LTD.

Surface treatment is preferably performed for adhering the support and the light-sensitive material constituting layers to each other. Examples thereof include chemical, mechanical, corona discharge, flaming, ultraviolet irradiation, high-frequency, glow discharge, active plasma, laser, mixed acid, ozonization and other surface activating treatments. Of these surface treatments, ultraviolet irradiation, flaming, corona discharge and glow discharge treatments are preferred.

Now, the substratum will be described below:

The substratum may be composed of a single layer or two or more layers. As the binder for the substratum, there can be mentioned not only copolymers prepared from monomers, as starting materials, selected from among vinyl chloride, vinylidene chloride, butadiene, methacrylic acid, acrylic acid, itaconic acid and maleic anhydride but also polyethyleneimine, an epoxy resin, a grafted gelatin, nitrocellulose, gelatin, polyvinyl alcohol and modified polymere of these polymers. Resorcin or p-chlorophenol is used as a support-swelling compound. A gelatin hardener such as a chromium salt (e.g., chrome alum), an aldehyde (e.g., formaldehyde or glutaraldehyde), an isocyanate, an active halogen compound (e.g., 2,4-dichloro-6-hydroxy-s-triazine), an epichlorohydrin resin or an active vinyl sulfone compound can be used in the substratum. Also, SiO2, $TiO_2$, inorganic fine grains or polymethyl methacrylate copolymer fine grains (0.01 to 10 μm) may be incorporated therein as a matting agent.

Further, it is preferable to record photographed information and etc. using, as a support, the support having a magnetic recording layer as described in JP-A's 4-124645, 5-40321, 6-35092 and 6-317875.

The magnetic recording layer herein is the one obtained by coating a support with a water-base or organic solvent coating liquid having magnetic material grains dispersed in a binder.

The magnetic material grains can be composed of any of ferromagnetic iron oxides such as γ $Fe_2O_3$, Co coated γ $Fe_2O_3$, Co coated magnetite, Co containing magnetite, ferromagnetic chromium dioxide, ferromagnetic metals, ferromagnetic alloys, Ba ferrite of hexagonal system, Sr ferrite, Pb ferrite and Ca ferrite. Of these, Co coated ferromagnetic iron oxides such as Co coated γ $Fe_2O_3$ are preferred. The configuration thereof may be any of acicular, rice grain, spherical, cubic and plate shapes. The specific surface area is preferably at least 20 $m^2/g$, more preferably at least 30 $m^2/g$ in terms of SBET. The saturation magnetization ($\sigma_s$) of the ferromagnetic material preferably ranges from $3.0\times10^4$to $3.0\times10^5$ A/m, more preferably from $4.0\times10^4$ to $2.5\times10^5$ A/m. The ferromagnetic material grains may have their surface treated with silica and/or alumina or an organic material. Further, the magnetic material grains may have their surface treated with a silane coupling agent or a titanium coupling agent as described in JP-A-6-161032. Still further, use can be made of magnetic material grains having their surface coated with an organic or inorganic material as described in JP-A-4-259911 and JP-A-5-81652.

The binder for use in the magnetic material grains can be composed of any natural polymer (e.g., cellulose derivatives and sugar derivatives), acid-, alkali- or bio-degradable polymers, reactive resins, radiation curable resins, thermosetting resins and thermoplastic resins listed in JP-A-4-219569 and mixtures thereof. The Tg of each of the above resins ranges from −40 to 300° C. and the weight average molecular weight thereof ranges from 2 thousand to 1 million.

For example, vinyl copolymers, cellulose derivatives such as cellulose diacetate, cellulose triacetate, cellulose acetate propionate, cellulose acetate butyrate and cellulose tripropionate, acrylic resins and polyvinylacetal resins can be mentioned as suitable binder resins. Gelatin is also a suitable binder resin. Of these, cellulose di(tri)acetate is especially preferred.

The binder can be cured by adding an epoxy, aziridine or isocyanate crosslinking agent. Suitable isocyanate crosslinking agents include, for example, isocyanates such as tolylene diisocyanate, 4,4'-diphenylmethane diisocyanate, hexamethylene diisocyanate and xylylene diisocyanate, reaction products of these isocyanates and polyhydric alcohols (e.g., reaction product of 3 mol of tolylene diisocyanate and 1 mol of trimethylolpropane), and polyisocyanates produced by condensation of these isocyanates, as described in, for example, JP-A-6-59357.

The method of dispersing the magnetic material in the above binder preferably comprises using a kneader, a pin type mill and an annular type mill either individually or in combination as described in JP-A-6-35092. Dispersants listed in JP-A-5-088283 and other common dispersants can be used. The thickness of the magnetic recording layer ranges from 0.1 to 10 $\mu$m, preferably 0.2 to 5 $\mu$m, and more preferably from 0.3 to 3 $\mu$m. The weight ratio of magnetic material grains to binder is preferably in the range of 0.5:100 to 60:100, more preferably 1:100 to 30:100. The coating amount of magnetic material grains ranges from 0.005 to 3 g/m$^2$, preferably from 0.01 to 2 g/m$^2$, and more preferably from 0.02 to 0.5 g/m$^2$. The transmission yellow density of the magnetic recording layer is preferably in the range of 0.01 to 0.50, more preferably 0.03 to 0.20, and most preferably 0.04 to 0.15.

The magnetic recording layer can be applied to the back of a photographic support in its entirety or in striped pattern by coating or printing. The magnetic recording layer can be applied by the use of, for example, an air doctor, a blade, an air knife, a squeeze, an immersion, reverse rolls, transfer rolls, a gravure, a kiss, a cast, a spray, a dip, a bar or an extrusion. Coating liquids set forth in JP-A-5-341436 are preferably used.

The magnetic recording layer may also be provided with, for example, lubricity enhancing, curl regulating, antistatic, sticking preventive and head polishing functions, or other functional layers may be disposed to impart these functions. An abrasive of grains whose at least one member is nonspherical inorganic grains having a Mohs hardness of at least 5 is preferred. The nonspherical inorganic grains are preferably composed of fine grains of any of oxides such as aluminum oxide, chromium oxide, silicon dioxide and titanium dioxide; carbides such as silicon carbide and titanium carbide; and diamond. These abrasives may have their surface treated with a silane coupling agent or a titanium coupling agent. The above grains may be added to the magnetic recording layer, or the magnetic recording layer may be overcoated with the grains (e.g., as a protective layer or a lubricant layer). The binder which is used in this instance can be the same as that mentioned above and, preferably, the same as that of the magnetic recording layer. The light-sensitive material having the magnetic recording layer is described in U.S. Pat. No. 5,336,589, U.S. Pat. No. 5,250,404, U.S. Pat. No. 5,229,259, U.S. Pat. No. 5,215,874 and EP No. 466,130.

The film patrone capable of accommodating the light-sensitive material therein will be described below.

The main material composing the patrone for use in the present invention may be a metal or a synthetic plastic. Examples of preferable plastic materials include polystyrene, polyethylene, polypropylene and polyphenyl ether. Further, the patrone may contain various types of antistatic agents and can preferably contain, for example, carbon black, metal oxide grains, nonionic, anionic, cationic or betaine type surfactants and polymers. Such an antistatic patrone is described in JP-A-1-312537 and JP-A-1-312538. The resistance thereof at 25° C. in 25% RH is preferably $10^{12}$ Ω or less. The plastic patrone is generally molded from a plastic having carbon black or a pigment milled thereinto for imparting light shielding properties. The patrone size may be the same as the current size 135, or for miniaturization of cameras, it is advantageous to decrease the diameter of the 25 mm cartridge of the current size 135 to 22 mm or less. The volume of the case of the patrone is preferably 30 cm$^3$ or less, more preferably 25 cm$^3$ or less. The weight of the plastic used in each patrone or patrone case preferably ranges from 5 to 15 g.

Still further, the patrone may be one capable of feeding a film out by rotating a spool. Further, the patrone may be so structured that a film front edge is accommodated in the main frame of the patrone and that the film front edge is fed from a port part of the patrone to the outside by rotating a spool shaft in a film feeding out direction. These are disclosed in U.S. Pat. No. 4,834,306 and U.S. Pat. No. 5,226,613.

The foregoing light-sensitive material of the present invention can preferably be used in a lens-equipped film unit as described in JP-B-2-32615 and Jpn. Utility Model Appln. KOKOKU Publication No. 3-39784.

The lens-equipped film unit refers to a unit comprising a packaging unit frame fitted in advance with a photographing lens and a shutter and, accommodated therein directly or after being packed in a container, an unexposed color light-sensitive material in sheeted or rolled form, which unit is light-tightly sealed and furnished with an outer packaging.

The packaging case frame is further fitted with a finder, means for light-sensitive material frame feeding, means for holding and ejecting an exposed color light-sensitive material, etc. The finder can be fitted with a parallax compensation support, and the photographing mechanism can be fitted with auxiliary lighting means as described in, for example, Jpn. Utility Model Appln. KOKAI Publication Nos. 1-93723, 1-57738 and 1-57740 and JP-A's 1-93723 and 1-152437.

Because the light-sensitive material used in the invention is accommodated in the packaging unit frame, the humidity within the packaging unit frame is preferably conditioned so that the relative humidity at 25° C. is in the range of 40 to 70%, more preferably 50 to 65%. It is preferred that the outer packaging be constituted of a moisture impermeable material, for example, nonwater-absorbent material of 0.1% or less absorptivity as measured in accordance with ASTM testing method D-570. It is especially preferred to employ an aluminum foil laminated sheet or an aluminum foil.

As the container for accommodating the exposed light-sensitive material, provided in the packaging unit frame, there can be employed cartridges for outer packaging unit, or common patroness for example, any of containers described in JP-A's 54-111822 and 63-194255, U.S. Pat. Nos. 4,832,275 and 4,834,306. The employed film of light-sensitive material can be of the 110-size, 135-size, half size thereof, or 126-size.

The plastic material employed for constituting the packaging unit can be produced by various methods, such as addition polymerization of an olefin having a carbon to carbon double bond, ring-opening polymerization of a few-member cyclic compound, polycondensation (condensation polymerization) or polyaddition of a plurality of polyfunctional compounds, and addition condensation of a phenol derivative, a urea derivative or a melamine derivative and an aldehyde compound.

The light-sensitive material of the present invention can be developed by any of the customary methods described in the above RD Nos. 17643 (pages 28 to 29), 18716 (page 651, left to right column) and 307105 (pages 880 to 881). As the development processing for the color negative film for use in the present invention, there can be mentioned processing C-41 of Eastman Kodak Company and processing CN-16 of Fuji Photo Film Co., Ltd.

The development processing for the color reversal film for use in the present invention is described in detail in Public Technology No. 6 (Apr. 1, 1991) page 1 line 5 to page 10 line 5 and page 15 line 8 to page 24 line 2, issued by Aztek. The contents thereof can preferably be applied without exception to this processing. As preferred development processing including the above contents, there can be mentioned processing E-6 of Eastman Kodak Company and processing CR-56 of Fuji Photo Film Co., Ltd.

With respect to the light-sensitive material of the present invention, an image can also be formed by performing a heat development after imagewise exposure.

The heat processing of light-sensitive material is known in the art to which the present invention pertains. The heat development light-sensitive material and processing thereof are described in, for example, pages 553 to 555 of Shashin Kogaku no Kiso (Fundamentals of Photographic Engineering) published by Corona Publishing Co., Ltd. in 1970; page 40 of Eizo Joho (Image Information) issued in April, 1978; pages 32 and 33 of Nabletts Handbook of Photography and Reprography 7th Ed. (Vna Nostrand and Reinhold Company); U.S. Pat. Nos. 3,152,904, 3,301,678, 3,392,020 and 3,457,075; GB Nos. 1,131,108 and 1,167,777; and RD No. 17029 (1978) pages 9 to 15.

In heat development processing, the heating temperature is in the range of about 50 to 250° C. An especially effective temperature is in the range of 60 to 180° C.

In heat development processing, the heating method comprises, for example, contacting the light-sensitive material with a heated block or blade, or contacting the light-sensitive material with a hot plate, a hot presser, a hot roller, a hot drum, a halogen lamp heater or an infrared or far infrared lamp heater, or passing the light-sensitive material through a high-temperature atmosphere.

Any type of heat development apparatus can be used in the processing of the light-sensitive material of the present invention. For example, heat development apparatuses described in JP-A's 59-75247, 59-177547, 59-181353 and 60-18951 and Jpn. Utility Model Appln. KOKAI Publication No. 62-25944 are preferably employed.

With respect to the light-sensitive material of the present invention, further, an image can be formed by activator processing or development using a processing solution containing a developing agent and a base. The activator processing refers to a processing method comprising accommodating a color developing agent within the light-sensitive material and developing the light-sensitive material with a processing solution containing no color developing agent. This processing solution is characterized by not containing a color developing agent contained in customary development processing solution components, and may contain other components (for example, alkali, auxiliary developing agent, etc.). The activator processing is illustrated in EP Nos. 545,491A1 and 565,165A1 and other publications.

Now, processing materials and processing methods for use in the heat development processing of the present invention will be described in detail.

In order to accelerate silver development and a dye forming reaction, a base or a base precursor can be used in the light-sensitive material of the present invention. As a base precursor, use can be made of, for example, a salt of organic acid and a base which is decarboxylated when heated or a compound capable of releasing amines through an intramolecular nucleophilic substitution reaction or the Lossen rearrangement or Beckmann rearrangement. Examples thereof are described in, for example, U.S. Pat. Nos. 4,514,493 and 4,657,848 and Public Technology No. 5 (Mar. 22, 1991, issued by Aztek) pages 55 to 86. Also, the method of generating a base by a combination of a basic metal compound only slightly soluble in water with a compound (referred to as "complex forming compound") capable of inducing a complex forming reaction with the metal ion being a constituent of the basic metal compound in the presence of water as a medium, as described in EP No. 210,660 and U.S. Pat. No. 4,740,445, can be employed. The addition amount of the base or a base precursor is in the range of 0.1 to 20 g/m$^2$, preferably 1 to 10 g/m$^2$.

In order to supply a base, use can be made of a processing member furnished with a processing layer containing a base or a base precursor. The processing member may have other functions, such as those of excluding air at the time of heat development, preventing the evaporation of materials from the light-sensitive material, supplying processing materials other than the base to the light-sensitive material, and removing materials (YF dye, AH dye, etc.) of the light-sensitive material being unneeded after the development or unneeded components produced by the development. The same support and binder as in the light-sensitive material can be employed in the processing member. For the above dye removal or other purposes, a mordant may be added to the processing member. As the mordant, use can be made of those known in the art of photography. For example, use can be made of mordants described in U.S. Pat. No. 4,720,446 columns 58 and 59 and JP-A's 61-88256 (pages 32 to 41), 62-244043 and 62-244036. Also, use can be made of dye receptive polymeric compounds described in U.S. Pat. No. 4,463,079. Further, a heat solvent mentioned later may be contained in the processing member.

In performing heat development with the use of the processing member, a small amount of water can preferably be used for the purposes of development acceleration, acceleration of processing material transfer and acceleration of unneeded matter diffusion. For example, reference can be made to U.S. Pat. Nos. 4,704,245 and 4,470,445 and JP-A-61-238056. The water may contain an inorganic alkali metal salt, an organic base, a low-boiling-point solvent, a surfactant, an antifoggant, a compound capable of forming a complex with a metal salt of extremely low solubility, a mildewproofing agent and an antibacterial agent. Any generally employed water can be used as the above water. For example, use can be made of distilled water, tap water, well water and mineral water. In the heat development apparatus using the processing member and the light-sensitive material of the present invention, water may be used only once or recycled plural times. In the latter instance, use is made of water containing components leached from the materials. Also, apparatuses and water described in, for example, JP-A's 63-144354, 63-144355, 62-38460 and 3-210555 may be employed. Use can be made of the method of applying water to the light-sensitive material, the processing member or both thereof. The water application amount is preferably one corresponding to 1/10 to 1-fold of the amount required for effecting the maximum swelling of all coating films of the light-sensitive material or processing member (excluding the back layer). With respect to the method of water application, for example, the methods described in JP-A's 62-253159 (page 5) and 63-85544 can preferably be employed. Moreover, a solvent can be used in the state of being enclosed in a microcapsule or being accommodated in the form of a hydrate within the light-sensitive material, the processing member or both thereof in advance. The temperature of the applied water is preferably in the range of about 30 to 60° C. as described in, for example, the above JP-A-63-85544.

When heat development is carried out in the presence of a small amount of water, it is effective to employ the method of generating a base by a combination of a basic metal compound only slightly soluble in water with a compound (referred to as "complex forming compound") capable of inducing a complex forming reaction with the metal ion being a constituent of the basic metal compound in the presence of water as a medium, as described in EP No. 210,660 and U.S. Pat. No. 4,740,445. In this method, from the viewpoint of the storage stability of the light-sensitive material, it is preferred to add the basic metal compound only slightly soluble in water to the light-sensitive material and to add the complex forming compound to the processing member.

For piling the light-sensitive material and the processing member one upon one another so that the light-sensitive layer and the processing layer are opposite to each other, there can be employed the methods described in JP-A's 62-253159 and 61-147244 (page 27). The heating temperature is preferably in the range of 70 to 100° C., and the heating time is preferably in the range of 5 to 60 sec.

The processing sheet and/or the light-sensitive material of the present invention may be in a form having a conductive exothermic layer as heating means for heat development. As an exothermic element for the heat evolution, use can be made of those described in JP-A-61-145544.

In order to accelerate the heat development, a heat solvent can be added to the light-sensitive material of the present invention. As examples thereof, there can be mentioned polar organic compounds as described in U.S. Pat. Nos. 3,347,675 and 3,667,959. Particular examples thereof include amide derivatives (benzamide, etc.), urea derivatives (methylurea, ethyleneurea, etc.), sulfonamide derivatives (for example, compounds described in Jpn. Pat. Appln. KOKOKU Publication Nos. (hereinafter referred to as JP-B's) 1-40974 and 4-13701), polyol compounds (sorbitols) and polyethylene glycols. When the heat solvent is insoluble in water, it is preferably used in the form of a solid dispersion. The layer to be loaded with the heat solvent may be a light-sensitive layer or a nonlight-sensitive layer, depending on the intended use. The addition amount of heat solvent is in the range of 10 to 500% by weight, preferably 20 to 300% by weight, based on the binder of the layer to be loaded therewith.

In the present invention, although image information can be introduced without removing the developed silver formed by the development and undeveloped silver halides, image introduction can be performed after effecting the removal. In the latter instance, means for effecting the removal can be applied simultaneously with the development or after the development.

For removing the developed silver from the light-sensitive material, or complexing or solubilizing silver halides, simultaneously with the development, the processing member can be loaded with a silver oxidizer or re-halogenating agent capable of acting as a bleaching agent or a silver halide solvent capable of acting as a fixing agent in advance, and reaction thereof can be induced at the time of heat development. Further, after the completion of image forming development, a second member containing a silver oxidizer or re-halogenating agent or a silver halide solvent can be stuck to the light-sensitive material to thereby carry out removal of developed silver or complexing or solubilization of silver halides. In the present invention, it is preferred to implement such processing to such an extent that reading of image information is not hindered after photographing and the subsequent image forming development. In particular, because undeveloped silver halides cause extensive haze in the gelatin film and increase the density of the image background, it is preferred to reduce the haze, or solubilize the same so as to remove its entirety or portion from the film, with the use of the above complexing agent. Furthermore, for the purpose of reducing the haze of silver halides per se, it is preferred to employ tabular grains with a high aspect ratio or employ tabular grains with a high silver chloride content.

Common silver bleaching agents can be arbitrarily used in the processing member of the present invention. Such bleaching agents are described in U.S. Pat. Nos. 1,315,464 and 1,946,640 and Photographic Chemistry, vol. 2, chapter 30, Foundation Press, London, England. Such bleaching agents effectively oxidize and solubilize photographic silver images. Examples of useful silver bleaching agents include alkali metal bichromates and alkali metal ferricyanides. Preferred bleaching agents are those soluble in water, and comprehend ninhydrin, indandione, hexaketocyclohexane, 2,4-dinitrobenzoic acid, benzoquinone, benzenesulfonic acid and 2,5-dinitrobenzoic acid. Further, there can be employed metallo-organic complexes, such as ferric salts of cyclohexyldialkylaminotetraacetic acid, ferric salt of ethylenediaminetetraacetic acid and ferric salt of citric acid. As the fixing agent, use can be made of silver halide solvents which can be contained in the processing member (first processing member) for developing the light-sensitive material. The same binder, support and additives as in the first processing member can be used in a second processing member. The coating amount of bleaching agent, although should be varied depending on the silver content of light-sensitive material to be stuck to the processing member, can be in the range of 0.01 to 10 mol/mol of coating silver of light-sensitive material per unit area of light-sensitive material. The coating amount of bleaching agent is preferably in the range of 0.1 to 3 mol/mol of coating silver of light-sensitive material, more preferably in the range of 0.1 to 2 mol/mol of coating silver of light-sensitive material.

The present invention will be described in greater detail below by way of its examples. However, the present invention is in no way limited to these examples.

EXAMPLE 1

Preparation of Silver Iodide Fine Grain Emulsion 1700 milliliters (hereinafter referred to as "mL") of an aqueous solution containing 0.23 g of KI and 23 g of low-molecular-weight gelatin was agitated while maintaining its temperature at 40° C. An aqueous solution containing 153 g of $AgNO_3$ and an aqueous solution containing 149.5 g of KI were added by the double jet method over a period of 13 min. After completion of the addition, the mixture was cooled to 40° C., and desalted by the customary flocculation method. Thereafter, 78 g of alkali-processed delimed gelatin was added, and the pH value of the mixture was adjusted to 5.8 at 40° C.

The thus obtained silver iodide fine grain emulsion contained, per kg of emulsion, 0.72 mol of Ag and 31 g of gelatin. With respect to the emulsion, the average grain size was 0.03 $\mu$m, and the variation coefficient of grain size was 20%.

Preparation of Emulsion 1-A 1200 ml of an aqueous solution containing 0.75 g of low-molecular-weight gelatin, 0.9 g of KBr and 0.2 g of modified silicone oil (L7602, produced by Nippon Unicar Company, Limited) was vigorously agitated while maintaining the temperature of the mixture at 39° C. and adjusting the pH value thereof to 1.8. An aqueous solution containing 0.45 g of $AgNO_3$ and an aqueous solution of KBr containing 1.5 mol % of KI were added by the double jet method over a period of 16 sec. During this period, the silver potential against saturated calomel electrode was maintained at 10 mV (addition (i)). Subsequently, the mixture was heated to 54° C. and ripened. After the completion of ripening, 20 g of alkali-processed delimed gelatin was added. The pH value of the mixture was adjusted to 5.9, and 2.9 g of KBr was added. An aqueous solution of KBr and 288 mL of an aqueous solution containing 28.8 g of $AgNO_3$ were added by the double jet method over a period of 53 min. During this period, 0.03 $\mu$m grain size silver iodide fine grain emulsion was simultaneously added so that the silver iodide content became 4.1 mol %, and the silver potential against saturated calomel electrode was maintained at 10 mV (addition (ii)). 2.5 g of KBr was added, and an aqueous solution of KBr and an aqueous solution containing 87.7 g of $AgNO_3$ were added by the double jet method over a period of 63 min while increasing the flow rate so that the final flow rate was 1.2 times the initial flow rate. During this period, the above AgI fine grain emulsion was simultaneously added while conducting a flow rate increase so that the silver iodide content became 10.5 mol %, and the silver potential was maintained at −70 mV (addition (iii)). An aqueous solution of KBr and 132 mL of an aqueous solution containing 41.8 g of $AgNO_3$ were added by the double jet method over a period of 25 min. During this period, the addition of the aqueous solution of KBr was regulated so that the potential at the completion of the addition was +20 mV (addition (iv)). 15 g of supplemental gelatin was added, so that the pH value was adjusted to 7.3. KBr was added to thereby adjust the silver potential to −70 mV. Thereafter, the above silver iodide fine grain emulsion was added in an amount, in terms of the weight of KI, of 5.8 g. Immediately after the completion of the addition, 609 mL of an aqueous solution containing 66.4 g of $AgNO_3$ was added over a period of 10 min. For 6 min in the initial stage of addition, the silver potential was maintained at −70 mV by the use of an aqueous solution of KBr (addition (v)). The resultant mixture was desalted by the customary flocculation method, and 40 g of disperse gelatin was added, so that the pH and pAg thereof at 40° C. were adjusted to 6.5 and 8.2, respectively.

The following compounds 1 and 2 were added, and the mixture was heated to 56° C. The above silver iodide fine grain emulsion was added in an amount of $4.5\times10^{-4}$ mol per mol of silver. Thereafter, the following sensitizing dyes 1, 2 and 3 were added in a molar ratio of 55:40:5 in the form of solid dispersion. Further, potassium thiocyanate, chloroauric acid, sodium thiosulfate and N,N-dimethylselenourea were added to thereby effect optimum chemical sensitization. At the completion of chemical sensitization, compounds 3 and 4 were added.

The thus obtained emulsion 1-A had an average equivalent circle diameter of 1.15 $\mu$m, an average aspect ratio of 3.8 and an average iodide content of 7 mol %. As a result of observation through a 200 kV transmission electron microscope at liquid nitrogen temperature, it was found that 10 or more dislocation lines per grain on the average were present in the vicinity of the periphery of tabular grains of the emulsion.

(Compound-1)

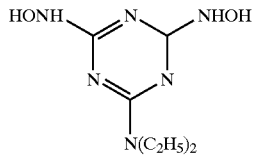

(Compound-2)

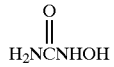

Compound-3)

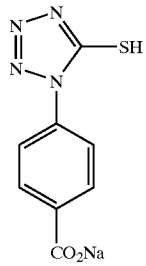

(Compound-4)

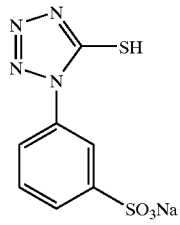

(Sensitizing dye-1)

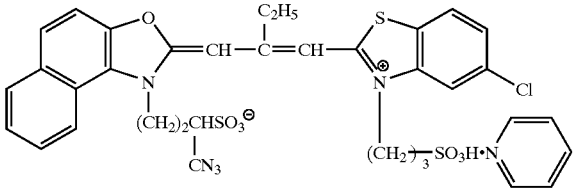

Sensitizing dye-2)

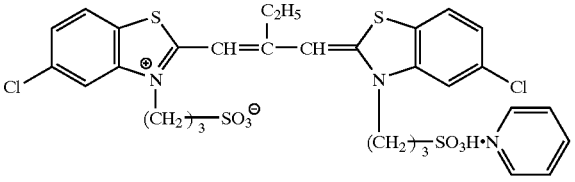

(Sensitizing dye-3)

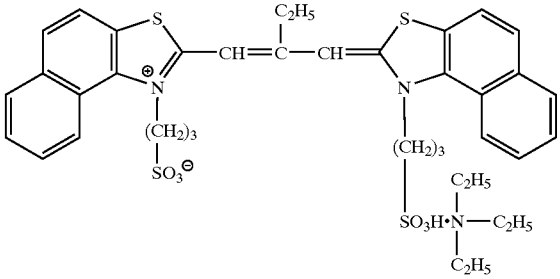

Preparation of Emulsion 1-B

Emulsion 1-B was prepared in the same manner as the emulsion 1-A except that the alkali-processed delimed gelatin used in the addition (ii) was changed to gelatin succinate and that the silver potential of the additions (i) and (ii) was changed to 0 mV. In the obtained emulsion 1-B, tabular grains with an average aspect ratio of 5 or more occupied a percentage exceeding 95% of the total projected area of all the grains. The emulsion 1-B had an average equivalent circle diameter of 1.42 μm, an average aspect ratio of 7.2 and an average iodide content of 7 mol %.

Preparation of Emulsion 1-C

Emulsion 1-C was prepared in the same manner as the emulsion 1-A except that the alkali-processed delimed gelatin used in the addition (ii) was changed to gelatin succinate and that the silver potential of the additions (i) and (ii) was changed to −25 mV. In the obtained emulsion 1-C, tabular grains with an average aspect ratio of 5 or more occupied a percentage exceeding 95% of the total projected area of all the grains. The emulsion 1-C had an average equivalent circle diameter of 1.64 μm, an average aspect ratio of 10.9 and an average iodide content of 7 mol %.

Preparation of Emulsion 1-D

Emulsion 1-D was prepared in the same manner as the emulsion 1-A except that the alkali-processed delimed gelatin used in the addition (ii) was changed to gelatin succinate and that the silver potential of the additions (i) and (ii) was changed to −60 mV. In the obtained emulsion 1-D, tabular grains with an average aspect ratio of 5 or more occupied a percentage exceeding 95% of the total projected area of all the grains. The emulsion 1-D had an average equivalent circle diameter of 2.02 μm, an average aspect ratio of 20.0 and an average iodide content of 7 mol %.

A support of cellulose triacetate film furnished with a substratum was coated with each of the above chemically sensitized emulsions 1-A to 1-D under the following coating conditions. Film pAg regulating agent (aqueous solution of $AgNO_3$ or an aqueous solution of NaBr) was appropriately added to each protective layer. Thus, coating samples 101 to 116 whose film pAg was regulated were obtained.

Coating Conditions (1) Emulsion layer

Emulsion: various emulsions (silver $2.1\times10^{-2}$ mol/m$^2$),

Coupler: following compound 5 ($1.5\times10^{-3}$ mol/m$^2$),

Antifoggant: following compound 6 ($1.0\times10^{-4}$ mol/m$^2$),

Tricresyl phosphate (1.1 g/m$^2$), and

Alkali-processed delimed gelatin (2.3 g/m$^2$).

(2) Protective layer

Sodium salt of 2,4-dichloro-6-hydroxy-s-triazine (0.08 g/m$^2$),

Alkali-processed delimed gelatin (1.8 g/m$^2$), and

Film pAg regulating agent (appropriate one).

(Compound-5)

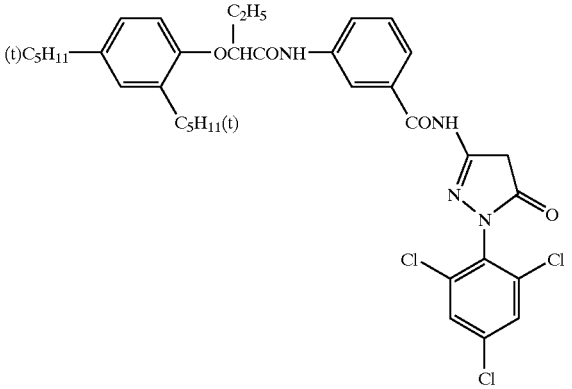

(Compound-6)

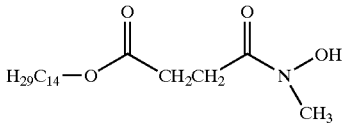

(Compound-7)

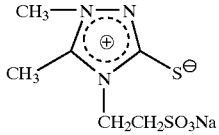

The obtained samples were allowed to stand still in an atmosphere of 40° C. and 70% relative humidity for 14 hr, exposed through a yellow filter and a continuous wedge for 1/100 sec, and subjected to the following color development processing.

(Processing step)

| Step | Processing Time | Processing Temp. |
|---|---|---|
| Color development | 60 sec | 45.0° C. |
| Bleaching | 20 sec | 45.0° C. |
| Fixing | 40 sec | 45.0° C. |
| Washing (1) | 15 sec | 45.0° C. |
| Washing (2) | 15 sec | 45.0° C. |
| Washing (3) | 15 sec | 45.0° C. |
| Drying | 45 sec | 80.0° C. |

(Washing was performed according to a countercurrent system from (3) to (1) .)

The composition of each of the processing solutions was as follows.

| | (g) |
|---|---|
| (Color developer) | |
| Diethylenetriaminepentaacetic acid | 2.0 |
| 1-Hydroxyethylidene-1,1-diphosphonic acid | 3.3 |
| Sodium sulfite | 5.5 |
| Potassium carbonate | 39.0 |
| Potassium bromide | 2.0 |
| Potassium iodide | 1.3 mg |
| Disodium N,N-bis(sulfonatoethyl)hydroxylamine | 10.0 |
| 2-Methyl-4-[N-ethyl-N-(β-hydroxyethyl)amino]aniline sulfate | 9.0 |
| Silver solvent: above compound 7 | 0.4 |
| Water | q.s. ad 1000 ml |
| pH | 10.25. |

This pH was adjusted by the use of potassium hydroxide or sulfuric acid.

-continued

| | (g) |
|---|---|
| (Bleaching solution) | |
| Fe(III) ammonium 1,3-diaminopropanetetraacetate monohydrate | 0.33 |
| Fe(III) nitrate nonahydrate | 0.30 |
| Ammonium bromide | 0.80 |
| Ammonium nitrate | 0.20 |
| Acetic acid | 1.0 lit. |
| Water | q.s. ad 1000 ml |
| pH | 4.5. |
| This pH was adjusted by the use of aqueous ammonia. | |
| (Fixer) | |
| Ammonium sulfite | 28.0 |
| Aq. soln. of ammonium thiosulfate (700 g/lit.) | 280 mL |
| Imidazole | 15.0 |
| Ethylenediaminetetraacetic acid | 15.0 |
| Water | q.s. ad 1000 ml |
| pH | 5.8. |
| This pH was adjusted by the use of aqueous ammonia or acetic acid. | |

Washing Water

Tap water was passed through a mixed-bed column filled with H-type strongly acidic cation exchange resin (Amberlite IR-120B: available from Rohm & Haas Co.) and OH-type strongly basic anion exchange resin (Amberlite IR-400: available from the same source) to thereby reduce the concentrations of calcium and magnesium ions to be 3 mg/lit. or less. Subsequently, 20 mg/lit. of sodium dichloroisocyanurate and 150 mg/lit. of sodium sulfate were added. The pH of the solution ranged from 6.5 to 7.5.

The density of each of the developed samples was measured, thereby determining the sensitivity. The sensitivity was given as the logarithm of inverse number of exposure quantity required for a magenta color image density to exhibit fog +0.2 and expressed as a relative value to that of sample 101. The graininess was evaluated by measuring the RMS granularity of magenta color image at a density of fog +0.2. Each of the undeveloped samples was allowed to stand still for 14 hr under such conditions that the temperature and relative humidity were 40° C. and 70%, respectively, and placed in an atmosphere of 25° C. and 55% relative humidity for 8 hr. Thereafter, the samples were exposed through a yellow filter and a continuous wedge for 1/100 sec. Then, in the same atmosphere, the emulsion surface was scratched at a speed of 1 cm/sec by means of a needle having a diameter of 0.1 mm under a load of 4 g. The samples were developed under the above conditions, and the density change of scratch trace between fog zone and highest density zone was measured by means of an aperture with a diameter of 25 $\mu$m. Thus, the pressure resistance was evaluated. The obtained results are given in Table 1.

TABLE 1

| Sample No. | Emulsion | Average aspect ratio | Film pAg | Relative sensitivity | RMS value × 100 | Scratch density change: Fog portion | Scratch density change: Highest density portion |
|---|---|---|---|---|---|---|---|
| 101 (Comp. Ex.) | 1-A | 3.8 | 9.5 | 100 | 77 | +0.34 | −0.67 |
| 102 (Comp. Ex.) | 1-A | 3.8 | 8.0 | 102 | 78 | +0.29 | −0.60 |
| 103 (Comp. Ex.) | 1-A | 3.8 | 6.0 | 105 | 80 | +0.22 | −0.58 |
| 104 (Comp. Ex.) | 1-A | 3.8 | 4.5 | 101 | 79 | +0.27 | −0.54 |
| 105 (Comp. Ex.) | 1-B | 7.2 | 9.5 | 110 | 75 | +0.25 | −0.46 |
| 106 (Invention) | 1-B | 7.2 | 8.0 | 120 | 70 | +0.14 | −0.17 |
| 107 (Invention) | 1-B | 7.2 | 6.0 | 122 | 70 | +0.09 | −0.11 |
| 108 (Invention) | 1-B | 7.2 | 4.5 | 116 | 71 | +0.11 | −0.08 |
| 109 (Comp. Ex.) | 1-C | 10.9 | 9.5 | 115 | 76 | +0.18 | −0.40 |
| 110 (Invention) | 1-C | 10.9 | 8.0 | 127 | 70 | +0.13 | −0.14 |
| 111 (Invention) | 1-C | 10.9 | 6.0 | 131 | 68 | +0.07 | −0.07 |
| 112 (Invention) | 1-C | 10.9 | 4.5 | 120 | 70 | +0.11 | −0.05 |
| 113 (Comp. Ex.) | 1-D | 20.0 | 9.5 | 123 | 76 | +0.17 | −0.33 |
| 114 (Invention) | 1-D | 20.0 | 8.0 | 141 | 72 | +0.10 | −0.05 |
| 115 (Invention) | 1-D | 20.0 | 6.0 | 144 | 70 | +0.05 | −0.03 |
| 116 (Invention) | 1-D | 20.0 | 4.5 | 134 | 74 | +0.09 | −0.02 |

It is apparent from Table 1 that the samples of the present invention realize high sensitivity and excellent graininess even if rapidly processed with such a short color development time as 60 sec. It is also apparent that the fog density change by scratch is slight to thereby demonstrate the excellent pressure resistance of the samples of the present invention.

EXAMPLE 2

Preparation of Tabular Silver Iodobromide Emulsion 2-A $H_2SO_4$ was added to 1000 ml of an aqueous solution containing 0.5 g of oxidized gelatin and 0.37 g of KBr to thereby adjust the pH value thereof to 2. The mixture was agitated while maintaining the temperature at 40° C. Under the agitation, 20 mL of a 0.3 M aqueous solution of $AgNO_3$ and 20 mL of a 0.3 M aqueous solution of KBr were simultaneously added by the double jet method over a period of 40 sec. Subsequently, KBr was added to thereby adjust the pAg value to 9.9. Further, NaOH was added to thereby adjust the pH value to 5.0. The mixture was heated to 75° C. over a period of 35 min, and 30 g of gelatin phthalate was added. 512 mL of a 1.2M aqueous solution of $AgNO_3$ and 440 mL of a 1.4M aqueous solution of KBr were added over a period of 33 min while maintaining the pAg value at 7.72 and while increasing the flow rate (so that the final flow rate was 5.2 times the initial flow rate). Thereafter, the mixture was cooled to 40° C., and sodium p-iodoacetamidobenzenesulfonate (compound 8) was added in an amount of 0.033 mol in terms of KI. Further, 64 mL of a 0.8 M aqueous solution of sodium sulfite was added. An aqueous solution of NaOH was added to thereby adjust the pH value of the reaction mixture to 9.0. The reaction mixture was held at 40° C. for 4 min.

The temperature of the reaction mixture was raised to 55° C. The pH value of the reaction mixture was adjusted to 5.8, and 104 mL of a 0.4 M aqueous solution of $AgNO_3$ and 279 mL of a 0.12 M aqueous solution of KI were added at a constant flow rate over a period of 5 min. Subsequently, an aqueous solution of KBr was added to thereby adjust the pAg value to 8.8. Further, 133 mL of a 1.8 M aqueous solution of $AgNO_3$ and 125 mL of a 1.8 M aqueous solution of KBr were added. Thereafter, the obtained emulsion was cooled to 35° C., and washed by the customary flocculation method. 75 g of gelatin was added, so that the pH and pAg values were adjusted to 5.5 and 8.2, respectively. In the obtained grains, tabular grains with an average aspect ratio of 5 or more occupied a percentage exceeding 99% of the total projected area of all the grains. The grains had an average equivalent sphere diameter of 0.65 μm, an average equivalent circle diameter of 1.13 μm, an average grain thickness of 0.144 μm and an average aspect ratio of 7.8.

Preparation of Tabular Silver Iodobromide Emulsion 2-B

This emulsion was prepared in the same manner as the emulsion 2-A except for the following. At 75° C., the same addition was performed while increasing the flow rate and while maintaining the pAg value at 8.01 in place of 7.72. The pAg after cooling to 55° C. was adjusted to the same value as in the preparation of the emulsion 2-A, followed by the subsequent additions. In the obtained emulsion 2-B, tabular grains with an average aspect ratio of 5 or more occupied a percentage exceeding 99% of the total projected area of all the grains. The grains had an average equivalent sphere diameter of 0.65 μm, an average equivalent circle diameter of 1.50 μm, an average grain thickness of 0.082 μm and an average aspect ratio of 18.3.

Preparation of Tabular Silver Iodobromide Emulsion 2-C

This emulsion was prepared in the same manner as the emulsion 2-A except for the following. At 75° C., the same addition was performed while increasing the flow rate and while maintaining the pAg value at 8.29 in place of 7.72. The pAg after cooling to 55° C. was adjusted to the same value as in the preparation of the emulsion 2-A, followed by the subsequent additions. In the obtained emulsion 2-C, tabular grains with an average aspect ratio of 5 or more occupied a percentage exceeding 99% of the total projected area of all the grains. The grains had an average equivalent sphere diameter of 0.65 μm, an average equivalent circle diameter of 1.64 μm, an average grain thickness of 0.068 μm and an average aspect ratio of 24.1.

Chemical Sensitization

The emulsions 2-A to 2-C were appropriately loaded, under such conditions that the temperature, pH and pAg were 60° C., 6.2 and 8.4, respectively, with the following sensitizing dyes 4, 5 and 6, the following compound 9, potassium thiocyanate, chloroauric acid, sodium thiosulfate and tellurium sensitizing agent (following compound 10) so that a spectral sensitization and a chemical sensitization were carried out. The sensitizing dyes were changed in proportion to the grain surface area of each emulsion. The amount of chemical sensitizer was regulated so as to maximize the sensitivity at 1/100 sec exposure with respect to each of the emulsions.

(Compound-8)

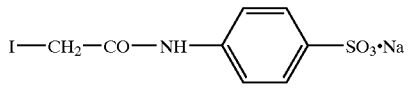

(Compound-9)

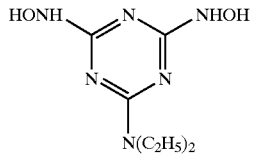

(Compound-10)

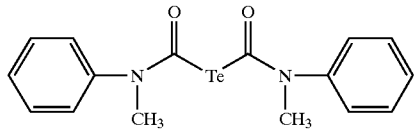

(Sensitizing dye-4)

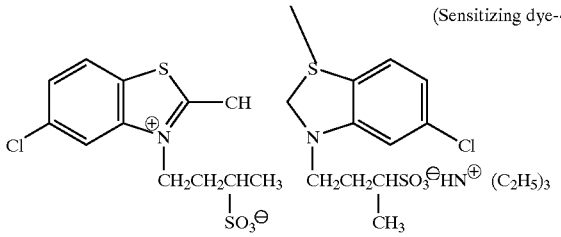

-continued (Sensitizing dye-5)

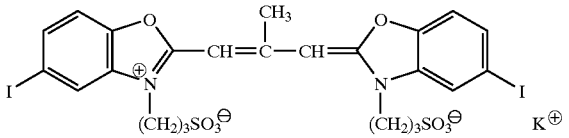

(Sensitizing dye-6)

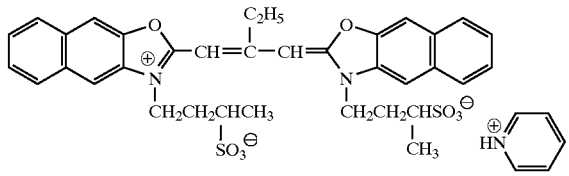

Preparation of Benzotriazole Silver Salt (Organosilver Salt) Dispersion 28 g of gelatin and 13.2 g of benzotriazole were dissolved in 300 mL of water. The resultant solution was agitated while maintaining its temperature at 40° C. A solution of 17 g of silver nitrate in 100 mL of water was added to the above solution over a period of 2 min. The benzotriazole silver salt was precipitated by regulating the pH value so as to remove excess salts. Thereafter, the pH value was adjusted to 6.3. Thus, 400 g of a dispersion of benzotriazole silver salt was obtained.

Preparation of Zinc Hydroxide (Base Precursor) Dispersion

A dispersion of zinc hydroxide for use as a base precursor was prepared in the following manner. 31 g of powdered zinc hydroxide with a primary particle size of 0.2 $\mu$m, 1.6 g of carboxymethylcellulose as a dispersant, 0.4 g of sodium polyacrylate, 8.5 g of lime-processed ossein gelatin and 158.5 mL of water were mixed together. This mixture was milled with the use of glass beads for 1 hr to thereby effect dispersion. Thereafter, the glass beads were filtered off. Thus, 188 g of a zinc hydroxide dispersion was obtained.

Preparation of Coupler Dispersion

An emulsion dispersion of magenta coupler was prepared in the following manner. 7.80 g of magenta coupler (a), 5.45 g of developing agent (b), 2 mg of antifoggant (c), 8.21 g of high-boiling organic solvent (d) and 24.0 mL of ethyl acetate were mixed together at 60° C. to thereby obtain a solution. This solution was mixed into 150 g of an aqueous solution wherein 12.0 g of lime-processed gelatin and 0.6 g of surfactant (e) were dissolved, and emulsified and dispersed by means of a dissolver agitator at 10,000 rpm over a period of 20 min. After the dispersion, distilled water was added so that the whole amount became 300 g, and mixed at 2000 rpm for 10 min.

Magenta coupler (a)

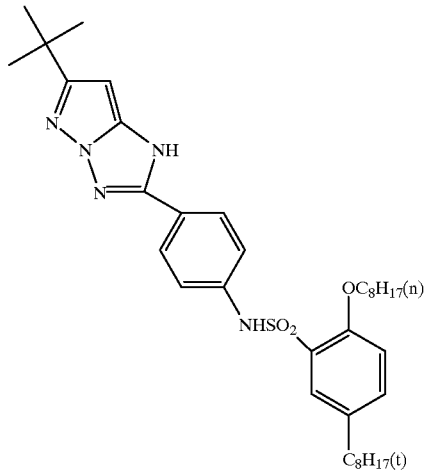

Developing agent (b)

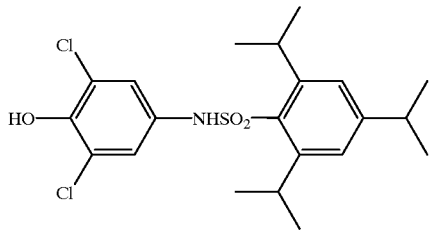

Antifoggant (c)

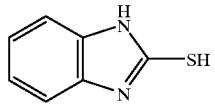

High-boiling organic solvent (d)

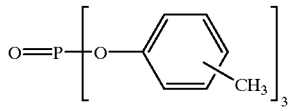

Surfacant (e)

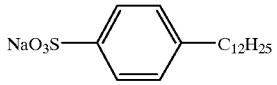

Preparation of Coating Sample

The above dispersions were combined with the chemically sensitized emulsions 2-A to 2-C and applied in the constitution of Table 2 onto supports. Thus, coating samples 201 to 212 wherein the film pAg was regulated by appropriately loading the protective layer with a film pAg regulating agent (aqueous solution of $AgNO_3$ or an aqueous solution of NaBr) were obtained (Table 6 given later). Further, coating samples 213 to 216 were prepared in the same manner as the samples 209 to 212 wherein use was made of the emulsion 2-C, except that the benzotriazole silver salt (organosilver salt) was removed.

TABLE 2

| Constitution of coating sample | | |
|---|---|---|
| Protective layer | Lime-processed gelatin | 1000 |
| | Matting agent (silica) | 50 |
| | Surfactant (f) | 100 |
| | Surfactant (g) | 300 |
| | Water-soluble polymer (h) | 15 |
| | Film hardener (i) | 135 |
| | Film pAg regulating agent | |
| Interlayer | Lime-processed gelatin | 375 |
| | Surfactant (g) | 15 |
| | Zinc hydroxide | 1100 |
| | Water-soluble polymer (h) | 15 |
| Magenta coloring layer | Lime-processed gelatin | 2000 |
| | Emulsion (in terms of coating silver amt.) | 1728 |
| | Benzotriazole silver salt | 260 |
| | Magenta coupler (a) | 637 |
| | Developing agent (b) | 444 |
| | Antifoggant (c) | 0.2 |
| | High-boiling organic solvent (d) | 670.00 |
| | Surfactant (e) | 33 |
| | Water-soluble polymer (h) | 14 |
| | Transparent PET base (120 μm) | |

* Figure indicates the coating amt. (mg/m$^2$)

Further, processing material P-1 as specified in Tables 3 and 4 was prepared.

TABLE 3

| Constitution of processing material P-1 | | |
|---|---|---|
| Layer arrangement | Added material | Addn. amt. (mg/m$^2$) |
| 4th layer | Acid-processed gelatin | 220 |
| Protective layer | Water-soluble polymer (j) | 60 |
| | Water-soluble polymer (k) | 200 |
| | Additive (l) | 80 |
| | Palladium sulfide | 3 |
| | Potassium nitrate | 12 |
| | Matting agent (m) | 10 |
| | Surfactant (g) | 7 |
| | Surfactant (n) | 7 |
| | Surfactant (o) | 10 |
| 3rd layer | Lime-processed gelatin | 240 |
| Interlayer | Water-soluble polymer (k) | 24 |
| | Film hardener (p) | 180 |
| | Surfactant (e) | 9 |
| 2nd layer | Lime-processed gelatin | 2400 |
| Base generating layer | Water-soluble polymer (k) | 360 |
| | Water-soluble polymer (q) | 700 |
| | Water-soluble polymer (r) | 600 |
| | High-boiling solvent (s) | 2000 |
| | Additive (t) | 20 |
| | Hydantoin potassium salt | 260 |
| | Guanidine picolinate | 2910 |
| | Potassium quinolinate | 225 |
| | Sodium quinolinate | 180 |
| | Surfactant (e) | 24 |
| 1st layer | Lime-processed gelatin | 280 |
| Substratum | Water-soluble polymer (j) | 12 |
| | Surfactant (g) | 14 |
| | Film hardener (p) | 185 |
| | Transparent support A (63 μm) | |

TABLE 4

| Constitution of support A | | |
|---|---|---|
| Name of layer | Compsn. | Mass (mg/m$^2$) |
| Surface substratum | Gelatin | 100 |
| Polymer layer | Polyethylene terephthalate | 62500 |

TABLE 4-continued

| Constitution of support A | | |
|---|---|---|
| Name of layer | Compsn. | Mass (mg/m$^2$) |
| Back substratum | Methyl methacrylate/styrene/2-ethylhexyl acrylate/methacrylic acid copolymer | 1000 |
| | PMMA latex (av. particle diam. 12μ) | 120 |

Surfacant (f)

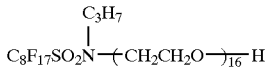

Surfacant (g)

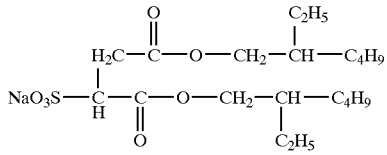

Water-soluble polymer (h)

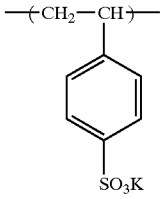

Film hardener (i)

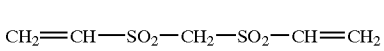

Water-soluble polymer (j)

κ-Carrageenan

Water-soluble polymer (k)

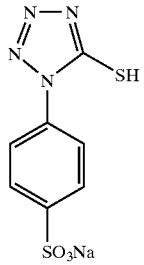

Additive (l)

Sumikage IL-5H (produced by Sumitomo Chemical Co., Ltd.)

Matting agent (m)

SYLOID79
(produced by Fuji-Davidson Chemical Co., Ltd, Japan)

Surfactant (n)

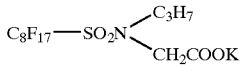

Surfactant (o)

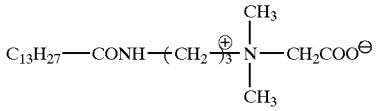

Film hardener (p)

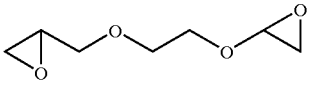

-continued

Additive (p)

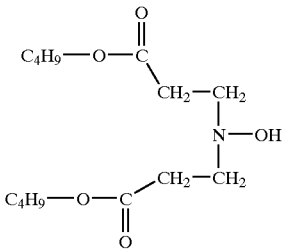

Water-soluble polymer (q)

dextrin (molecular weight 70,000)

Water-soluble polymer (r)

MP polymer MP102 (produced by Kuraray Co., Ltd.)

High-boiling solvent (s)

Empara 4 0 (produce by Ajinomoto Co., Ltd.)

These light-sensitive materials were subjected to 2000 lux exposure for 1/100 sec through an optical wedge and a yellow filter. After exposure, 40° C. water was applied in an amount of 15 mL/m$^2$ onto the light-sensitive material surface, and the resultant light-sensitive material surface and the surface of processing member were stuck to each other. Heat development was effected at 83° C. for 30 sec with the use of a heating drum. After the processing, the light-sensitive material was separated from the processing member. Thus, magenta colored images were obtained. The resultant samples were further subjected to the second step processing using a second processing sheet as specified in Table 5.

TABLE 5

Constitution of processing material P-2

| Layer arrangement | Added material | Addn. amt. (mg/m$^2$) |
|---|---|---|
| 4th layer | Acid-processed gelatin | 220 |
| Protective layer | Water-soluble polymer (j) | 60 |
| | Water-soluble polymer (k) | 200 |
| | Additive (1) | 80 |
| | Palladium sulfide | 3 |
| | Potassium nitrate | 12 |
| | Matting agent (m) | 10 |
| | Surfactant (g) | 7 |
| | Surfactant (n) | 7 |
| | Surfactant (o) | 10 |
| 3rd layer | Lime-processed gelatin | 240 |
| Interlayer | Water-soluble polymer (k) | 24 |
| | Film hardener (p) | 180 |
| | Surfactant (e) | 9 |

TABLE 5-continued

Constitution of processing material P-2

| Layer arrangement | Added material | Addn. amt. (mg/m$^2$) |
|---|---|---|
| 2nd layer | Lime-processed gelatin | 2400 |
| Fixing layer | Water-soluble polymer (k) | 360 |
| | Water-soluble polymer (q) | 700 |
| | Water-soluble polymer (r) | 600 |
| | Compound A | 4000 |
| | Surfactant (e) | 20 |
| 1st layer | Lime-processed gelatin | 280 |
| Substratum | Water-soluble polymer (j) | 12 |
| | Surfactant (g) | 14 |
| | Film hardener (p) | 185 |
| | Transparent support A (63 μm) | |

Compound A

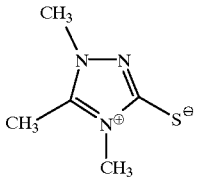

In the second step processing, 10 mL/m$^2$ of water was applied onto the second processing sheet. The resultant second processing sheet was stuck to the light-sensitive material after the first processing, and heated at 60° C. for 30 sec. The transmission density of obtained colored samples was measured, thereby obtaining a characteristic curve.

The sensitivity was given as the inverse number of exposure quantity corresponding to a density that was 0.2 higher than fog density and expressed as a relative value to that of sample 201 (assumed as being 100). Further, for evaluating the graininess of the samples, exposure was carried out so that the magenta color density became 1.0, followed by similar heat development. The RMS value was measured by an aperture of 48 μm diameter with the use of a diffuse light source. Moreover, each undeveloped sample was stored at 50° C. in 60% relative humidity for 3 days, and thereafter the same heat development was carried out. The relative sensitivity was determined, and the storage stability of light-sensitive material was evaluated thereby.

TABLE 6

| | | | | | | Heat development (60° C. 30" developed) | | |
|---|---|---|---|---|---|---|---|---|
| Sample No. | Emulsion | Average aspect ratio | Average grain thickness (μm) | Film pAg | Organic silver salt | Relative sensitivity | RMA value × 1000 | Relative sensitivity after storage |
| 201 (Comp. Ex.) | 2-A | 7.8 | 0.144 | 9.0 | added | 100 | 61 | 77 (−23) |
| 202 (Invention) | 2-A | 7.8 | 0.144 | 7.5 | added | 108 | 57 | 97 (−11) |
| 203 (Invention) | 2-A | 7.8 | 0.144 | 6.0 | added | 115 | 55 | 106 (−9) |
| 204 (Invention) | 2-A | 7.8 | 0.144 | 5.0 | added | 111 | 60 | 101 (−10) |
| 205 (Comp. Ex.) | 2-B | 18.3 | 0.082 | 9.0 | added | 122 | 50 | 100 (−22) |
| 206 (Invention) | 2-B | 18.3 | 0.082 | 7.5 | added | 130 | 47 | 120 (−10) |
| 207 (Invention) | 2-B | 18.3 | 0.082 | 6.0 | added | 137 | 44 | 131 (−6) |

TABLE 6-continued

| Sample No. | Emulsion | Average aspect ratio | Average grain thickness (μm) | Film pAg | Organic silver salt | Heat development (60° C. 30" developed) Relative sensitivity | RMA value × 1000 | Relative sensitivity after storage |
|---|---|---|---|---|---|---|---|---|
| 203 (Invention) | 2-B | 18.3 | 0.082 | 5.0 | added | 130 | 49 | 127 (−3) |
| 209 (Comp. Ex.) | 2-C | 24.1 | 0.068 | 9.0 | added | 135 | 51 | 108 (−27) |
| 210 (Invention) | 2-C | 24.1 | 0.068 | 7.5 | added | 164 | 47 | 158 (−6) |
| 211 (Invention) | 2-C | 24.1 | 0.068 | 6.0 | added | 175 | 45 | 171 (−4) |
| 212 (Invention) | 2-C | 24.1 | 0.068 | 5.0 | added | 171 | 47 | 169 (−2) |
| 213 (Comp. Ex.) | 2-C | 24.1 | 0.068 | 9.0 | none | 110 | 58 | 88 (−22) |
| 214 (Invention) | 2-C | 24.1 | 0.068 | 7.5 | none | 159 | 53 | 148 (−11) |
| 215 (Invention) | 2-C | 24.1 | 0.068 | 6.0 | none | 170 | 53 | 161 (−9) |
| 216 (Invention) | 2-C | 24.1 | 0.068 | 5.0 | none | 166 | 54 | 160 (−6) |

It is apparent from the above results that a highly sensitive light-sensitive material strikingly improved in graininess can be provided by the light-sensitive material of the present invention containing a tabular silver halide emulsion wherein the average grain thickness is smaller than 0.12 μm, which light-sensitive material can be heat developed by virtue of a built-in developing agent. Further, the samples of the present invention containing an organosilver salt exhibited enhanced performance in the graininess and storage stability of light-sensitive material.

EXAMPLE 3

Preparation of Tabular Seed Emulsion 4220 mL of distilled water containing 3.17 g of oxidized gelatin having a weight average molecular weight of 15,000 and 3.17 g of KBr was placed in a reaction vessel, and heated to 35° C. Under vigorous agitation, 158 mL of an aqueous solution containing 31.7 g of $AgNO_3$ and 158 mL of an aqueous solution containing 22.2 g of KBr and 5.27 g of gelatin having a weight average molecular weight of 15,000 were added to the solution by the double jet method over a period of 60 sec. Immediately after the completion of addition, 5.28 g of KBr was added. 249 mL of an aqueous solution containing 39.8 g of $AgNO_3$ and 258 mL of an aqueous solution containing 29.1 g of KBr were added by the double jet method over a period of 120 sec. Immediately after the completion of addition, 4.78 g of KBr was added. The temperature of the reaction mixture was maintained at 40° C. for 1 min after the completion of addition, and raised to 75° C. 92.3 g of gelatin phthalate wherein 97% of amino groups had been modified by phthalic acid and 7.92 g of KBr were added. An aqueous solution of KBr and 160 mL of an aqueous solution containing 51.0 g of $AgNO_3$ were added over a period of 12 min while increasing the flow rate so that the final flow rate was 1.4 times the initial flow rate. During this period, the silver potential against saturated calomel electrode was maintained at −60 mV. The mixture was cooled to 40° C. and desalted by the customary flocculation method. Thereafter, gelatin was added so that the pH and pAg were adjusted to 5.7 and 8.8, respectively.

Preparation of Emulsion 3-A 1211 ml of an aqueous solution containing 46.0 g of gelatin phthalate and 1.7 g of KBr was vigorously agitated while maintaining its temperature at 75° C. 9.9 g of the above seed emulsion was added, and 0.3 g of modified silicone oil (L7602, produced by Nippon Unicar Company, Limited) was added. The pH value was adjusted to 5.5 by the addition of $H_2SO_4$. An aqueous solution of KBr and 67.6 mL of an aqueous solution containing 7.0 g of $AgNO_3$ were added over a period of 6 min while increasing the flow rate so that the final flow rate was 5.1 times the initial flow rate. During this period, the silver potential against saturated calomel electrode was maintained at −20 mV. The mixture was cooled to 40° C., and 2 mg of sodium benzenethiosulfinate and 2 mg of thiourea dioxide were added. In an agitator-equipped apparatus provided outside the reaction vessel, 762 mL of an aqueous solution containing 134.4 g of $AgNO_3$ and 762 mL of an aqueous solution containing 90.1 g of KBr, 9.46 g of KI and 38.1 g of gelatin having a weight average molecular weight of 20,000 were simultaneously introduced to thereby produce AgBrI fine grain emulsion of 7 mol % silver iodide content (average size: 0.015 μm). While conducting the production, the AgBrI fine grain emulsion was added to the mixture within the reaction vessel over a period of 90 min. During this period, the silver potential against saturated calomel electrode was maintained at −30 mV.

An aqueous solution of KBr and 121 mL of an aqueous solution containing 45.6 g of $AgNO_3$ were added by the double jet method over a period of 22 min. During this period, the silver potential against saturated calomel electrode was maintained at +20 mV. The mixture was heated to 78° C., and KBr was added to thereby adjust the silver potential to −80 mV. Thereafter, 0.03 μm grain size AgI fine grain emulsion was added in an amount, in terms of KI, of 6.33 g. Immediately after the completion of addition, 206 mL of an aqueous solution containing 66.4 g of $AgNO_3$ was added over a period of 16 min. For 5 min in the initial stage of addition, the silver potential was maintained at −80 mV by the use of an aqueous solution of KBr. The resultant mixture was cooled and desalted by the customary method. Gelatin was added so that the pH and pAg thereof at 40° C. were adjusted to 5.8 and 8.7, respectively. In the obtained emulsion, tabular grains with an average aspect ratio of 5 or more occupied a percentage exceeding 90% of the total projected area of all the grains. The emulsion consisted of hexagonal tabular grains having an average grain size, in terms of equivalent sphere diameter, of 1.70 μm and an average aspect ratio of 12.0.

The obtained emulsion was loaded with sensitizing dye D-15 ($4.5\times10^{-4}$ mol/mol Ag), potassium thiocyanate, chloroauric acid, sodium thiosulfate and mono (pentafluorophenyl)diphenylphosphine selenide so that a spectral sensitization and a chemical sensitization were carried out. Upon the completion of chemical sensitization, the following compounds 11 and 12 were added. The amount of chemical sensitizer was regulated so as to optimize the degree of chemical sensitization of the emulsion.

Compound-11)

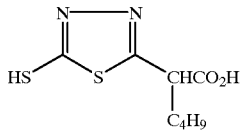

(Compound-12)

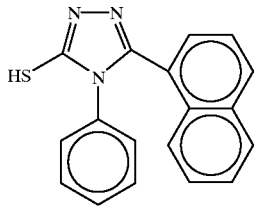

Preparation of Emulsion 3-B

The emulsion 3-B was prepared in the same manner as the emulsion 3-A except that, after the spectral sensitization and chemical sensitization by loading with sensitizing dye D-15 ($4.5\times10^{-4}$ mol/mol Ag), potassium thiocyanate, chloroauric acid, sodium thiosulfate and mono(pentafluorophenyl) diphenylphosphine selenide, sensitizing dye D-15 was added in an amount of $0.5\times10^{-4}$ mol/mol Ag and agitated for 10 min, and, further, sensitizing dye D-20 was added in an amount of $1.0\times10^{-3}$ mol/mol Ag and agitated for 60 min to thereby complete the chemical sensitization.

Measurement of Light Absorption Intensity

The light absorption intensity per unit area was determined by coating a slide glass with the obtained emulsion in a small thickness and effecting measurement by means of microspectrophotometer MSP 65 manufactured by Karlzeis in the following manner.

First, with respect to grains to be investigated, a transmission spectrum and a reflection spectrum were taken, thereby determining an absorption spectrum. The portion wherein no grains existed was used as the reference transmission spectrum. On the other hand, as the reference reflection spectrum, use was made of measurement of silicon carbide whose reflection factor was known. The measured portion was a circular aperture of 1 $\mu$m diameter, and positions were adjusted so as to avoid the overlapping of grain contours by the aperture portion. Thus, the transmission spectrum and reflection spectrum were taken in the range of wave number from 14,000 $cm^{-1}$ (714 nm) to 28,000 $cm^{-1}$ (357 nm). Assuming that absorption factor A=1−T (transmission factor)−R(reflection factor), an absorption spectrum was determined. The light absorption intensity per unit surface area was defined as ½ of an integral value, over wave number ($cm^{-1}$), of −Log (1−A'), wherein A' represented an absorption factor in which the absorption by silver halides was deducted. The range of integration was from 14,000 $cm^{-1}$ to 28,000 $cm^{-1}$. A tungsten lamp was used as a light source for measurement, and the light source voltage was 8 V. In order to minimize the damage to dyes by light irradiation, use was made of the primary-side monochrometer, and the wavelength interval and slit width were set for 2 nm and 2.5 nm, respectively.

As a result of measurement, the average light absorption intensity over 200 grains of the emulsion 3-A was 51 (variation coefficient: 9.4) while that of the emulsion 3-B was 121 (variation coefficient: 46.9).

Preparation of 5-amino-3-benzylthiotriazole Silver Salt (Organosilver Salt) Dispersion 11.3 g of 5-amino-3-benzylthiotriazole, 1.1 g of sodium hydroxide and 10 g of gelatin were dissolved in 1000 mL of water. The resultant solution was agitated while maintaining its temperature at 50° C. A solution of 8.5 g of silver nitrate in 100 mL of water was added to the above solution over a period of 2 min. An emulsion was precipitated by regulating the pH value of the emulsion so as to remove excess salts. Thereafter, the pH value was adjusted to 6.0. Thus, 400 g (yield) of a dispersion of 5-amino-3-benzylthiotriazole silver salt was obtained.

For obtaining a light-sensitive material, the preparation of a support and the coating formation of substratum, back 1st layer (antistatic layer), back 2nd layer (magnetic recording layer) and back 3rd layer (sliding layer) were carried out in the following manner.

(1) Preparation of Support

The support employed in this Example was produced according to the following procedure. 100 parts by weight of polyethylene 2,6-naphthalenedicarboxylate (PEN) and 2 parts by weight of ultraviolet absorbent Tinuvin P.326 (produced by Ciba-Geigy) were homogeneously mixed together. The mixture was melted at 300° C., extruded through T-die, longitudinally drawn at a ratio of 3.3 at 140° C., transversely drawn at a ratio of 4.0 and thermoset at 250° C. for 6 sec. Thus, a 90 $\mu$m thick PEN film was obtained. This PEN film was loaded with appropriate amounts of blue, magenta and yellow dyes (I-1, I-4, I-6, I-24, I-26, I-27 and II-5 described in JIII Journal of Technical Disclosure No. 94-6023). Further, the film was wound round a stainless steel core of 30 cm diameter and heated at 110° C. for 48 hr so as to give a heat history. Thus, the support resistant to curling was obtained.

(2) Formation of Substratum By Coating

Glow treatment of the PEN support on its both surfaces was performed in the following manner. Four rod electrodes of 2 cm diameter and 40 cm length were fixed at intervals of 10 cm on an insulating board in a vacuum tank. The electrodes were arranged so as to allow the support film to travel at a distance of 15 cm therefrom. A heating roll of 50 cm diameter fitted with a temperature controller was disposed just ahead of the electrodes. The support film was set so as to contact a ¾ round of the heating roll. The support film, 90 $\mu$m thick and 30 cm wide biaxially oriented film, was traveled and heated by the heating roll so that the temperature of the film surfaces between the heating roll and the electrode zone was 115° C. The support film was carried at a speed of 15 cm/sec and underwent glow treatment.

Glow treatment was performed under such conditions that the pressure within the vacuum tank was 26.5 Pa, and the $H_2O$ partial pressure of ambient gas 75%. Further, the conditions were such that the discharge frequency was 30 KHz, the output 2500 W, and the treating strength 0.5 $KV\cdot A\cdot min/m^2$. With respect to the vacuum glow discharge electrodes, the method described in JP-A-7-003056 was followed.

One side (emulsion side) of the glow-treated PEN support was furnished with a substratum of the following recipe. The dry film thickness was designed so as to be 0.02 $\mu$m. The drying was performed at 115° C. for 3 min.

| | |
|---|---|
| Gelatin | 83 pts. wt. |
| Water | 291 pts. wt. |
| Salicylic acid | 18 pts. wt. |
| Aerosil R972 (colloidal silica, produced by Nippon Aerosil Co., Ltd.) | 1 pt. wt. |
| Methanol | 6900 pts. wt. |
| n-Propanol | 830 pts. wt. |
| Polyamide-epichlorohydrin resin described in JP-A-51-3619. | 25 pts. wt. |

(3) Formation of Back 1st Layer (Antistatic Layer) By Coating

Liquid mixture of 40 parts by weight of SN-100 (conductive fine particles produced by Ishihara Sangyo Kaisha, Ltd.) and 60 parts by weight of water, while adding a 1N aqueous solution of sodium hydroxide thereto, was agitated by an agitator to thereby form a coarse dispersion and subjected to dispersion by means of a horizontal sand mill. Thus, a dispersion of conductive fine particles of 0.06 $\mu$m secondary particle average diameter (pH 7.0) was obtained.

The coating liquid of the following composition was applied onto the surface-treated PEN support (back side) so that the coating amount of conductive fine particles was 270 mg/m$^2$. The drying was performed at 115° C. for 3 min.

| | |
|---|---|
| SN-100 (conductive fine particles produced by Ishihara Sangyo Kaisha, Ltd.) | 270 pts. wt. |
| Gelatin | 23 pts. wt. |
| Rheodol TW-L120 (surfactant produced by Kao Corp.) | 6 pts. wt. |
| Denacol EX-521 (film hardener produced by Nagase Chemtex Corporation) | 9 pts. wt. |
| Water | 5000 pts. wt. |

(4) Formation of Back 2nd Layer (Magnetic Recording Layer) By Coating

Magnetic particles CSF-4085V2 ($\gamma$-$Fe_2O_3$ coated with Co, produced by Toda Kogyo Co., Ltd.) were surface treated with 16% by weight, based on the magnetic particles, of X-12-641 (silane coupling agent produced by Shin-Etsu Chemical Co., Ltd.).

The back 1st layer on its upper side was coated with the coating liquid of the following composition so that the coating amount of CSF-4085V2 treated with the silane coupling agent was 62 mg/m$^2$. The magnetic particles and abrasive were dispersed by the method of JP-A-6-035092. The drying was performed at 115° C. for 1 min.

| | |
|---|---|
| Diacetylcellulose (binder) | 1140 pts. wt. |
| CSF-4085V2 treated with X-12-641 (magnetic particles) | 62 pts. wt. |
| AKP-50 (alumina abrasive produced by Sumitomo Chemical Co., Ltd.) | 40 pts. wt. |
| Millionate MR-400 (film hardener produced by Nippon Polyurethane Co., Ltd.) | 71 pts. wt. |
| Cyclohexanone | 12000 pts. wt. |
| Methyl ethyl ketone | 12000 pts. wt. |

The $D^B$ color density increment of the magnetic recording layer through X-light (blue filter) was about 0.1. Further, with respect to the magnetic recording layer, the saturation magnetization moment, coercive force and rectangular ratio were 4.2 Am$^2$/kg, 7.3×10$^4$ A/m and 65%, respectively.

(5) Formation of Back 3rd Layer (Sliding Layer) By Coating

The light-sensitive material on its magnetic recording layer side was coated with the back 3rd layer.

Wax (1-2) of the following formula was emulsified in water by means of a high-voltage homogenizer, thereby obtaining a wax water dispersion of 10% by weight concentration and 0.25 $\mu$m weight average diameter.

Wax (1-2): n-$C_{17}H_{35}COOC_{40}H_{81}$–n.

The magnetic recording layer (back 2nd layer) on its upper side was coated with the coating liquid of the following composition so that the coating amount of wax was 27 mg/m$^2$. The drying was performed at 115° C. for 1 min.

| | |
|---|---|
| Wax water dispersion mentioned above (10% by weight) | 270 pts.wt. |
| Pure water | 176 pts.wt. |
| Ethanol | 7123 pts.wt. |
| Cyclohexanone | 841 pts.wt. |

Yellow coupler (a), developing agent (DEVP-26), antifoggant (b),(c), high-boiling organic solvent (d),(e) and ethyl acetate were mixed together at 60° C. to thereby obtain a solution. This solution was mixed into an aqueous solution wherein lime-processed gelatin and sodium dodecylbenzenesulfonate were dissolved, and emulsified and dispersed by means of a dissolver agitator at 10,000 rpm over a period of 20 min. Thus, a dispersion of yellow coupler and developing agent was obtained.

Yellow coupler (a)

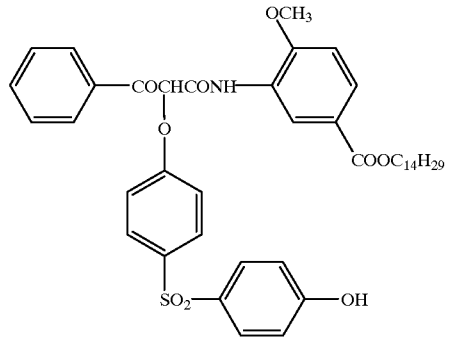

Antifoggant (b)

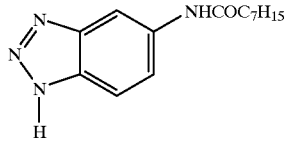

Antifoggant (c)

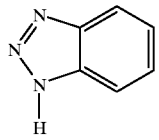

-continued

High-boiling organic solvent (d)

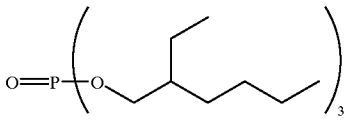

High-boiling organic solvent (e)

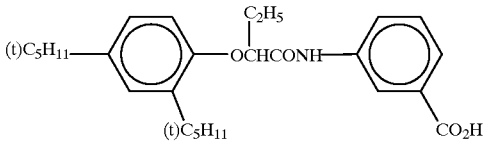

Magenta coupler (f), magenta coupler (g), developing agent (DEVP-26), antifoggant (b), high-boiling organic solvent (h) and ethyl acetate were mixed together at 60° C. to thereby obtain a solution. This solution was mixed into an aqueous solution wherein lime-processed gelatin and sodium dodecylbenzenesulfonate were dissolved, and emulsified and dispersed by means of a dissolver agitator at 10,000 rpm over a period of 20 min. Thus, a dispersion of magenta coupler and developing agent was obtained.

Magenta coupler (f)

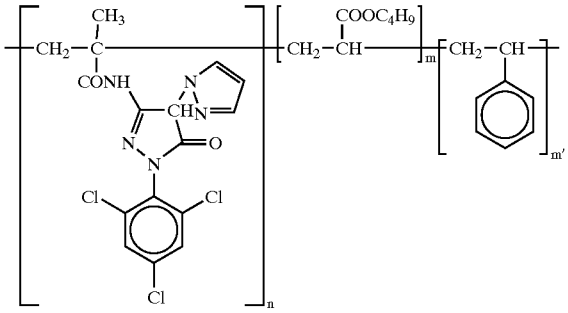

n = 50
m = 25
m′ = 25
mol.wt. about 20,000

Magenta coupler (g)

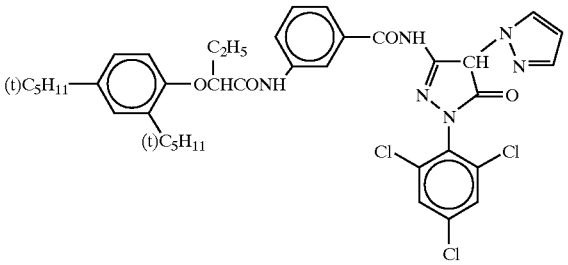

High-boiling solvent (h)

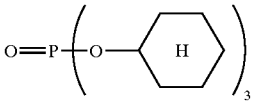

-continued

High-boiling solvent (h)

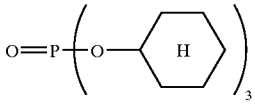

Cyan coupler (i), cyan coupler (j), developing agent (DEVP-26), antifoggant (b), high-boiling organic solvent (h), (k) and ethyl acetate were mixed together at 60° C. to thereby obtain a solution. This solution was mixed into an aqueous solution wherein lime-processed gelatin and sodium dodecylbenzenesulfonate were dissolved, and emulsified and dispersed by means of a dissolver agitator at 10,000 rpm over a period of 20 min. Thus, a dispersion of cyan coupler and developing agent was obtained.

Cyan coupler (i)

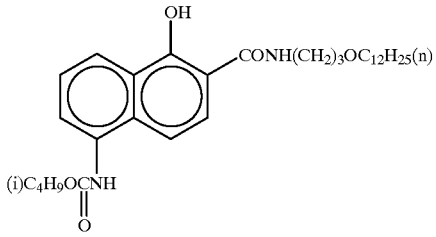

Cyan coupler (j)

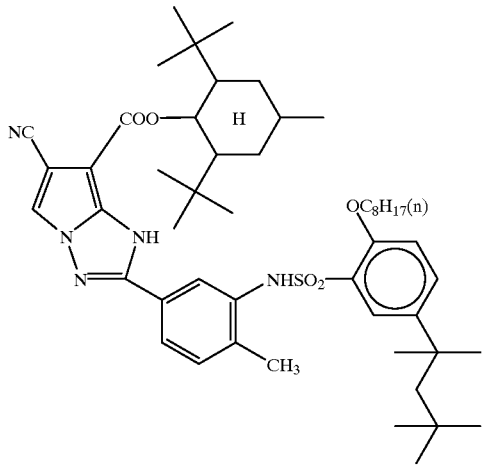

High-boiling organic solvent (k)

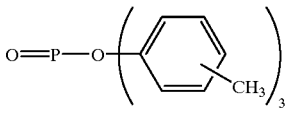

Furthermore, dispersions of dyes for coloring interlayers as a filter layer and an antihalation layer were prepared in the same manner. Individual dyes and high-boiling organic solvents employed for dispersing them are set forth below.

Yellow dye (1)

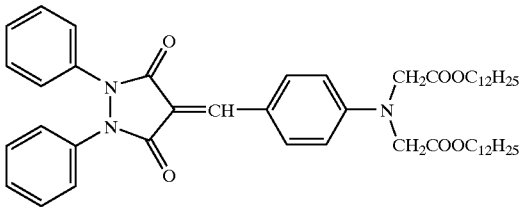

High-boiling organic solvent (m)

A 1:1 mixture of

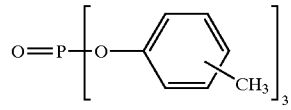

and Ajinomoto Empara K65 produced by Ajinomoto Co., Ltd.

Magenta dye (n)

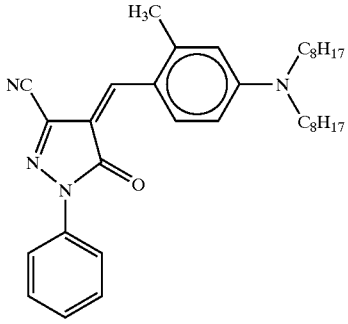

High-boiling organic solvent (o)

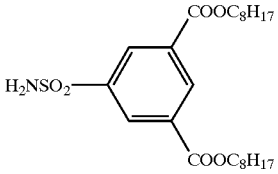

Cyan dye (p)

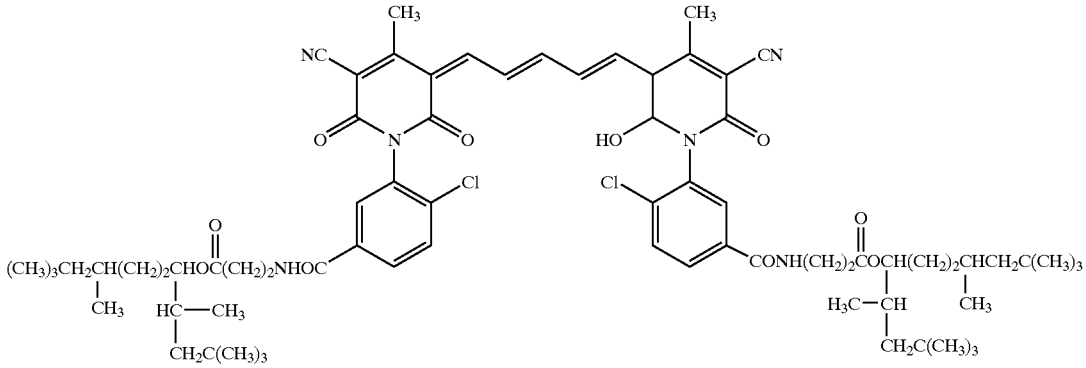

Preparation of Base Precursor Solid Fine Particle Dispersion 64 g of base precursor compound (w), 28 g of diphenyl sulfone and lOg of surfactant Demol N produced by Kao Corporation were mixed with 220 mL of distilled water. The mixture was dispersed with beads by means of a sand mill (¼ gallon sand grinder mill, manufactured by Aimex Co., Ltd.). Thus, a solid fine particle dispersion of 0.2 $\mu$m average particle diameter base precursor compound was obtained.

Preparation of Multilayer Coating Sample

Sample 301 having a multilayer color light-sensitive material specified in Table 7 opposite to the above back layers was prepared.

TABLE 7

| Sample 301 | Addn. amt. (mg/m$^2$) |
|---|---|
| 14th layer | |
| Protective layer | |
| Alkali-processed delimed gelatin | 950 |
| Matting agent (silica) | 55 |
| Surfactant (q) | 32 |
| surfactant (r) | 43 |

TABLE 7-continued

| Sample 301 | Addn. amt. (mg/m$^2$) |
|---|---|
| Water-soluble polymer (s) | 17 |
| Film hardener (t) | 105 |
| 13th layer | |
| Interlayer | |
| Alkali-processed delimed gelatin | 455 |
| Surfactant (r) | 8 |
| Base precursor compound (w) | 425 |
| Formaldehyde scavenger (u) | 312 |
| D-sorbitol | 60 |
| Water-soluble polymer (s) | 20 |
| Film pAg regulating agent | |
| 12th layer | |
| Yellow coloring layer (high-speed layer) | |
| Alkali-processed delimed gelatin | 1750 |
| Emulsion 3-A (in terms of coating silver amt.) | 560 |
| 5-amino-3-benzylthiotriazole silver salt | 160 |
| Yellow coupler (a) | 170 |
| Developing agent (DEVP-26) | 225 |
| Antifoggant (b) | 3.8 |
| Antifoggant (c) | 5.0 |
| High-boiling organic solvent (d) | 90 |
| High-boiling organic solvent (e) | 90 |
| Surfactant (v) | 30 |

TABLE 7-continued

| Sample 301 | Addn. amt. (mg/m$^2$) |
|---|---|
| D-sorbitol | 210 |
| Water-soluble polymer (s) | 1 |
| 11th layer | |
| Yellow coloring layer (medium-speed layer) | |
| Alkali-processed delimed gelatin | 1400 |
| Emulsion 3-C (in terms of coating silver amt.) | 267 |
| 5-amino-3-benzylthiotriazole silver salt | 190 |
| Yellow coupler (a) | 175 |
| Developing agent (DEVP-26) | 310 |
| Antifoggant (b) | 5.0 |
| Antifoggant (c) | 10.0 |
| High-boiling organic solvent (d) | 135 |
| High-boiling organic solvent (e) | 135 |
| Surfactant (v) | 30 |
| D-sorbitol | 140 |
| Water-soluble polymer (s) | 2 |
| 10th layer | |
| Yellow coloring layer (low-speed layer) | |
| Alkali-processed delimed gelatin | 1610 |
| Emulsion 3-D (in terms of coating silver amt.) | 225 |
| 5-amino-3-benzylthiotriazole silver salt | 220 |
| Yellow coupler (a) | 456 |
| Developing agent (DEVP-26) | 553 |
| Antifoggant (b) | 9.0 |
| Antifoggant (c) | 16.0 |
| High-boiling organic solvent (d) | 220 |
| High-boiling organic solvent (e) | 220 |
| Surfactant (v) | 25 |
| D-sorbitol | 1140 |
| Water-soluble polymer (s) | 2 |
| 9th layer | |
| Interlayer (yellow filter layer) | |
| Alkali-processed delimed gelatin | 580 |
| Surfactant (v) | 20 |
| Surfactant (r) | 20 |
| Base precursor compound (w) | 510 |
| Dye (1) | 80 |
| High-boiling organic solvent (m) | 80 |
| Water-soluble polymer (s) | 20 |
| 8th layer | |
| Magenta coloring layer (high-speed layer) | |
| Alkali-processed delimed gelatin | 780 |
| Emulsion 3-E (in terms of coating silver amt.) | 450 |
| 5-amino-3-benzylthiotriazole silver salt | 65 |
| Magenta coupler (f) | 55 |
| Magenta coupler (g) | 26 |
| Developing agent (DEVP-26) | 85 |
| Antifoggant (b) | 1.3 |
| High-boiling organic solvent (h) | 78 |
| Surfactant (v) | 10 |
| D-sorbitol | 105 |
| Water-soluble polymer (s) | 9 |
| 7th layer | |
| Magenta coloring layer (medium-speed layer) | |
| Alkali-processed delimed gelatin | 660 |
| Emulsion 3-F (in terms of coating silver amt.) | 402 |
| 5-amino-3-benzylthiotriazole silver salt | 60 |
| Magenta coupler (f) | 98 |
| Magenta coupler (g) | 54 |
| Developing agent (DEVP-26) | 170 |
| Antifoggant (b) | 2.4 |
| High-boiling organic solvent (h) | 155 |
| Surfactant (v) | 13 |
| D-sorbitol | 86 |
| Water-soluble polymer (s) | 16 |

TABLE 7-continued

| Sample 301 | Addn. amt. (mg/m$^2$) |
|---|---|
| 6th layer | |
| Magenta coloring layer (low-speed layer) | |
| Alkali-processed delimed gelatin | 722 |
| Emulsion 3-G (in terms of coating silver amt.) | 242 |
| 5-amino-3-benzylthiotriazole silver salt | 156 |
| Magenta coupler (f) | 228 |
| Magenta coupler (g) | 123 |
| Developing agent (DEVP-26) | 421 |
| Antifoggant (b) | 5.7 |
| High-boiling organic solvent (h) | 386 |
| Surfactant (v) | 34 |
| D-sorbitol | 84 |
| Water-soluble polymer (s) | 18 |
| 5th layer | |
| Interlayer (magenta filter layer) | |
| Alkali-processed delimed gelatin | 855 |
| Surfactant (v) | 14 |
| Surfactant (r) | 25 |
| Base precursor compound (w) | 476 |
| Dye (n) | 52 |
| High-boiling organic solvent (o) | 50 |
| Formaldehyde scavenger (u) | 300 |
| D-sorbitol | 80 |
| Water-soluble polymer (s) | 14 |
| 4th layer | |
| Cyan coloring layer (high-speed layer) | |
| Alkali-processed delimed gelatin | 840 |
| Emulsion 3-H (in terms of coating silver amt.) | 418 |
| 5-amino-3-benzylthiotriazole silver salt | 63 |
| Cyan coupler (i) | 22 |
| Cyan coupler (j) | 40 |
| Developing agent (DEVP-26) | 75 |
| Antifoggant (b) | 1.0 |
| High-boiling organic solvent (h) | 76 |
| Surfactant (v) | 6 |
| D-sorbitol | 88 |
| Water-soluble polymer (s) | 20 |
| 3rd layer | |
| cyan coloring layer (medium-speed layer) | |
| Alkali-processed delimed gelatin | 475 |
| Emulsion 3-I (in terms of coating silver amt.) | 410 |
| 5-amino-3-benzylthiotriazole silver salt | 105 |
| Cyan coupler (i) | 50 |
| Cyan coupler (j) | 130 |
| Developing agent (DEVP-26) | 224 |
| Antifoggant (b) | 2.5 |
| High-boiling organic solvent (h) | 200 |
| Surfactant (v) | 10 |
| D-sorbitol | 45 |
| Water-soluble polymer (s) | 10 |
| 2nd layer | |
| cyan coloring layer (low-speed layer) | |
| Alkali-processed delimed gelatin | 810 |
| Emulsion 3-J (in terms of coating silver amt.) | 290 |
| 5-amino-3-benzylthiotriazole silver salt | 150 |
| Cyan coupler (i) | 90 |
| Cyan coupler (j) | 230 |
| Developing agent (DEVP-26) | 405 |
| Antifoggant (b) | 4.0 |
| High-boiling organic solvent (h) | 360 |
| Surfactant (v) | 15 |
| D-sorbitol | 90 |
| Water-soluble polymer (s) | 7 |

TABLE 7-continued

| Sample 301 | Addn. amt. (mg/m$^2$) |
|---|---|
| 1st layer | |
| Antihalation layer | |
| Alkali-processed delimed gelatin | 420 |
| Surfactant (v) | 12 |
| Base precursor compound (w) | 620 |
| Dye (p) | 260 |
| High-boiling organic solvent (o) | 245 |
| Water-soluble polymer (s) | 15 |
| Transparent PET base (96 $\mu$m) | |

Surfactant (q)

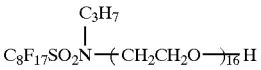

Surfacant (r)

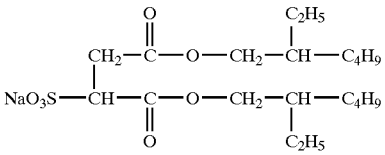

Water-souble polymer (s)

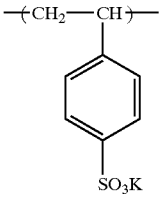

-continued

Film hardener (t)

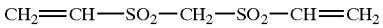

Formaldehyde scavenger (u)

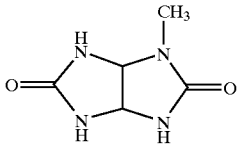

Surfacant (v)

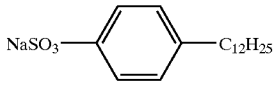

Base precursor compound (w)

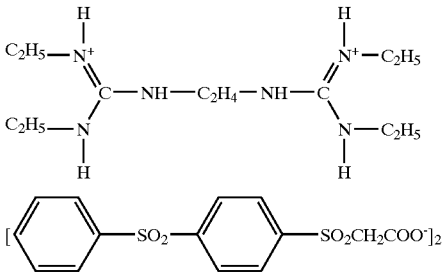

The emulsion 3-A was used in the 12th layer (high-speed yellow coloring layer), and emulsions 3-C to 3-J prepared in the same manner as employed in the process for preparing tabular emulsions, described in JP-A-1-329231, were used in the other emulsion layers. The sensitizing dyes and compositions of emulsions used in the preparation of the sample 301 are listed in Table 8.

TABLE 8

| Emulsion | Average grain size ($\mu$m) | Variation coefficient of grain diameter (%) | Average aspect ratio | Sensitizing dye | Remark |
|---|---|---|---|---|---|
| 3-A (blue-sensitive) | 1.70 | 15 | 12.0 | D-15 | Hexagonal tabular grains |
| 3-B (blue-sensitive) | 1.70 | 15 | 12.0 | D-15/D-20 | Hexagonal tabular dye multilayer adsorption grains |
| 3-C (blue-sensitive) | 0.86 | 20 | 8.0 | IV | Triple-structure tabular grains |
| 3-D (blue-sensitive) | 0.49 | 17 | 5.2 | IV | Triple-structure tabular grains |
| 3-E (green-sensitive) | 1.07 | 22 | 7.0 | I/II/III | Triple-structure tabular grains |
| 3-F (green-sensitive) | 0.86 | 20 | 8.0 | I/II/III | Triple-structure tabular grains |
| 3-G (green-sensitive) | 0.49 | 17 | 5.2 | I/II/III | Triple-structure tabular grains |
| 3-H (red-sensitive) | 1.07 | 22 | 7.0 | V/VI/VII | Triple-structure tabular grains |
| 3-I (red-sensitive) | 0.86 | 20 | 8.0 | V/VI/VII | Triple-structure tabular grains |
| 3-J (red-sensitive) | 0.49 | 17 | 5.2 | V/VI/VII | Triple-structure tabular grains |

Sensitizing dye for green-sensitive emulsion I

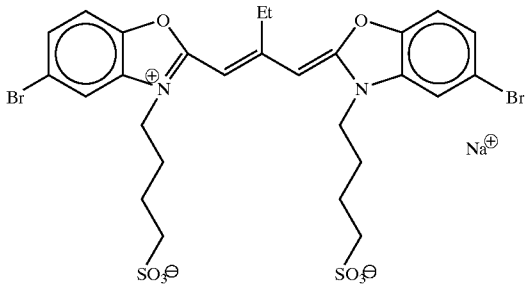

Sensitizing dye for green-sensitive emulsion II

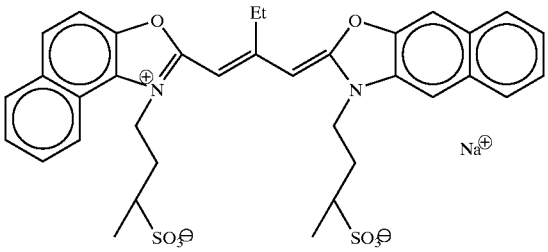

Sensitizing dye for green-sensitive emulsion III

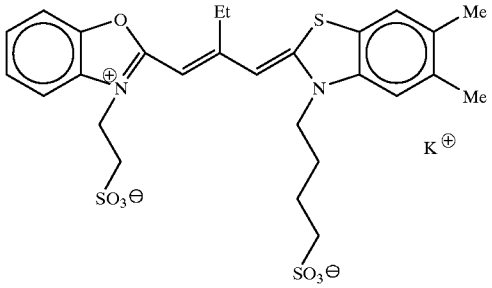

Mixture at molar ratio of I:II:III = 77:20:3

Sensitizing dye for blue-sensitive emulsion IV

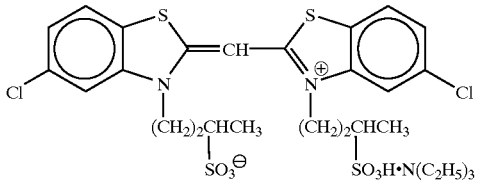

-continued

Sensitizing dye for red-sensitive emulsion V

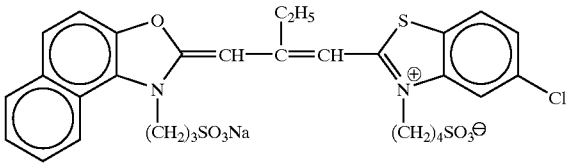

Sensitizing dye for red-sensitive emulsion VI

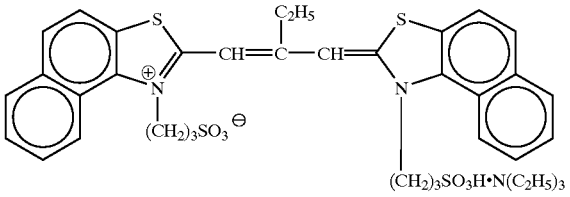

Sensitizing dye for red-sensitive emulsion VII

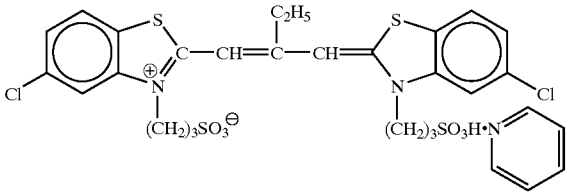

Mixture at molar ratio of V:VI:VII = 40:2:58

Samples 302 to 304 were prepared by coating under the same conditions as in the preparation of the sample 301 except that the addition amount of pAg regulating agent to the 13th layer (interlayer) was changed. Further, samples 305 to 308 were prepared by coating under the same conditions as in the preparation of the sample 301 except that the emulsion 3-A was replaced by the emulsion 3-B in the 12th layer (high-speed yellow coloring layer). Specimens were cut out from these light-sensitive material samples, and two types of sample specimens, the one immediately after the coating and the other having been stored at 45° C. in 80% relative humidity for 3 days after the coating, were provided. These sample specimens were subjected to white light exposure for 1/100 sec through an optical wedge. After the exposure, the sample specimens were heat developed for 10 sec by contacting the back layer side of the sample specimens with a heating drum heated at 150° C. The transmission density of each of the sample specimens having been colored by the heat development was measured. The sensitivity was given as the inverse number of exposure quantity corresponding to a density of yellow fog +0.2 and expressed as a relative value to that of sample 301. The obtained results are given in Table 9.

TABLE 9

| Sample No. | Emulsion of high-speed yellow coloring layer | Average aspect ratio | Average light absorption intensity (dye multilayer adsorption) | Film pAg | Heat development (150° C. 10" developed) Relative sensitivity | Relative sensitivity after storage |
|---|---|---|---|---|---|---|
| 301 (Comparative example) | 3-A | 12.0 | 51 (none) | 9.0 | 100 | 83(−17) |
| 302 (Invention) | 3-A | 12.0 | 51 (none) | 7.5 | 130 | 123(−7) |
| 303 (Invention) | 3-A | 12.0 | 51 (none) | 6.0 | 145 | 143(−2) |

TABLE 9-continued

| Sample No. | Emulsion of high-speed yellow coloring layer | Average aspect ratio | Average light absorption intensity (dye multilayer adsorption) | Film pAg | Heat development (150° C. 10" developed Relative sensitivity | Relative sensitivity after storage |
|---|---|---|---|---|---|---|
| 304 (Invention) | 3-A | 12.0 | 51 (none) | 5.0 | 152 | 147(−5) |
| 305 (Comparative example) | 3-B | 12.0 | 121 (found) | 9.0 | 167 | 135(−32) |
| 306 (Invention) | 3-B | 12.0 | 121 (found) | 7.5 | 179 | 169(−10) |
| 307 (Invention) | 3-B | 12.0 | 121 (found) | 6.0 | 182 | 177(−5) |
| 308 (Invention) | 3-B | 12.0 | 121 (found) | 5.0 | 180 | 174(−6) |

It is apparent from Table 9 that the light-sensitive material of the present invention realizes high sensitivity and excellent storage stability even if rapidly processed with such a short development time as 10 sec at 150° C. It is also apparent that, in particular, the effect of the present invention is striking in the use of sensitizing dye multilayer adsorption emulsion 3-B of high light absorption intensity,

EXAMPLE 4

A piece of 24 mm width and 160 cm length was cut from multilayer coating sample 307, and furnished with two 2 mm square perforations disposed at an interval of 5.8 mm at 0.7 mm from an extreme edge on one side in the lengthwise direction of the light-sensitive material. Sets of these two perforations were provided at intervals of 32 mm. The sample piece was accommodated in a film cartridge shown in FIGS. 1 to 7 of U.S. Pat. No. 5,296,887. The film cartridge was inserted in a camera, and various scenes were photographed with the use of the camera set for ISO 200. While photographing, a gray plate having a neutral gray color of 18% reflection factor was photographed into each subject. The same heat development as in Example 3 was carried out, and image information was read by the use of a film scanner. On the basis of the obtained image information, image processing was performed in such a manner that the neutral gray RGB values of individual images agreed with each other. Further, gradation correction was effected. Images were outputted into Pictography 3000 manufactured by Fuji Photo Film Co., Ltd. Thus, a hard copy of images was obtained. The obtained output images were highly satisfactory in image quality and color reproduction.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A silver halide photographic light-sensitive material comprising, on a support, at least one light-sensitive silver bromoiodide emulsion layer comprising a chemically sensitized silver halide emulsion, wherein the silver bromoiodide emulsion has an iodide content of from 1 mol % to 10 mol %, and at least one non-light-sensitive layer, wherein 60% or more of the total projected area of silver halide grains contained in said at least one light-sensitive silver bromoiodide emulsion layer are tabular silver halide grains having an average aspect ratio of 5 or more, and a film pAg on the light-sensitive silver halide emulsion layer side of said material falls within 4.0 to 8.0.

2. The material according to claim 1, wherein said tabular silver halide grains have an average thickness of 0.01 to 0.12 μm.

3. The material according to claim 1, wherein at least some of said tabular silver halide grains have at least a sensitizing dye adsorbed thereon so as to exhibit a spectral absorption maximum wavelength of less than 500 nm and a light absorption intensity of 60 or more, or so as to exhibit a spectral absorption maximum wavelength of 500 nm or more and a light absorption intensity of 100 or more.

4. The material according to claim 1, wherein a developing agent and/or a precursor thereof is contained in said at least one light-sensitive silver halide emulsion layer and/or said at least one non-light-sensitive layer.

5. The material according to claim 4, wherein the developing agent is at least one compound selected from among the compounds represented by the following general formulae (1) to (5):

(1)

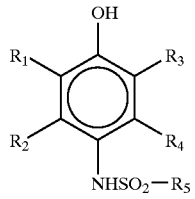

(2)

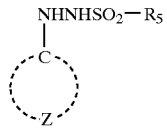

(3)

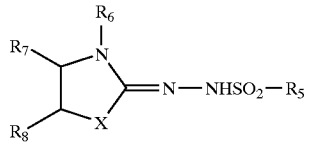

(4)

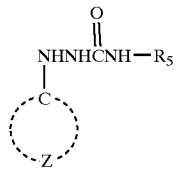

-continued (5)

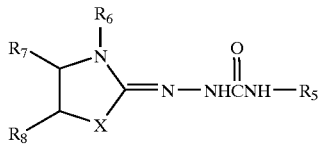

where each of $R_1$ to $R_4$ independently represents a hydrogen atom, a halogen atom, an alkyl group, an aryl group, an alkylcarbonamido group, an arylcarbonamido group, an alkylsulfonamido group, an arylsulfonamido group, an alkoxy group, an aryloxy group, an alkylthio group, an arylthio group, an alkylcarbamoyl group, an arylcarbamoyl group, a carbamoyl group, an alkylsulfamoyl group, an arylsulfamoyl group, a sulfamoyl group, a cyano group, an alkylsulfonyl group, an arylsulfonyl group, an alkoxycarbonyl group, an aryloxycarbonyl group, an alkylcarbonyl group, an arylcarbonyl group or an acyloxy group; $R_5$ represents a substituted or unsubstituted alkyl group, aryl group or heterocyclic group; Z represents an atom group (including a carbon atom of the formula) capable of forming an aromatic ring (including a heteroaromatic ring), which may have substituents other than —$NHNHSO_2$-$R_5$ or —NHNHCONH-$R_5$, provided that when Z is a benzene ring, the total of Hammett's constants (σ) of the substituents is 1 or more; $R_6$ represents a substituted or unsubstituted alkyl group; X represents an oxygen atom, a sulfur atom, a selenium atom or a tertiary nitrogen atom substituted with an alkyl or aryl; and each of $R_7$ and $R_8$ independently represents a hydrogen atom or a substituent, wherein $R_7$ and $R_8$ may be bonded to each other to thereby form a double bond or a ring.

6. The material according to claim 4, wherein the developing agent is a p-phenylenediamine compound and/or a p-aminophenol compound.

7. The material according to claim 4, wherein the developing agent precursor is a compound represented by the following general formula (6):

(6)

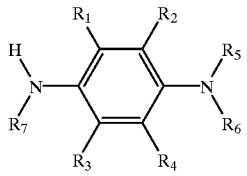

where each of $R_1$, $R_2$, $R_3$ and $R_4$ independently represents a hydrogen atom or a substituent; each of $R_5$ and $R_6$ independently represents an alkyl group, an aryl group, a heterocyclic group, an acyl group or a sulfonyl group; $R_1$ and $R_2$, $R_3$ and $R_4$, $R_5$ and $R_6$, $R_2$ and $R_5$, and/or $R_4$ and $R_6$ may be bonded to each other to thereby form a 5-membered, 6-membered or 7-membered ring; and $R_7$ represents $R_{11}$-O—CO—, $R_{12}$-CO—CO—, $R_{13}$-NH—CO—, $R_{14}$-$SO_2$—, $R_{15}$-W—C($R_{16}$)($R_{17}$)- or $(M)_{1/n}$ $OSO_2$—, wherein each of $R_{11}$, $R_{12}$, $R_{13}$ and $R_{14}$ independently represents an alkyl group, an aryl group or a heterocyclic group, $R_{15}$ represents a hydrogen atom or a block group, W represents an oxygen atom, a sulfur atom or >N-$R_{18}$, each of $R_{16}$, $R_{17}$ and $R_{18}$ independently represents a hydrogen atom or an alkyl group, and M represents a n-valence cation.

8. The material according to claim 1, wherein an organometallic salt is contained in said at least one light-sensitive silver halide emulsion layer and/or said at least one nonlight-sensitive layer.

9. A method of forming an image in the silver halide photographic light-sensitive material of claim 1, which comprises a development performed at 60 to 180° C.

10. A method of forming an image in the silver halide photographic light-sensitive material of claim 1, which comprises a development performed for a period of 5 to 60 sec.

11. The material according to claim 1, wherein the film pAg falls within 5.0 to 7.5.

12. The material according to claim 1, wherein the average aspect ratio of said tabular silver halide grains is 8 to 60.

13. The material according to claim 3, wherein said sensitizing dye is a dye having at least one aromatic group.

14. The material according to claim 13, wherein said sensitizing dye consists of a positively charged dye, or a dye having intra-molecularly offset charge, or a dye having no charge.

15. The material according to claim 3, wherein said sensitizing dye comprises a combination of a positively charged dye and a negatively charged dye, and at least one of them has at least one aromatic group as a substituent.

16. The material according to claim 3, wherein said sensitizing dye is a dye compound having two or more chromophore portions linked to each other by a covalent bond through a linking group.

17. The material according to claim 1, wherein said tabular silver halide grains have an average thickness of 0.01 to 0.07 μm.

18. The material according to claim 1, wherein at least some of said tabular silver halide grains have a sensitizing dye adsorbed thereon so as to exhibit a spectral absorption maximum wavelength of less than 500 nm and a light absorption intensity of 90 or more, or so as to exhibit a spectral absorption maximum wavelength of 500 nm or more and a light absorption intensity of 150 or more.

19. The material according to claim 3 containing a compound of the formula:

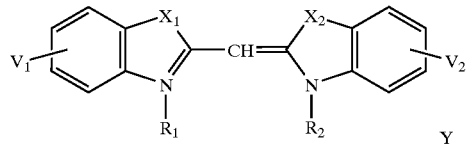

Y wherein X1 is S,
X2 is S,
V1 is 5-Ph,
V2 is 5'-Ph
R1 is

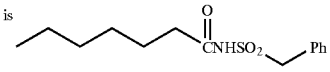

R2 is

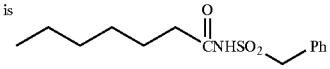

and

Y is

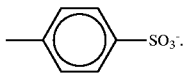

20. The material according to claim 1, wherein the film pAg on the light-sensitive silver halide emulsion side of the material falls within 5.0 to 7.5.

* * * * *